US012758064B2

(12) United States Patent
Conrad

(10) Patent No.: US 12,758,064 B2
(45) Date of Patent: Oct. 13, 2026

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 819 days.

(21) Appl. No.: 18/108,238

(22) Filed: Feb. 10, 2023

(65) Prior Publication Data

US 2023/0240488 A1 Aug. 3, 2023

Related U.S. Application Data

(63) Continuation of application No. 16/450,304, filed on Jun. 24, 2019, now abandoned, which is a (Continued)

(51) Int. Cl.

| | |
|---|---|
| ***A47L 5/24*** | (2006.01) |
| ***A47L 5/22*** | (2006.01) |
| ***A47L 5/32*** | (2006.01) |
| ***A47L 5/36*** | (2006.01) |
| ***A47L 9/16*** | (2006.01) |

(Continued)

(52) U.S. Cl.

CPC ..... *A47L 5/24* (2013.01); *A47L 5/225* (2013.01); *A47L 5/32* (2013.01); *A47L 5/362* (2013.01); *A47L 9/16* (2013.01); *A47L 9/1608* (2013.01); *A47L 9/165* (2013.01); *A47L 9/1666* (2013.01); *A47L 9/1683* (2013.01); *A47L 9/22* (2013.01); *A47L 9/2857* (2013.01); *A47L 9/322* (2013.01); *A47L 9/325* (2013.01); *A47L 9/19* (2013.01)

(58) Field of Classification Search

CPC .... A47L 9/1683; A47L 9/1608; A47L 9/1666; A47L 9/1691; A47L 9/165; A47L 9/1625; A47L 9/106; A47L 5/24

See application file for complete search history.

(56) References Cited

U.S. PATENT DOCUMENTS 3,320,727 A * 5/1967 Farley ..... A47L 9/165 55/378

3,543,325 A 12/1970 Hamrick (Continued)

FOREIGN PATENT DOCUMENTS

AU 2008201597 A1 11/2008

AU 2011211368 B2 9/2012

(Continued)

OTHER PUBLICATIONS

English machine translation of CN1323566A, published on Nov. 28, 2001.

(Continued)

*Primary Examiner* — Joel D Crandall

(74) *Attorney, Agent, or Firm* — Philip C. Mendes da Costa; SMART & BIGGAR LP

(57) ABSTRACT

A hand vacuum cleaner having an air flow path extending from a dirty air inlet to a clean air outlet, with an air treatment member and a suction motor positioned in the air flow path, the dirty air inlet comprising a flow conduit having an inlet axis. A pistol grip handle is provided wherein the inlet axis intersects the pistol grip handle, and the suction motor is provided at a lower end of the pistol grip handle.

20 Claims, 54 Drawing Sheets

Related U.S. Application Data continuation of application No. 15/184,954, filed on Jun. 16, 2016, now Pat. No. 10,376,112, which is a continuation-in-part of application No. 14/994,495, filed on Jan. 13, 2016, now abandoned, and a continuation of application No. 14/932,816, filed on Nov. 4, 2015, now Pat. No. 9,693,666, and a continuation of application No. 13/779,405, filed on Feb. 27, 2013, now Pat. No. 9,433,332, said application No. 14/932,816 is a continuation of application No. 13/040,676, filed on Mar. 4, 2011, now Pat. No. 9,211,044, said application No. 14/994,495 is a continuation of application No. 13/039,376, filed on Mar. 3, 2011, now Pat. No. 9,265,395, which is a continuation-in-part of application No. 12/722,705, filed on Mar. 12, 2010, now Pat. No. 8,578,555.

(51) Int. Cl.

| | |
|---|---|
| ***A47L 9/19*** | (2006.01) |
| ***A47L 9/22*** | (2006.01) |
| ***A47L 9/28*** | (2006.01) |
| ***A47L 9/32*** | (2006.01) |

(56) References Cited

U.S. PATENT DOCUMENTS 3,870,486 A * 3/1975 Eriksson ..... A47L 7/0019 55/467
4,011,624 A 3/1977 Proett
4,523,936 A 6/1985 Disanza, Jr.
4,831,685 A 5/1989 Bosyj et al.
4,905,342 A 3/1990 Ataka
4,920,606 A 5/1990 Gerke, Jr. et al.
5,065,473 A 11/1991 Krasznai et al.
5,078,761 A * 1/1992 Dyson ..... A47L 9/1633 96/400
5,129,125 A 7/1992 Gamou et al.
5,267,371 A 12/1993 Soler et al.
5,287,591 A 2/1994 Rench et al.
5,307,538 A 5/1994 Rench et al.
5,347,679 A 9/1994 Saunders et al.
5,358,290 A 10/1994 Fleet et al.
5,363,535 A 11/1994 Rench et al.
5,970,572 A 10/1999 Thomas
5,974,625 A 11/1999 Garner
6,098,244 A 8/2000 Conrad et al.
6,099,661 A 8/2000 Conrad
6,101,672 A 8/2000 Conrad et al.
6,123,779 A 9/2000 Conrad et al.
6,129,775 A 10/2000 Conrad et al.
6,135,708 A 10/2000 Conrad et al.
6,168,716 B1 1/2001 Conrad et al.
6,170,119 B1 1/2001 Conrad et al.
6,173,474 B1 1/2001 Conrad
6,174,127 B1 1/2001 Conrad et al.
6,183,641 B1 2/2001 Conrad et al.
6,210,469 B1 4/2001 Tokar
6,224,325 B1 5/2001 Conrad et al.
6,228,260 B1 5/2001 Conrad et al.
6,231,645 B1 5/2001 Conrad et al.
6,238,177 B1 5/2001 Conrad et al.
6,243,917 B1 6/2001 Conrad
6,251,296 B1 6/2001 Conrad et al.
6,261,052 B1 7/2001 Conrad et al.
6,261,379 B1 7/2001 Conrad et al.
6,280,143 B1 8/2001 Parker et al.
6,307,358 B1 10/2001 Conrad
6,312,594 B1 11/2001 Conrad et al.
6,328,527 B1 12/2001 Conrad et al.
6,334,234 B1 1/2002 Conrad et al.
6,344,064 B1 2/2002 Conrad
6,434,785 B1 8/2002 Vandenbelt et al.
6,440,197 B1 8/2002 Conrad et al.
6,457,205 B1 10/2002 Conrad
6,502,278 B2 1/2003 Oh et al.
6,533,834 B2 3/2003 Conrad et al.
6,599,340 B2 7/2003 Conrad et al.
6,613,129 B2 * 9/2003 Gen ..... B01D 50/20 55/318
6,712,868 B2 3/2004 Murphy et al.
6,732,403 B2 5/2004 Moore et al.
6,782,585 B1 8/2004 Conrad et al.
6,810,558 B2 11/2004 Lee
6,902,596 B2 * 6/2005 Conrad ..... A47L 9/1691 55/459.1
6,974,488 B2 12/2005 Dyson
7,028,369 B2 4/2006 Park et al.
7,329,294 B2 2/2008 Conrad
7,370,387 B2 5/2008 Walker et al.
7,485,164 B2 2/2009 Jeong et al.
7,544,224 B2 6/2009 Tanner et al.
7,740,675 B2 6/2010 Conrad
7,749,293 B2 7/2010 Conrad
7,776,120 B2 8/2010 Conrad
7,803,207 B2 9/2010 Conrad
7,811,345 B2 10/2010 Conrad
7,867,308 B2 1/2011 Conrad
7,882,593 B2 2/2011 Beskow et al.
7,931,716 B2 4/2011 Oakham
7,941,895 B2 5/2011 Conrad
8,100,999 B2 1/2012 Ashbee et al.
8,117,712 B2 2/2012 Dyson et al.
8,127,398 B2 3/2012 Conrad
8,146,201 B2 4/2012 Conrad
8,151,407 B2 4/2012 Conrad
8,156,609 B2 4/2012 Milne et al.
8,176,596 B2 5/2012 Conrad
8,192,515 B2 6/2012 Conrad
8,292,979 B2 10/2012 Conrad
8,296,900 B2 10/2012 Conrad
8,302,251 B2 11/2012 Beskow et al.
8,347,455 B2 1/2013 Dyson et al.
8,349,428 B2 1/2013 Conrad
8,370,993 B2 2/2013 Conrad
8,375,508 B2 2/2013 Conrad
8,444,731 B2 5/2013 Gomiciaga-Pereda et al.
8,448,291 B2 5/2013 Conrad
8,479,358 B2 7/2013 Conrad
8,484,799 B2 7/2013 Conrad
8,486,170 B2 7/2013 Conrad et al.
8,510,907 B2 8/2013 Conrad
8,533,904 B2 9/2013 Conrad
8,561,257 B2 10/2013 Conrad
8,567,005 B2 10/2013 Conrad
8,578,550 B2 11/2013 Conrad
8,578,553 B2 11/2013 Conrad
8,590,102 B2 11/2013 Conrad
8,595,895 B2 12/2013 Smith
8,607,407 B2 12/2013 Conrad
8,621,709 B2 1/2014 Conrad
8,640,304 B2 2/2014 Conrad
8,646,147 B2 2/2014 Conrad
8,659,184 B2 2/2014 Conrad
8,673,487 B2 3/2014 Churchill
8,677,554 B2 3/2014 Conrad
8,677,558 B2 3/2014 Conrad
8,713,751 B2 5/2014 Conrad
8,813,305 B2 8/2014 Conrad
8,834,209 B2 9/2014 Conrad
8,869,344 B2 10/2014 Conrad
8,869,345 B2 10/2014 Conrad
8,869,348 B2 10/2014 Conrad
8,875,340 B2 11/2014 Conrad
8,875,342 B2 11/2014 Conrad
8,945,258 B2 2/2015 Smith
8,979,960 B2 3/2015 Smith
9,027,203 B2 5/2015 Conrad et al.
9,066,642 B2 6/2015 Conrad
9,119,513 B2 9/2015 Conrad
9,144,358 B2 9/2015 Smith
D740,502 S 10/2015 Janda

(56) References Cited

U.S. PATENT DOCUMENTS 9,161,666 B2 10/2015 Conrad
9,167,944 B2 10/2015 Conrad
9,204,769 B2 12/2015 Conrad
9,204,773 B2 12/2015 Conrad
9,226,633 B2 1/2016 Conrad et al.
9,232,881 B2 1/2016 Conrad
9,271,618 B2 3/2016 Mantyla et al.
9,427,122 B2 8/2016 Conrad et al.
9,451,852 B2 9/2016 Conrad
9,492,045 B2 11/2016 Conrad
9,516,979 B2 12/2016 Gidwell
9,572,463 B2 2/2017 Conrad
9,591,952 B2 3/2017 Conrad
9,675,218 B2 6/2017 Kim et al.
9,711,986 B2 7/2017 Sunderland et al.
9,801,513 B2 10/2017 Conrad et al.
11,534,043 B2 12/2022 Conrad
11,793,374 B2 10/2023 Conrad
11,857,142 B2 1/2024 Conrad
2001/0027587 A1 10/2001 Conrad et al.
2002/0011050 A1 1/2002 Hansen et al.
2002/0162188 A1 11/2002 Harmen
2002/0178701 A1* 12/2002 Oh ..... B01D 45/16 55/426
2003/0159411 A1 8/2003 Hansen et al.
2003/0201754 A1 10/2003 Conrad
2004/0216264 A1 11/2004 Shaver et al.
2004/0216266 A1 11/2004 Conrad
2005/0028317 A1* 2/2005 Barker ..... A47L 9/248 15/327.2
2005/0081321 A1 4/2005 Milligan et al.
2005/0132528 A1 6/2005 Yau
2005/0252180 A1 11/2005 Oh et al.
2006/0090290 A1 5/2006 Lau
2006/0123590 A1 6/2006 Fester et al.
2006/0156508 A1 7/2006 Khalil
2006/0196004 A1 9/2006 Conrad
2006/0207055 A1 9/2006 Ivarsson et al.
2007/0256272 A1* 11/2007 Kim ..... A47L 9/1683 15/347
2007/0271724 A1 11/2007 Hakan et al.
2008/0040883 A1 2/2008 Beskow et al.
2008/0134460 A1 6/2008 Conrad
2008/0172992 A1 7/2008 Conrad
2008/0178416 A1 7/2008 Conrad
2008/0178418 A1 7/2008 Conrad
2008/0179133 A1 7/2008 Conrad
2008/0196194 A1* 8/2008 Conrad ..... A47L 9/165 15/353
2008/0196196 A1* 8/2008 Conrad ..... A47L 5/36 15/300.1
2008/0196366 A1 8/2008 Conrad
2008/0216281 A1 9/2008 Conrad
2008/0216282 A1* 9/2008 Conrad ..... A47L 5/24 15/352
2008/0230446 A1* 9/2008 Bertram ..... A47L 9/102 209/10
2008/0256744 A1 10/2008 Rowntreer et al.
2009/0265877 A1 10/2009 Dyson et al.
2009/0282639 A1 11/2009 Dyson et al.
2009/0307864 A1 12/2009 Dyson
2009/0313958 A1 12/2009 Gomiciaga-Pereda et al.
2009/0313959 A1 12/2009 Gomiciaga-Pereda et al.
2010/0045215 A1 2/2010 Hawker et al.
2010/0175217 A1 7/2010 Conrad
2010/0192314 A1 8/2010 Otsuka et al.
2010/0212104 A1 8/2010 Conrad
2010/0229323 A1 9/2010 Conrad
2010/0229325 A1 9/2010 Conrad
2010/0229326 A1 9/2010 Conrad
2010/0229328 A1 9/2010 Conrad
2010/0229334 A1 9/2010 Conrad
2010/0229335 A1 9/2010 Conrad
2010/0242210 A1 9/2010 Conrad
2010/0243158 A1 9/2010 Conrad
2010/0251507 A1 10/2010 Conrad
2010/0299865 A1 12/2010 Conrad
2010/0299866 A1 12/2010 Conrad
2011/0146024 A1 6/2011 Conrad
2011/0219567 A1 9/2011 Conrad
2011/0219579 A1 9/2011 Conrad
2011/0289719 A1 12/2011 Han et al.
2012/0030896 A1 2/2012 Crouch et al.
2012/0079671 A1 4/2012 Stickney et al.
2012/0304417 A1 12/2012 Riley
2013/0091656 A1 4/2013 Smith
2013/0091810 A1 4/2013 Smith
2013/0139348 A1 6/2013 Otsuka et al.
2013/0160232 A1 6/2013 Peace
2014/0137363 A1 5/2014 Wilson
2014/0137364 A1 5/2014 Stickney et al.
2014/0182080 A1 7/2014 Lee et al.
2014/0208538 A1 7/2014 Visel et al.
2015/0230677 A1 8/2015 Andrikanish
2015/0297050 A1 10/2015 Marsh et al.
2016/0015230 A1 1/2016 Conrad et al.
2016/0051109 A1 2/2016 Hwang et al.
2016/0367094 A1 12/2016 Conrad
2017/0071426 A1 3/2017 Krebs et al.
2017/0079489 A1 3/2017 Dimbylow
2017/0196427 A1 7/2017 Brown et al.
2017/0258282 A1 9/2017 Shinagawa
2017/0290479 A1 10/2017 Conrad
2022/0151446 A1 5/2022 Conrad et al.

FOREIGN PATENT DOCUMENTS

CA 2275675 A1 12/1999
CA 2288544 A1 5/2000
CA 2258416 A1 7/2000
CA 2258419 A1 7/2000
CA 2258421 A1 7/2000
CA 2258422 A1 7/2000
CA 2258423 A1 7/2000
CA 2258426 A1 7/2000
CA 2330801 A1 7/2001
CA 2338193 A1 7/2002
CA 2339514 A1 9/2002
CA 2342673 A1 9/2002
CA 2342993 A1 9/2002
CA 2484587 A1 4/2005
CA 2731525 A1 10/2008
CA 2658014 A1 9/2010
CA 2658022 A1 9/2010
CA 2658160 A1 9/2010
CA 2658366 A1 9/2010
CA 2658397 A1 9/2010
CA 2658497 A1 9/2010
CA 2658643 A1 9/2010
CA 2658644 A1 9/2010
CA 2593950 C 1/2013
CN 1323566 A 11/2001
CN 1626025 A 6/2005
CN 1895148 A 1/2007
CN 101095604 A 1/2008
CN 101288572 A 10/2008
CN 101448447 A 6/2009
CN 101489453 A 7/2009
CN 101489461 A 7/2009
CN 101822506 A 9/2010
CN 201683850 U 12/2010
CN 1911151 B 4/2011
CN 101489455 B 6/2012
CN 101489457 B 6/2012
CN 202739907 U 2/2013
CN 103169420 A 6/2013
CN 101897558 B 9/2014
CN 102256523 B 11/2014
CN 104822301 A 8/2015
CN 205671986 U 11/2016
DE 112007003039 T5 10/2009
DE 112007003052 T5 1/2010
DE 112010001135 T5 8/2012

(56) References Cited

FOREIGN PATENT DOCUMENTS

| | | | |
|---|---|---|---|
| EP | 489468 | A1 | 6/1992 |
| EP | 1815777 | A1 | 8/2007 |
| EP | 1594386 | B1 | 4/2009 |
| EP | 2223644 | A2 | 9/2010 |
| EP | 2308360 | A2 | 4/2011 |
| EP | 2581013 | A1 | 4/2013 |
| EP | 2848173 | A1 | 3/2015 |
| GB | 2307849 | A | 6/1997 |
| GB | 2440111 | A | 1/2008 |
| GB | 2441962 | B | 3/2011 |
| GB | 2508035 | A | 5/2014 |
| JP | 2002085297 | A | 3/2002 |
| JP | 2008206613 | A | 9/2008 |
| JP | 2010178773 | A | 8/2010 |
| JP | 2010220632 | A | 10/2010 |
| JP | 2011189132 | A | 9/2011 |
| JP | 2011189133 | A | 9/2011 |
| WO | 9720492 | A1 | 6/1997 |
| WO | 0010718 | A1 | 3/2000 |
| WO | 2004069021 | A1 | 8/2004 |
| WO | 2006076363 | A2 | 7/2006 |
| WO | 2008009883 | A1 | 1/2008 |
| WO | 2008009888 | A1 | 1/2008 |
| WO | 2008009890 | A1 | 1/2008 |
| WO | 2008009891 | A1 | 1/2008 |
| WO | 2008035032 | A3 | 6/2008 |
| WO | 2008088278 | A2 | 7/2008 |
| WO | 2009026709 | A1 | 3/2009 |
| WO | 2010102396 | A1 | 9/2010 |
| WO | 2010147247 | A1 | 12/2010 |
| WO | 2012042240 | A1 | 4/2012 |
| WO | 2014131105 | A1 | 9/2014 |
| WO | 2016065151 | A1 | 4/2016 |
| WO | 2016199460 | A1 | 12/2016 |
| WO | 2017046559 | A1 | 3/2017 |
| WO | 2017046560 | A1 | 3/2017 |

OTHER PUBLICATIONS

English machine translation of DE112010001135T5, published on Aug. 2, 2012.
English machine translation of DE112007003052T5, published on Jan. 14, 2010.
English machine translation of DE112007003039T5, published on Oct. 29, 2009.
English machine translation of JP2011189133A, published on Sep. 13, 2011.
English machine translation of JP2011189132A, published on Sep. 29, 2011.
English machine translation of JP2010220632A, published on Oct. 7, 2010.
English machine translation of JP2010178773A, published on Aug. 19, 2010.
English machine translation of JP2008206613A , published on Sep. 11, 2008.
English machine translation of JP2002085297A, published on Mar. 26, 2002.
English machine translation of CN205671986U, published on Nov. 9, 2016.
English machine translation of CN202739907U, published on Feb. 20, 2013.
English machine translation of CN201683850U, published on Dec. 29, 2010.
English machine translation of CN104822301A, published on Aug. 5, 2015.
English machine translation of CN103169420A, published on Jun. 26, 2013.
English machine translation of CN102256523B , published on Nov. 5, 2014.
English machine translation of CN101897558B, published on Sep. 17, 2014.
English machine translation of CN101822506A, published on Sep. 8, 2010.
English machine translation of CN101489461A, published on Jul. 22, 2009.
English machine translation of CN101489457B , published on Jun. 27, 2012.
English machine translation of CN101489455B , published on Jun. 27, 2012.
English machine translation of CN101489453A , published on Jul. 22, 2009.
English machine translation of CN101448447A, published on Jun. 3, 2009.
English machine translation of CN101288572A , published on Oct. 22, 2008.
English machine translation of CN101095604A , published on Jan. 2, 2008.
English machine translation of EP1815777A1, published on Aug. 8, 2007.
English machine translation of CN1911151B , published on Apr. 13, 2011.
English machine translation of CN1895148A, published on Jan. 17, 2007.
English machine translation of CN1626025A , published on Jun. 15, 2005.
English machine translation of WO2010147247A1, published on Dec. 23, 2010.
English machine translation of WO2008035032A3, published on Jun. 12, 2008.
U.S. Appl. No. 09/343,479, filed Jun. 30, 1999.

* cited by examiner

SURFACE CLEANING APPARATUS

CROSS-REFERENCE TO RELATED APPLICATIONS

This application is:

a continuation of U.S. patent application Ser. No. 16/450,304, filed on Jun. 24, 2019, which itself is a continuation of Ser. No. 15/184,954, filed on Jun. 16, 2016, now Issued U.S. Pat. No. 10,376,112, which itself is:

(i) a continuation of U.S. patent application Ser. No. 13/779,405, filed on Feb. 27, 2013; now U.S. Pat. No. 9,433,332:

(ii) a continuation-in-part of U.S. patent application Ser. No. 14/994,495, filed on Jan. 13, 2016, now abandoned, which is a continuation of U.S. patent application Ser. No. 13/039,376, filed on Mar. 3, 2011, now U.S. Pat. No. 9,265,395, which is a continuation in part of U.S. patent application Ser. No. 12/722,705, filed Mar. 12, 2010, now U.S. Pat. No. 8,578,555; and (iii) a continuation of U.S. patent application Ser. No. 14/932,816 filed on Nov. 4, 2015, now U.S. Pat. No. 9,693,666, which is a continuation of U.S. patent application Ser. No. 13/040,676, filed on Mar. 4, 2011, now U.S. Pat. No. 9,211,044, the entirety of each of which is incorporated herein by reference.

FIELD

The specification relates to surface cleaning apparatus. In a preferred embodiment, the surface cleaning apparatus comprises a portable surface cleaning apparatus, such as a hand vacuum cleaner or a pod.

BACKGROUND OF THE INVENTION

The following is not an admission that anything discussed below is part of the prior art or part of the common general knowledge of a person skilled in the art.

Various types of surface cleaning apparatus are known. Surface cleaning apparatus include vacuum cleaners. Currently, a vacuum cleaner typically uses at least one cyclonic cleaning stage. More recently, cyclonic hand vacuum cleaners have been developed. See for example, U.S. Pat. No. 7,931,716 and US 2010/0229328. Each of these discloses a hand vacuum cleaner which includes a cyclonic cleaning stage. U.S. Pat. No. 7,931,716 discloses a cyclonic cleaning stage utilizing two cyclonic cleaning stages wherein both cyclonic stages have cyclone axis that extends vertically. US 2010/0229328 discloses a cyclonic hand vacuum cleaner wherein the cyclone axis extends horizontally and is co-axial with the suction motor. In addition, hand carriable (e.g., pod style) cyclonic vacuum cleaners are also known (see U.S. Pat. No. 8,146,201).

BRIEF SUMMARY OF THE INVENTION

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect, a pod or other hand carriable surface cleaning apparatus, such as a vacuum cleaner, is provided utilizing at least one cyclone stage wherein the cyclone chamber has two dirt outlets which are preferably positioned front and rear. An advantage of this design is that the dirt carrying capacity of the vacuum cleaner may be increased. For example, if the vacuum cleaner is being used and is tilted upwardly, the dirt in the dirt collection chamber will tend to move rearwardly. The amount of dirt in the dirt collection chamber may be below the fill line. However, when the vacuum cleaner is tilted upwardly, movement of the dirt rearwardly may cause the dirt in the dirt collection chamber to extend above the fill line and could potentially block a rearwardly positioned dirt outlet. The provision of a second spaced apart (preferably forwardly positioned) dirt outlet may provide an alternate dirt outlet which may be used in such a situation. Similarly, the hand vacuum cleaner may be tilted forwardly. In such a case, the dirt in the dirt collection chamber may move forwardly blocking a forward dirt outlet. However, the provision of a second spaced apart (preferably rearwardly positioned) dirt outlet may provide an alternate dirt outlet which may be used in such a situation. Accordingly, provision of different dirt outlets may allow the vacuum cleaner to continue to function despite the vacuum cleaner being operated at an angle to the horizontal. It will be appreciated that such a design is usable in hand vacuum cleaners, pod vacuum cleaners or other vacuum cleaners or surface cleaning apparatus which are meant to be carried by a hand or shoulder strap or the like (which may be referred to as hand carriable surface cleaning apparatus).

It will be appreciated that in a preferred embodiment, the dirt outlets are positioned adjacent the forward end and the rearward end of the cyclone chamber or cyclone chambers. However, it will be appreciated that displacing the dirt outlets from being exactly forward or rearward will still increase the dirt capacity of the hand carriable surface cleaning apparatus when operated at an angle to the horizontal.

The cyclone chamber may be of any particular design. Preferably, the cyclone chamber has the dirt outlet provided at a lower end. For example, the vacuum cleaner may have an upper air inlet and an upper air outlet. The dirt outlets may be provided in the sidewall at or close to the lower end wall of the cyclone chamber. Accordingly, the dirt outlets may be defined by cutouts or slots provided in the sidewall of the cyclone chamber. However, it will be appreciated that the dual dirt outlet design may be utilized with other cyclone constructions such as an inverted cyclone (e.g., the air inlet and air outlet are provided at a lower end and the dirt outlets are provided at an upper end of the cyclone chamber).

Each of the dirt outlets may be the same size. However, in a preferred embodiment, one of the dirt outlets is larger than the other. In addition, the positioning of the dirt outlets with respect to the position of the cyclone air inlet may vary. For example, one or both of the dirt outlets may have a radial extent of 15-135°, preferably 30-105° and, still more preferably, 60-75°. One of the dirt outlets may be positioned at the same radial position on the sidewall of the cyclone chamber as the cyclone air inlet. For example, if the dirt outlet is at the lower end of a cyclone chamber and the air inlet is at the upper end, one of the dirt outlets may be positioned directly below the air inlet such that the radial displacement around the sidewall of the cyclone chamber from the air inlet may be less than 10 degrees. In such an embodiment, it is preferred that the opposed dirt outlet is larger and may be twice as large (e.g., its angular extent may be twice that of the slot which is aligned with the air inlet).

It will also be appreciated that the hand carriable surface cleaning apparatus may be mountable on a base, such as a wheeled base or an upper portion of an upright surface cleaning apparatus. In such a case, the hand carriable surface cleaning apparatus may function as the air treatment member of an upright surface cleaning apparatus or a canister style surface cleaning apparatus.

In another embodiment, an improved air flow path for a hand carriable surface cleaning apparatus and, preferably, a hand vacuum cleaner or hand surface cleaning apparatus, is provided. In accordance with this embodiment, the suction motor inlet is positioned below the upper end of the cyclone chamber and preferably at a position between the upper and lower ends of the cyclone chamber or a cyclone bin assembly (e.g., a cyclone bin assembly which includes a cyclone chamber and a dirt collection chamber, wherein the dirt collection chamber may be positioned below the cyclone chamber). According to such an embodiment, the air may enter the cyclone chamber, either at the upper end or the lower end of the cyclone chamber, and exit the cyclone chamber via an air outlet positioned in the upper end wall of the cyclone chamber. The air may then travel through a pre-motor filter. The pre-motor filter is preferably positioned above the cyclone chamber. The air exiting the cyclone chamber may either travel upwardly through the pre-motor filter and then travel downwardly via a conduit provided through the pre-motor filter or at a position that is laterally spaced (e.g., rearwardly) from the pre-motor filter. Alternately, the air exiting the cyclone chamber may pass via a conduit through the pre-motor filter and then travel downwardly through the pre-motor filter before travelling laterally (e.g., rearwardly). A conduit may then extend downwardly from the downstream side of the pre-motor filter (e.g., adjacent the cyclone chamber and/or an exterior dirt collection chamber of the cyclone chamber) to the suction motor inlet. This down flow conduit may be spaced from the cyclone chamber and dirt collection chamber or it may share a common wall with one or both thereof.

An advantage of this design is that the pre-motor filter may be accessible for cleaning or replacement by opening a panel on the upper portion of the hand carriable surface cleaning apparatus. Concurrently, the hand carriable surface cleaning apparatus may be emptiable by opening a bottom door. The bottom door may open the cyclone chamber, the dirt collection chamber, and, preferably, both simultaneously. Accordingly, the surface cleaning apparatus is provided in a hand carriable configuration wherein a bottom opening door and an upper opening pre-motor filter chamber is provided.

It will be appreciated by a person skilled in the art that any of the features of the air flow passage discussed herein may not be utilized with the dual dirt outlet design disclosed herein, but may be used by itself or in combination with any other feature disclosed herein.

In another embodiment, a hand carriable surface cleaning apparatus is provided wherein the suction motor is positioned horizontally (e.g., transverse to the vertical axis of the cyclone) and located between the upper and lower ends of the cyclone chamber or a cyclone bin assembly (preferably at or proximate a midpoint of the cyclone or cyclone bin assembly). A handle is provided which extends upwardly from the suction motor housing and is secured to an upper portion of the hand carriable surface cleaning apparatus. For example, a lower end of the handle may be provided on an upper surface of the suction motor housing. The upper end of the handle may extend to the pre-motor filter housing or a bridging portion which extends rearwardly from the pre-motor filter housing. The handle is preferably positioned so as to be rearward of the centre of gravity of the hand vacuum cleaner. Preferably, the centre of gravity is also located below the lower end of the handle. The handle may also be angled forwardly such that a vertical line extending upwardly from the center of gravity may pass through an upper portion of the handle (preferably a bridging portion extending between the pre-motor filter housing and the upper portion of the handle). An advantage of this design is that the hand carriable surface cleaning apparatus has improved ergonomics. The hand vacuum cleaner may impart a downward force of less than two pounds, preferably less than one pound, and preferably essentially no downward force on the hand of the user when the user holds the hand carriable surface cleaning apparatus horizontally disposed.

It will be appreciated by a person skilled in the art that any of the features of the ergonomic design of the hand vacuum cleaner discussed herein may not be utilized with the dual dirt outlet design disclosed herein, but may be used by itself or in combination with any other feature disclosed herein.

In accordance with another embodiment, a hand carriable surface cleaning apparatus is provided wherein the dirt collection chamber is removable with the handle of the surface cleaning apparatus for emptying. An advantage of this design is that a user need not carry the entire hand carriable surface cleaning apparatus to a garbage can or the like for emptying the dirt collection chamber. Instead, the user may be able to manipulate a lighter portion while emptying the dirt collection chamber. In addition, utilizing the handle of the hand carriable surface cleaning apparatus provides an easy way for a user to transport and hold the dirt collection chamber while it is being emptied. In addition, as the dirt collection chamber has been removed from the suction motor, the dirt collection chamber may be washed or otherwise cleaned once removed from the suction motor. It will be appreciated that the dirt collection chamber may be a lower portion of the cyclone chamber or a separate chamber in communication with a dirt outlet of the cyclone chamber. Preferably, if the dirt collection chamber is exterior to the cyclone chamber, then the cyclone chamber and dirt collection chamber may be removable with the handle as a unit (e.g., a cyclone bin assembly). It will be appreciated by a person skilled in the art that any of the features of the removable dirt collection chamber and handle assembly discussed herein may not be utilized with the dual dirt outlet design disclosed herein, but may be used by itself or in combination with any other feature disclosed herein.

In accordance with another embodiment, a bleed valve is provided downstream of the cyclone chamber. For example, the air exiting the cyclone chamber may travel upwardly via a conduit (which may be an extension of the vortex finder) through the pre-motor filters so that the upper side of the pre-motor filter is the upstream or dirty side of the pre-motor filter. In such a construction, the bleed valve may be positioned in the up flow conduit and connect with an air flow passage on the downstream side of the pre-motor filter (e.g., a downstream header of the pre-motor filter). Accordingly, the bleed valve may be positioned so as to draw bleed air in through a port on the upper side of the pre-motor filter housing and convey the bleed air through the up flow conduit from the cyclone chamber to a position downstream of the pre-motor filter. An advantage of this design is that the bleed valve is positioned at a location which will not be blocked during operation of the hand vacuum cleaner and does not require another passage through the pre-motor filter (which would reduce the cross sectional area of the upstream surface area of the pre-motor filter). In an alternate embodiment, it will be appreciated that the bleed valve could be exterior to the up flow conduit and may pass through the pre-motor filter.

In another embodiment, the bleed valve could be provided on a rearward surface of the surface cleaning apparatus. For example, the bleed valve could be position coaxial with, and above, the suction motor housing. Accordingly, bleed air could travel essentially forwardly through the bleed valve into the down flow conduit adjacent to the cyclone chamber/dirt collection chamber and then rearwardly into the suction motor. In an alternate embodiment, the bleed valve could be radially spaced around the hand vacuum cleaner but still communicate with the down flow passage.

It will be appreciated by a person skilled in the art that any of the features of the bleed valve discussed herein may not be used with the dual dirt outlet design disclosed herein, but may be used by itself or in combination with any other feature disclosed herein.

In another embodiment, the hand carriable surface cleaning apparatus has a cyclone chamber with a vertically extending axis and the pre-motor filter is positioned above the cyclone chamber and is preferably positioned so as to extend perpendicular to the axis of the cyclone. Accordingly, the air exiting the cyclone chamber may travel upwardly to the pre-motor filter. In such an embodiment, the lower side of the pre-motor filter may be the upstream side or alternately, the upper side may be the upstream side of the pre-motor filter (if a conduit such as the vortex finder extends through the pre-motor filter). An advantage of this design is that a header may be provided and the air will tend to distribute itself radially outwardly over the entire upstream surface of the pre-motor filter.

It will be appreciated by those skilled in the art that any of the features of the positioning of the pre-motor filter discussed herein may not be utilized with the dual dirt outlet design disclosed herein, but may be used by itself or in combination with any other feature disclosed herein.

In another embodiment, a pod or other hand carriable surface cleaning apparatus may be provided with a porous pre-motor filter media that is positioned above, laterally from or below the cyclone chamber and the vortex finder or an extension thereof may extend through the porous pre-motor filter media to the upstream side of the porous pre-motor filter media. The porous pre-motor filter media may be essentially coaxial with the vortex finder (e.g., the porous pre-motor filter media may overlie the cyclone chamber and be essentially centered above the cyclone chamber). It will be appreciated by those skilled in the art that any of the features of a porous pre-motor filter media with a conduit therethrough disclosed herein may not be utilized with the dual dirt outlet discussed herein, but may be used by itself or in combination with any other feature disclosed herein.

In one embodiment there is provided a hand carriable surface cleaning apparatus having a front end, a rear end and comprising:

(a) a dirty fluid inlet;

(b) a cyclone bin assembly comprising a cyclone chamber downstream of the dirty fluid inlet, the cyclone chamber comprising a lower end, an upper end, a cyclone axis, an air inlet and an air outlet at the upper end;

(c) a porous pre-motor filter media comprising an upstream side and a downstream side, (d) a conduit in communication with the cyclone air outlet, extending through the porous pre-motor filter media and in communication with the upstream side of the porous pre-motor filter media;

(e) a suction motor positioned downstream of the porous pre-motor filter media and rearward of the cyclone bin assembly;

(f) an air flow path extending from the porous pre-motor filter media to the suction motor; and, (g) a clean air outlet downstream of the suction motor.

In some embodiments, the porous pre-motor filter media may be positioned above the cyclone chamber and the upstream side is spaced further from the cyclone chamber than the downstream side.

In some embodiments, the cyclone air outlet may comprise a vortex finder and the conduit comprises an extension of the vortex finder.

In some embodiments, the hand carriable surface cleaning apparatus may further comprise a downstream header on the downstream side of the porous pre-motor filter media. The air flow path may extend downstream from the downstream header.

In some embodiments, the hand carriable surface cleaning apparatus may further comprise an upstream header on the upstream side of the porous pre-motor filter media. The upstream header may be openable.

In some embodiments, at least a portion of the upstream header may be transparent.

In some embodiments, the suction motor may have a suction motor inlet that is positioned between the lower and upper ends of the cyclone bin assembly.

In some embodiments, the suction motor may have a motor axis that is generally perpendicular to the cyclone axis.

In some embodiments, the suction motor may have a motor axis that is generally perpendicular to the cyclone axis.

In some embodiments, the air inlet may be provided at the upper end and the dirt outlet is provided at the lower end and a dirt collection chamber is positioned below the cyclone chamber.

In some embodiments, the air flow path motor may have a portion that is exterior to and extends part way along an exterior wall of the cyclone chamber to a suction motor inlet.

In some embodiments, the hand carriable surface cleaning apparatus may further comprise a dirt collection chamber positioned exterior to the cyclone chamber. The air flow path may have a portion that extends part way along an exterior wall of the dirt collection chamber to a suction motor inlet.

In some embodiments, the hand carriable surface cleaning apparatus may further comprise a handle, a suction motor housing and a porous pre-motor filter media housing positioned above the cyclone chamber. The handle may extend between the suction motor housing and the porous pre-motor filter media housing.

In some embodiments, the porous pre-motor filter media housing may be openable.

In some embodiments, the suction motor may have a motor axis that is generally perpendicular to the cyclone axis.

In some embodiments, the handle may have a suction motor housing end that is spaced rearward of the cyclone bin assembly and below the porous pre-motor filter media housing and a porous pre-motor filter media end that is spaced above and forward of the suction motor end of the handle.

In some embodiments, the hand carriable surface cleaning apparatus may further comprise an opening having a perimeter. The perimeter may comprise portions of the handle, the pre-motor filer housing and the suction motor housing.

In some embodiments, the hand carriable surface cleaning apparatus may further comprise a handle. A portion of the handle may be placed rearward of a centre of gravity of the hand carriable surface cleaning apparatus.

In some embodiments, the hand carriable surface cleaning apparatus may further comprise a bleed valve having an inlet end in the air flow path.

In some embodiments, the bleed valve may have an axis that is generally parallel to an axis of the suction motor.

According to another aspect, a hand surface cleaning apparatus is provided that may be operable for an enhanced period of time without a significant reduction is air flow into the dirty air inlet. In accordance with this aspect, a pre-motor filter with enhanced surface area transverse to the direction of air flow is provided.

Typically, a surface cleaning apparatus such as a hand vacuum cleaner has a pre-motor filter and a post motor filter. The post motor filter may be a HEPA filter. In such a case, the air discharged from the clean air outlet of the unit may be comparable to that discharged from a full size vacuum cleaner. As the HEPA filter is used, the air flow through the unit will decrease and the suction provided by the unit will decrease. This can impact upon the cleaning performance achieved by the vacuum cleaner. To counter this, a larger suction motor may be provided. However, that would increase the hand weight of the unit. A pre-motor filter reduces the level of entrained dirt that will reach the HEPA filter. However, the filter will become clogged with use. Increasing the surface area of the upstream side of the pre-motor filter extends the lifetime of the pre-motor filter and may therefore enhance the life of a post motor filter.

The pre-motor filter may have an enhanced surface area of its upstream side by configuring the pre-motor filter to have a larger upstream surface area then that of the suction motor inlet end. A pre-motor filter may be positioned in the suction motor casing and may therefore have a diameter that is about the same as the diameter of the fan of the suction motor. By configuring the pre-motor filter to overlie part of one or more additional components of the unit, the surface area of the upstream side is increased.

For example, a suction motor may be positioned beside a cyclone chamber and extend in the same direction of the cyclone chamber. Accordingly, one end of a cyclone chamber may be adjacent the inlet end of the suction motor (e.g., positioned in about the same plane). The pre-motor filter (preferably a foam filter and more preferably a foam filter with a felt filter downstream thereof) may be configured to overlie part or all of the cyclone chamber as well as part or all of the suction motor. Alternately, or in addition, the pre-motor filter may overlie part of the open volume between the suction motor and the cyclone chamber. If the dirt collection chamber is exterior to the cyclone chamber, e.g., it is positioned to occupy some of the open volume, then the pre-motor filter may alternately or in addition overlie part or all of the dirt collection chamber. Accordingly, a pre-motor filter with an enhanced surface area of the upstream side may be provided without substantially increasing the size of the unit. A filter with an enhanced size may be provided by providing a filter that overlies part or all of two or more of the suction motor, the dirt collection chamber and the cyclone chamber.

According to this aspect, a surface cleaning apparatus is provided. The hand surface cleaning apparatus comprises an air flow passage extending from a dirty air inlet to a clean air outlet. A suction motor is positioned in the air flow path and has an inlet end and an outlet end. At least one cyclone chamber is positioned in the air flow path and has an associated dirt collection chamber, a cyclone air inlet and a cyclone air outlet. A pre-motor filter is positioned downstream of the cyclone chamber and upstream of the suction motor. The pre-motor filter has an upstream side and a downstream side. The pre-motor filter overlies at least a portion of the suction motor and the cyclone chamber.

The cyclone chamber and the suction motor may be positioned side by side and may have generally parallel longitudinal axes.

The pre-motor filter may overlie at least half of the suction motor and the cyclone chamber. The pre-motor filter may overlie at least 75% of the suction motor and the cyclone chamber.

The pre-motor filter may have a portion that is centered over the suction motor and a portion that overlies at least half of the cyclone chamber.

The upstream side of the pre-motor filter may face the cyclone air outlet and an inlet duct of the suction motor may extend through the pre-motor filter to the downstream side of the pre-motor filter.

The cyclone air outlet may extend through the pre-motor filter to the upstream side of the pre-motor filter, and the inlet end of the suction motor may face the downstream side of the pre-motor filter.

The hand surface cleaning apparatus may further comprising an openable door positioned at a side of the hand vacuum cleaner having the cyclone air outlet and the inlet end of the suction motor. The upstream side of the pre-motor filter may be visible when the door is opened.

The pre-motor filter may be mounted to at least one of the cyclone chamber and the suction motor and the pre-motor filter may remain in position when the door is opened.

The pre-motor filter may be spaced from the door and a chamber may be provided between the pre-motor filter and the door.

BRIEF DESCRIPTION OF THE SEVERAL VIEWS OF THE DRAWINGS

The drawings included herewith are for illustrating various examples of articles, methods, and apparatuses of the teaching of the present specification and are not intended to limit the scope of what is taught in any way.

In the drawings.

DETAILED DESCRIPTION OF THE INVENTION

Figure 1:
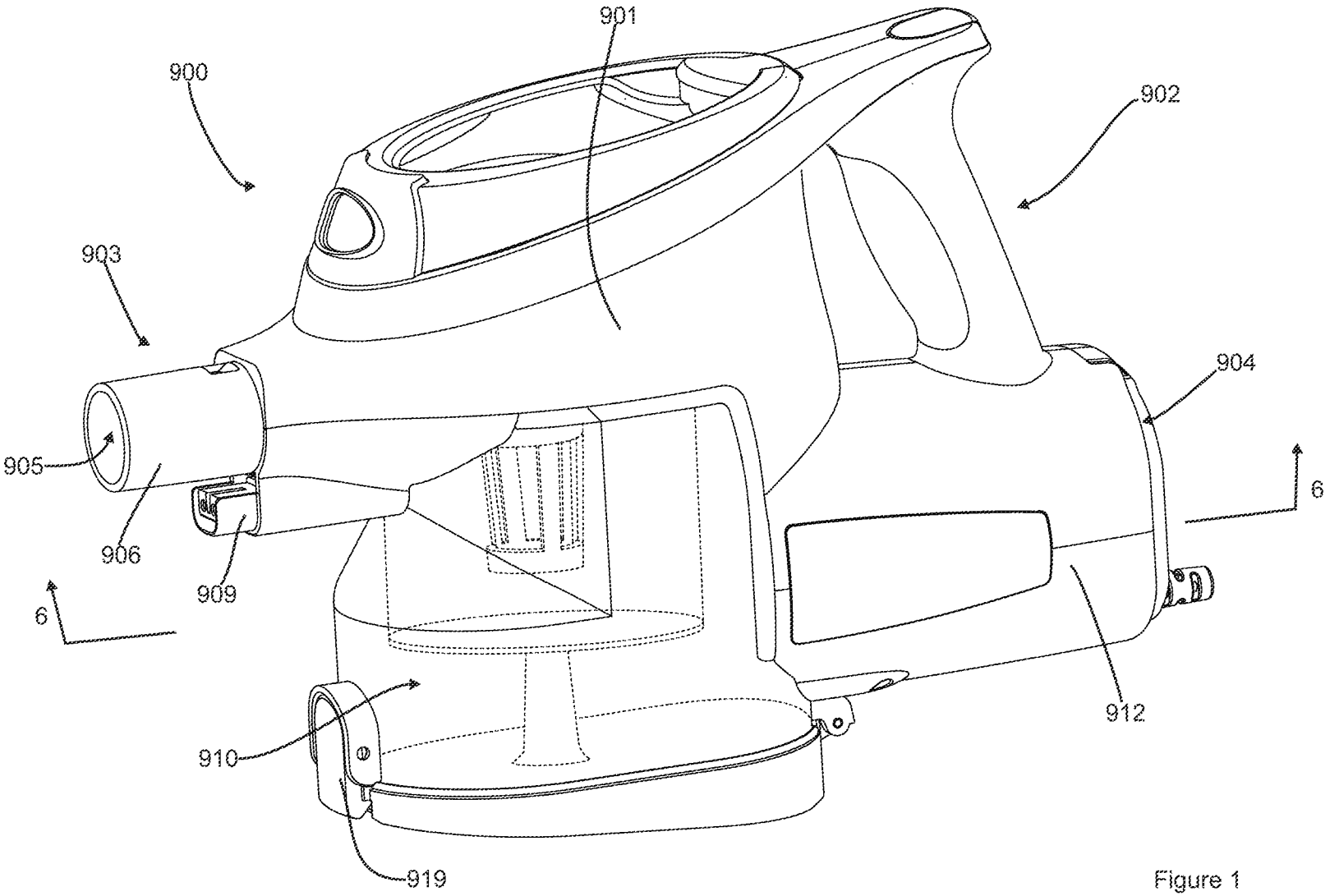
FIG. 1 is a perspective view of an example of a hand held surface cleaning apparatus.

Referring to FIG. 1, an embodiment of a surface cleaning apparatus 900 is shown. In the embodiment illustrated, the surface cleaning apparatus 900 is a hand carriable or hand-held vacuum cleaner. It will be appreciated that surface cleaning apparatus 900 could be carried by a hand of a user, a shoulder strap or the like and could be in the form of a pod or other portable surface cleaning apparatus. Surface cleaning apparatus 900 could be a vacuum cleaner, an extractor or the like. All such surface cleaning apparatus are referred to herein as a hand carriable surface cleaning apparatus. Optionally, surface cleaning apparatus 900 could be removably mounted on a base so as to form, for example, an upright vacuum cleaner, a canister vacuum cleaner, a stick vac, a wet-dry vacuum cleaner and the like. Power can be supplied to the surface cleaning apparatus 900 by an electrical cord (not shown) that can be connected to a standard wall electrical outlet. Alternatively, or in addition, the power source for the surface cleaning apparatus can be an onboard energy storage device, including, for example, one or more batteries.

Figure 2:
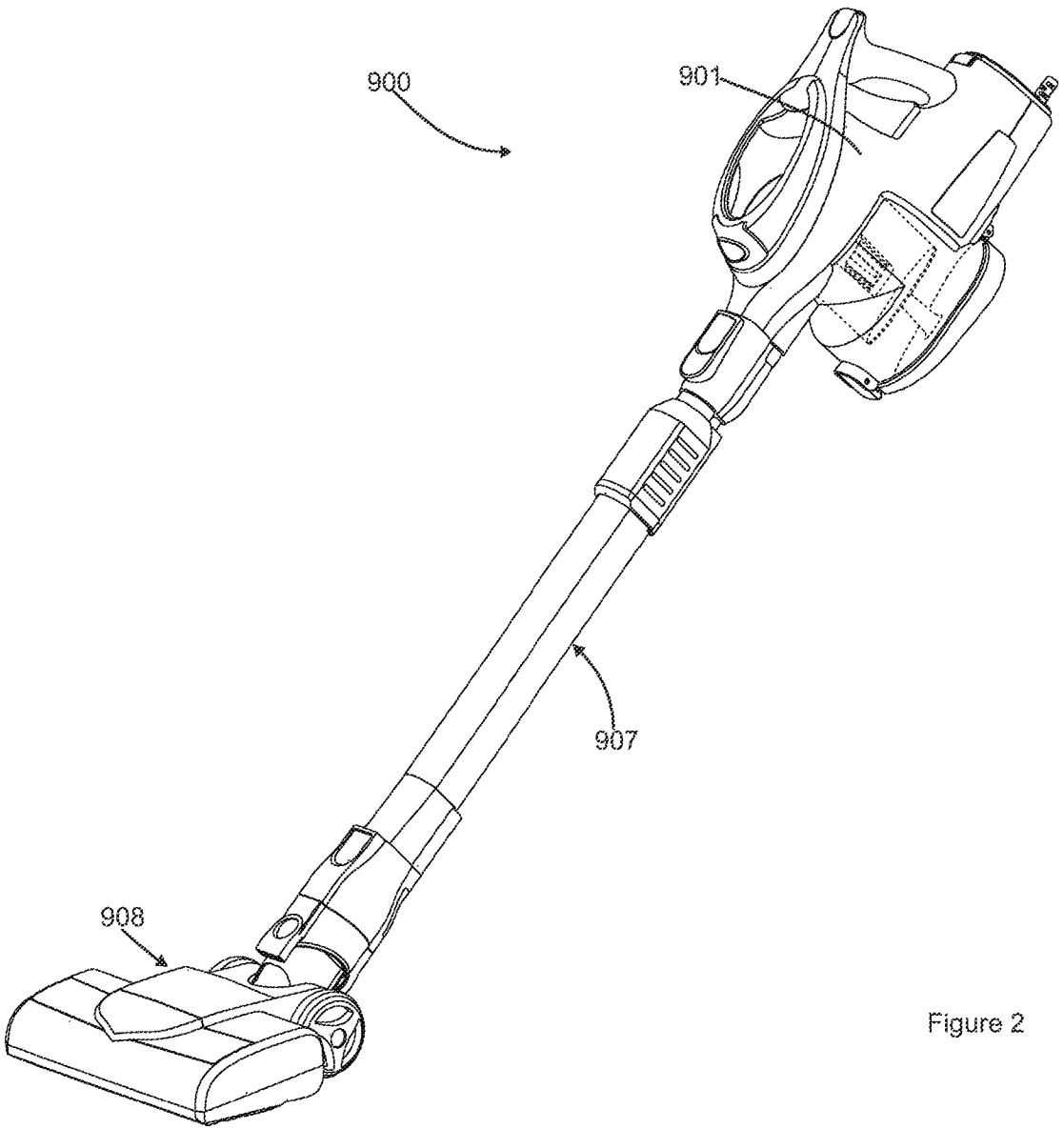
FIG. 2 is a perspective view of the surface cleaning apparatus of FIG. 1 attached to a cleaning tool.

The surface cleaning apparatus 900 comprises a main body 901 having a handle 902, a dirty air inlet 903, a clean air outlet 904 (see for example FIG. 6) and an air flow path extending therebetween. In the embodiment shown, the dirty air inlet 903 is the inlet end 905 of connector 906. Optionally, the inlet end can be used to directly clean a surface. Alternatively, the inlet end 905 can be connected to the downstream end of any suitable hose, cleaning tool or accessory, including, for example a wand 907 that is pivotally connected to a surface cleaning head 908 (FIG. 2), a nozzle and a flexible suction hose. In the configuration illustrated in FIG. 2, the surface cleaning apparatus 900 can be used to clean a floor or other surface in a manner analogous to conventional upright-style vacuum cleaners.

Referring again to FIG. 1, the connector 906 may be any suitable connector that is operable to connect to, and preferably detachably connect to, a hose, cleaning tool or other accessory. Optionally, in addition to providing an air flow connection, the connector 906 may also include an electrical connection. Providing an electrical connection may allow cleaning tools and accessories that are coupled to the connector to be powered by the surface cleaning apparatus 900. For example, the surface cleaning unit 900 can be used to provide both power and suction to a surface cleaning head, or other suitable tool. In the illustrated embodiment, the connector 906 includes an electrical coupling in the form of a female socket member 909, and a corresponding male prong member may be provided on the hose, cleaning tool and/or accessory that is connected to inlet end 905. Providing the female socket 909 on the electrified side of the electrical coupling may help prevent a user from inadvertently contacting the electrical contacts. In other embodiments, socket member 909 may include male connectors. In such a case, it is preferred that the male connectors are de-energized when exposed (i.e., they are not plugged into a female connector).

From the dirty air inlet 903, the air flow path extends through an air treatment member. The air treatment member may be any suitable member that can treat the air in a desired manner, including, for example, removing dirt particles and debris from the air. In the illustrated example, the air treatment member includes a cyclone bin assembly 910. Alternatively, the air treatment member can comprise a bag, a filter or other air treating means. In the illustrated embodiment, the cyclone bin assembly forms part of the main body 901 of the surface cleaning apparatus. A suction motor 911 (see FIG. 6) is mounted within a motor housing 912 portion of the main body 901 and is in fluid communication with the cyclone bin assembly 910. In this configuration, the suction motor 911 is downstream from the cyclone bin assembly 910 and the clean air outlet 904 is downstream from the suction motor 911.

Cyclone Bin Assembly

The following is a description of a cyclone and a cyclone bin assembly that may be used by itself in any surface cleaning apparatus or in any combination or sub-combination with any other feature or features disclosed herein.

Figure 5:
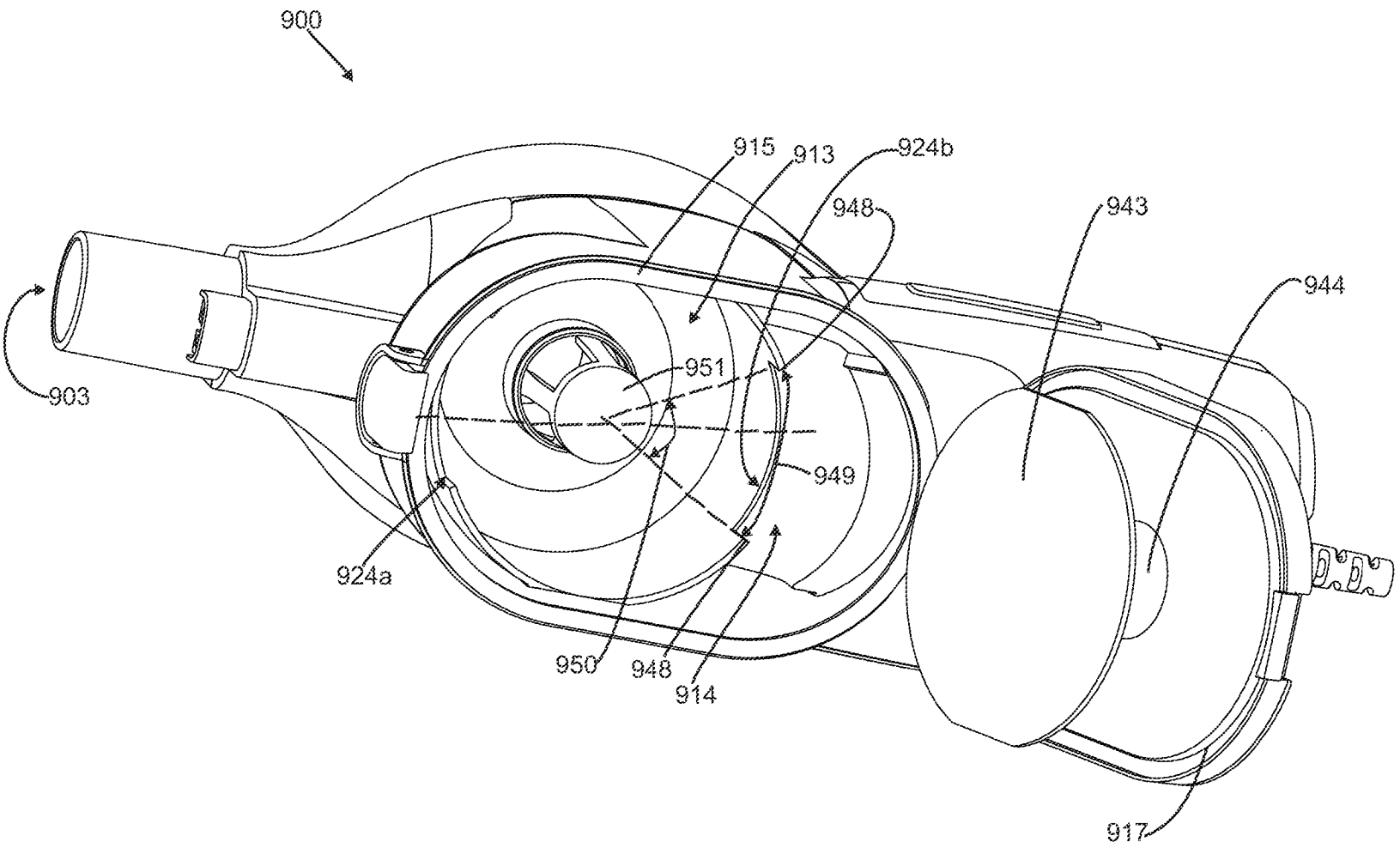
FIG. 5 is bottom perspective view of the surface cleaning apparatus of FIG. 1 with the bottom door in an open position.
Figure 6:
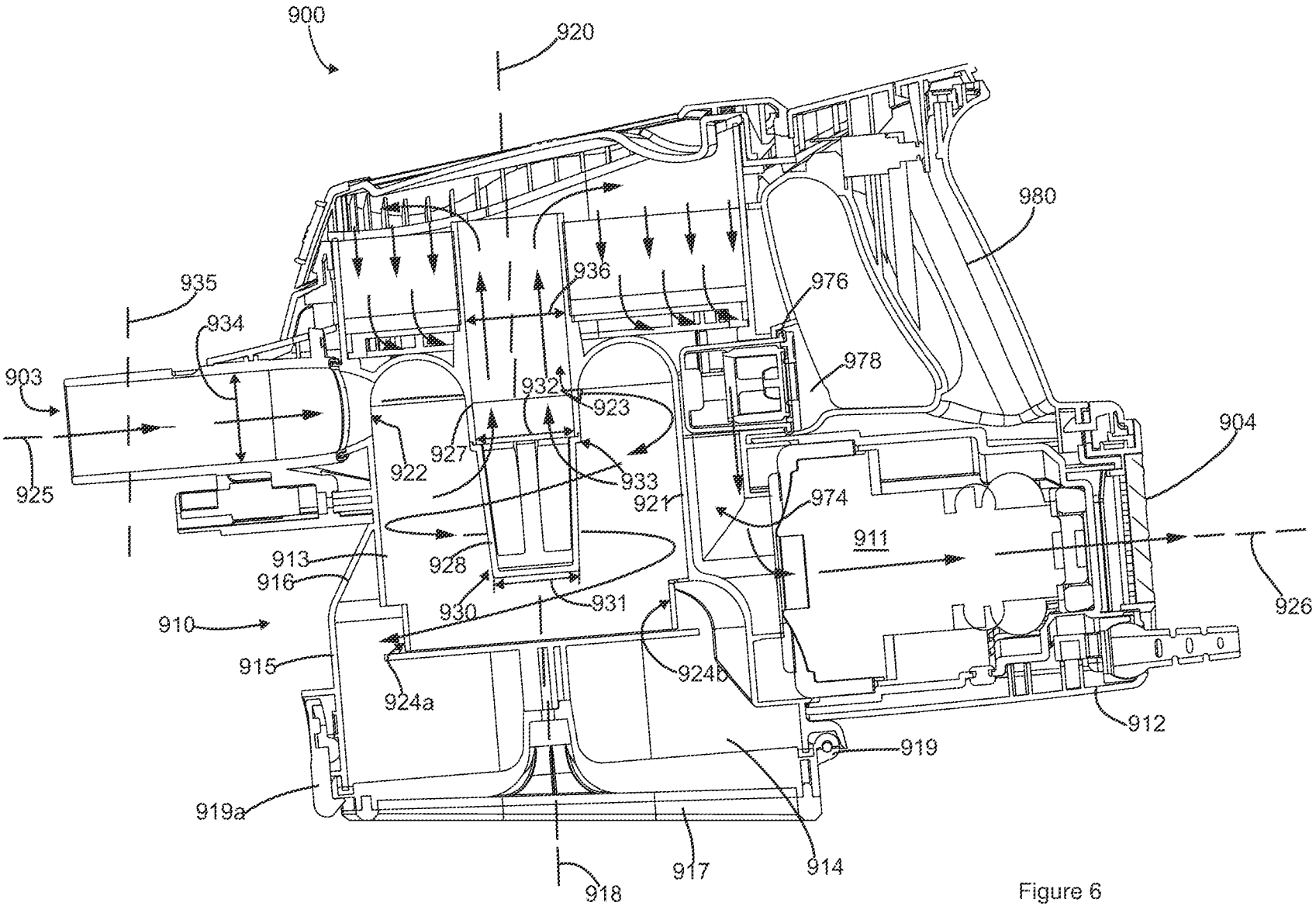
FIG. 6 is a cross sectional view of the surface cleaning apparatus of FIG. 1, taken along line 6-6 in FIG. 1.

Referring to FIGS. 5 and 6, in the illustrated embodiment, the cyclone bin assembly 910 includes a cyclone chamber 913 and a dirt collection chamber 914. The cyclone chamber 913 and the dirt collection chamber 914 may be of any suitable configuration.

In the illustrated embodiment the dirt collection chamber 914 is positioned outside or exterior to and substantially below the cyclone chamber 913. Preferably, a least a portion, if not all, of the dirt collection chamber is below the cyclone chamber. The dirt collection chamber 914 comprises a sidewall 915, a first end wall 916 and an opposed second end wall 917. The dirt collection chamber 914 extends along a dirt collection axis 918.

The dirt collection chamber 914 may be emptyable by any means known in the art and is preferably openable concurrently with the cyclone chamber 913. Preferably, the second dirt collection chamber end wall 917 is moveably (e.g., pivotally) connected to e.g., the dirt collection chamber sidewall 915, for example using hinge 919. In this configuration, the second dirt collection chamber end wall 917 functions as an openable door to empty the dirt collection chamber 914 and can be opened as shown in FIG. 5 to empty dirt and debris from the interior of the dirt collection chamber 914. The second dirt collection chamber end wall 917 can be retained in the closed position by any means known in the art, such as by a releasable latch 919*a*. In the illustrated example, the hinge 919 is provided on a back edge of the end wall 917 and the latch 919*a* is provided at the front of the end wall 917 so that the door swings backwardly when opened. Alternatively, the hinge and latch may be in different positions, and the door may open in a different direction or manner. Optionally, instead of being pivotal or openable, the end wall may be removable.

In the embodiment shown, the cyclone chamber 913 extends along a cyclone axis 920 and is bounded by a sidewall 921. The cyclone chamber 913 includes an air inlet 922 and an air outlet 923 and two dirt outlets 924*a* and 924*b* in communication with the dirt collection chamber 914. The air inlet, air outlet and dirt outlets may be of any design known in the art. Preferably, the air inlet 922 is generally tangentially oriented relative to the sidewall 921, so that air entering the cyclone chamber 913 will tend to swirl and circulate within the cyclone chamber 913, thereby disentraining dirt and debris from the air flow, before leaving the chamber via the air outlet 923. The air inlet 922 extends along an inlet axis 925 that may be generally perpendicular to the cyclone axis 920, and in the illustrated example is generally parallel to and offset above a suction motor axis 926.

In the illustrated example, the cyclone air outlet 923 comprises a conduit member or vortex finder 927. Optionally, a screen 928 can be positioned over the vortex finder 927 to help filter lint, fluff and other fine debris. Preferably, the screen 928 can be removable. Optionally, the screen 928 can be tapered such that the distal, inner or free end 930 of the screen 928 has a smaller diameter 931 than the diameter 932 at the base 933 of the screen 928 and/or the air inlet 922.

Optionally, the screen 928 can be configured so that the diameter 931 of the free end 930 of the screen is between about 60% and about 100% of the diameter 932 of the base 933 of the screen 928 and/or the air inlet 922, and may be between about 60%-90%, about 70-80% and preferably is between about 63-67% of the base diameter 932 and/or the air inlet 922.

The air inlet 922 has an inlet diameter 934, and a related inlet flow cross-sectional area (measure in a plane 935 perpendicular to the inlet axis 925). Preferably, the air outlet 923 is sized so that the diameter 936 of the air outlet 923, and therefore the corresponding flow area of the air outlet, is the same as the diameter 934 of the air inlet 922. Alternatively, the air outlet diameter 936 may be between about 50% and about 150%, and between about 85-115% of the air inlet diameter 934.

In the example illustrated the cyclone bin assembly 910 and the cyclone chamber 913 are arranged in a generally vertical, inverted cyclone configuration. In this configuration, the air inlet 922 and the air outlet 923 are provided toward the upper end of the cyclone chamber 913. Alternatively, the cyclone bin assembly 910 and cyclone chamber 913 can be provided in another orientation, including, for example, as a horizontal cyclone or in other configurations, e.g., with the dirt collection chamber beside the cyclone chamber and/or with the inlet and outlets at differing positions.

Optionally, some or all of the sidewall 921 can coincide with portions of the external sidewalls of the cyclone bin assembly 910 and the dirt collection chamber sidewall 915 (see FIGS. 5 and 6). This may help reduce the overall size of the cyclone bin assembly. Alternative, the sidewall 921 may be distinct from the sidewalls. In alternative embodiments, the cyclone chamber 915 may include only a single dirt outlet 924, or more than two dirt outlets.

Figure 7:
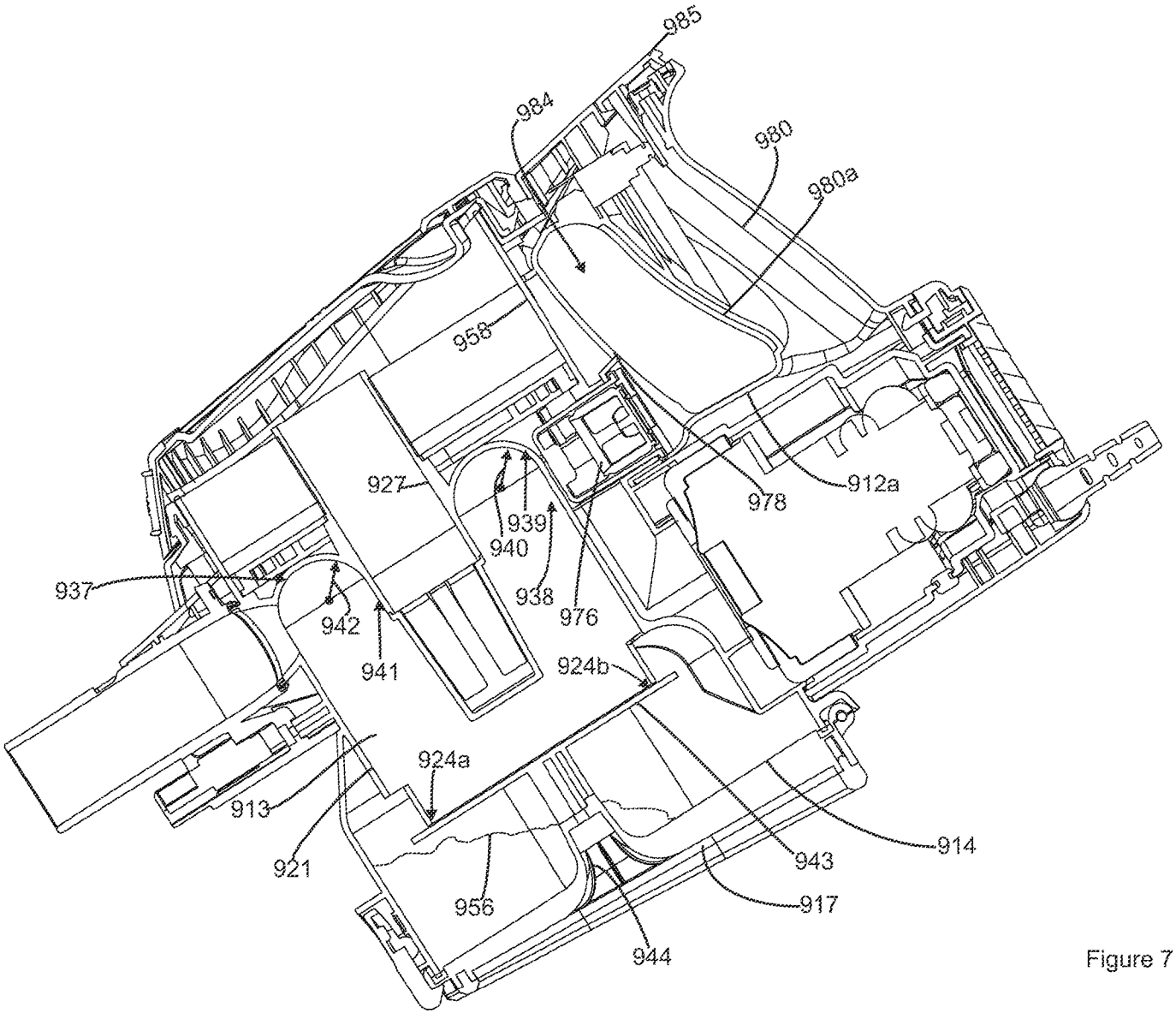
FIG. 7 is the cross sectional view of FIG. 6 with the surface cleaning apparatus tilted forward.

Referring to FIG. 7, in the illustrated embodiment, the cyclone chamber 913 includes a first or upper end wall 937. The end wall 937 is connected to the upper end of the sidewall 921 to enclose the upper end of the cyclone chamber 913. In the illustrated example, a juncture 938 between the end wall 937 and the side wall 921 includes a curved surface 939. The radius 940 of the curved surface 939 may be selected to be similar to the radius (i.e. half of the diameter 934) of the air inlet 922, and optionally may be selected so that the juncture surface 939 has the same radius as the air inlet.

Optionally, the juncture 941 between the end wall 937 and the vortex finder 927 may also be curved, and preferably is sized to have a radius 942 that is similar to or is the same as the radius 940 of the juncture between the end wall 937 and the sidewall 921. Providing curved surfaces at one or both of the junctures 938, 941 may help reduce backpressure and may help improve cyclone efficiency. Optionally, the upper end wall 937 of the cyclone chamber 913 can be openable or removable to allow access to the interior of the cyclone chamber 913 from above.

Referring also to FIG. 5, a deflector or arrestor plate 943 may be positioned at the lower end of the cyclone chamber 913, at the interface between the cyclone chamber 913 and the dirt collection chamber 917. The arrestor plate 943 is preferably sized to cover substantially all of the lower end of the cyclone chamber 913, and to abut the lower end of the cyclone sidewall 921 to form a lower end wall of the cyclone chamber. When the arrestor plate 943 abuts the lower ends of the sidewall 921 it helps define the gaps or slots that form the dirt outlets 924*a*, 924*b*. In this configuration, the dirt outlet slots 924*a*, 924*b* are bound on three sides by the cyclone chamber sidewall 921 and on a fourth side by the arrestor plate 943. Alternatively, the dirt outlet slots 924*a*, 924*b* may be entirely bounded by the sidewall 921 and may be spaced apart from the arrestor plate 943. In the illustrated example the dirt outlets 924*a*, 924*b* are vertically spaced apart from the air inlet 922 and air outlet 923 and are positioned at the opposite, lower end of the cyclone chamber 913.

In the illustrated embodiment, the arrestor plate 943 forms the bottom of the cyclone chamber and may be of any suitable configuration. Optionally the arrestor plate 943 may be fixed in its position adjacent the sidewall 921, or may be moveable or openable. Providing an openable arrestor plate 943 may help facilitate emptying of the cyclone chamber 913. Optionally, the arrestor plate 943 may be openable concurrently with another portion of the surface cleaning apparatus, including, for example, the dirt collection chamber 917.

In the illustrated embodiment, the arrestor plate 943 is mounted to and supported spaced from the openable wall 917 by a support member 944. The support member 944 may be of any suitable configuration and may be formed from any suitable material that is capable of supporting the arrestor plate 943 and resisting stresses exerted on the arrestor plate 943 by the air flow in the cyclone chamber or dirt particles exiting the cyclone chamber 913. In this configuration, the arrestor plate 943 is openable concurrently with the end wall 917, so that opening the end wall 917 simultaneously opens the dirt collection chamber 914 and the cyclone chamber 913. Alternatively, the arrestor plate 943 may be mounted to the sidewall 921 (or other portion of the surface cleaning apparatus) and need not open in unison with the end wall 917.

Figure 8:
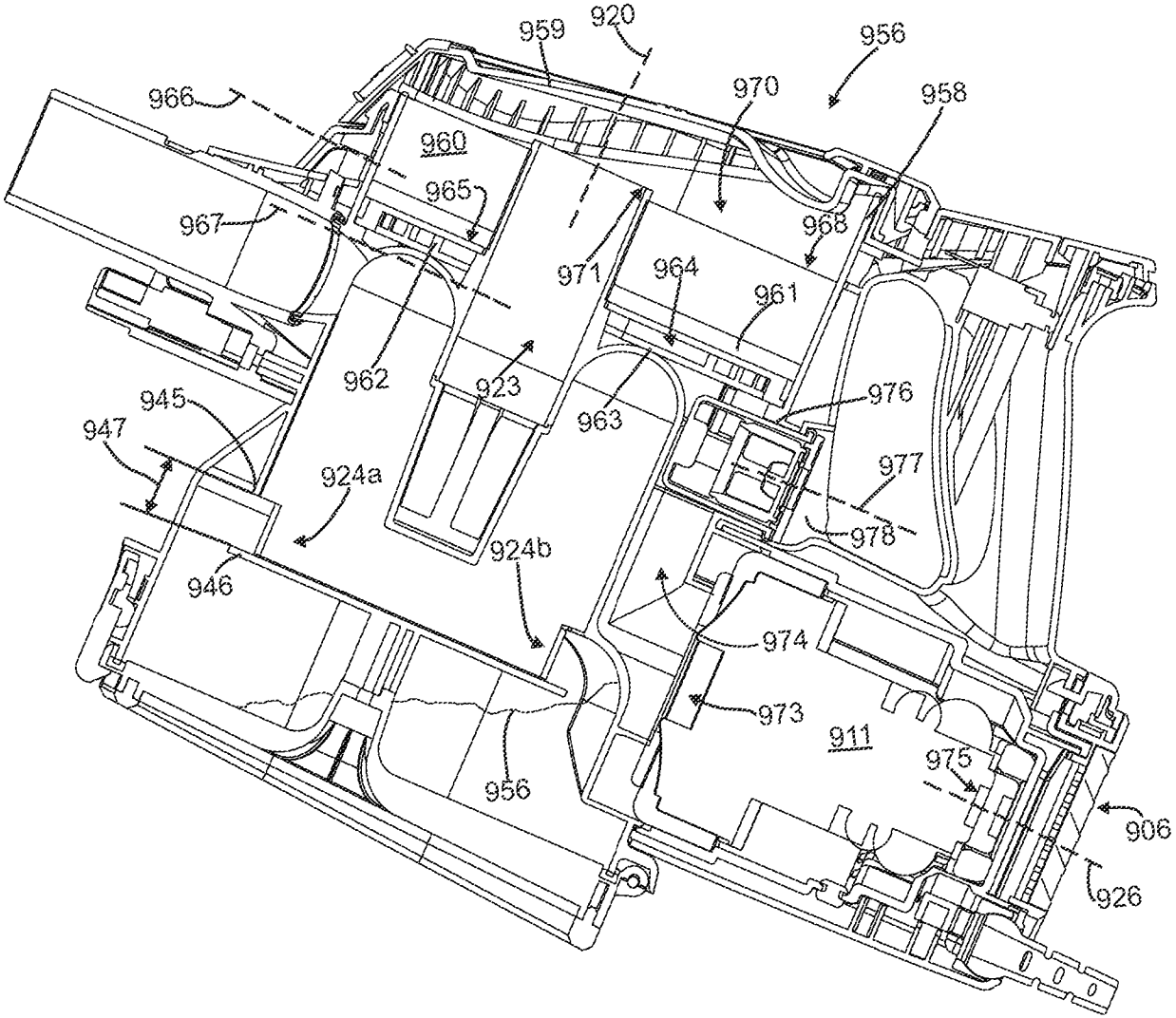
FIG. 8 is the cross sectional view of FIG. 6 with the surface cleaning apparatus tilted backward.

Referring to FIG. 8, each dirt outlet 924*a* and 924*b* is a slot that includes an upper edge 945 and a lower edge 946 spaced apart from each other by a slot height 947, measured axially. The slot height 947 may be any suitable distance, including for example, between 1 mm and 49 mm or more, and preferably is between about 3 mm and about 25 mm. Each slot 924*a*, 924*b* also includes two side edges 948 (FIG. 5) spaced apart by a slot width 949, measured along the perimeter of the cyclone chamber sidewall 921. Each slot width may be between about 5% and about 50% of the perimeter of the cyclone chamber sidewall 921, and preferably may be between about 10% and about 35% and may be about 25%. In the illustrated embodiment the cyclone chamber sidewall 921 is circular in axial cross-sectional shape, and the angle 950 (FIG. 5) subtended by the dirt outlet 924*b* may between about 20° and about 180°, and may be between about 35° and 125°, and between about 45° and 90°. In the illustrated embodiment the angle 951 between the dirt outlets 924*a* and 924*b*, measured from the centre line of the slots (FIG. 5) is 180°. Optionally, the dirt outlets 924*a*, 924*b* may be generally identical. Alternatively, the dirt outlets 924*a* and 924*b* may be of different configurations (i.e. may have different heights and/or widths). Optionally, slot 924*a*, which is at the same end as the cyclone air inlet, is smaller than the opposed dirt outlet 924*b* and may be about half the size.

Figure 12:
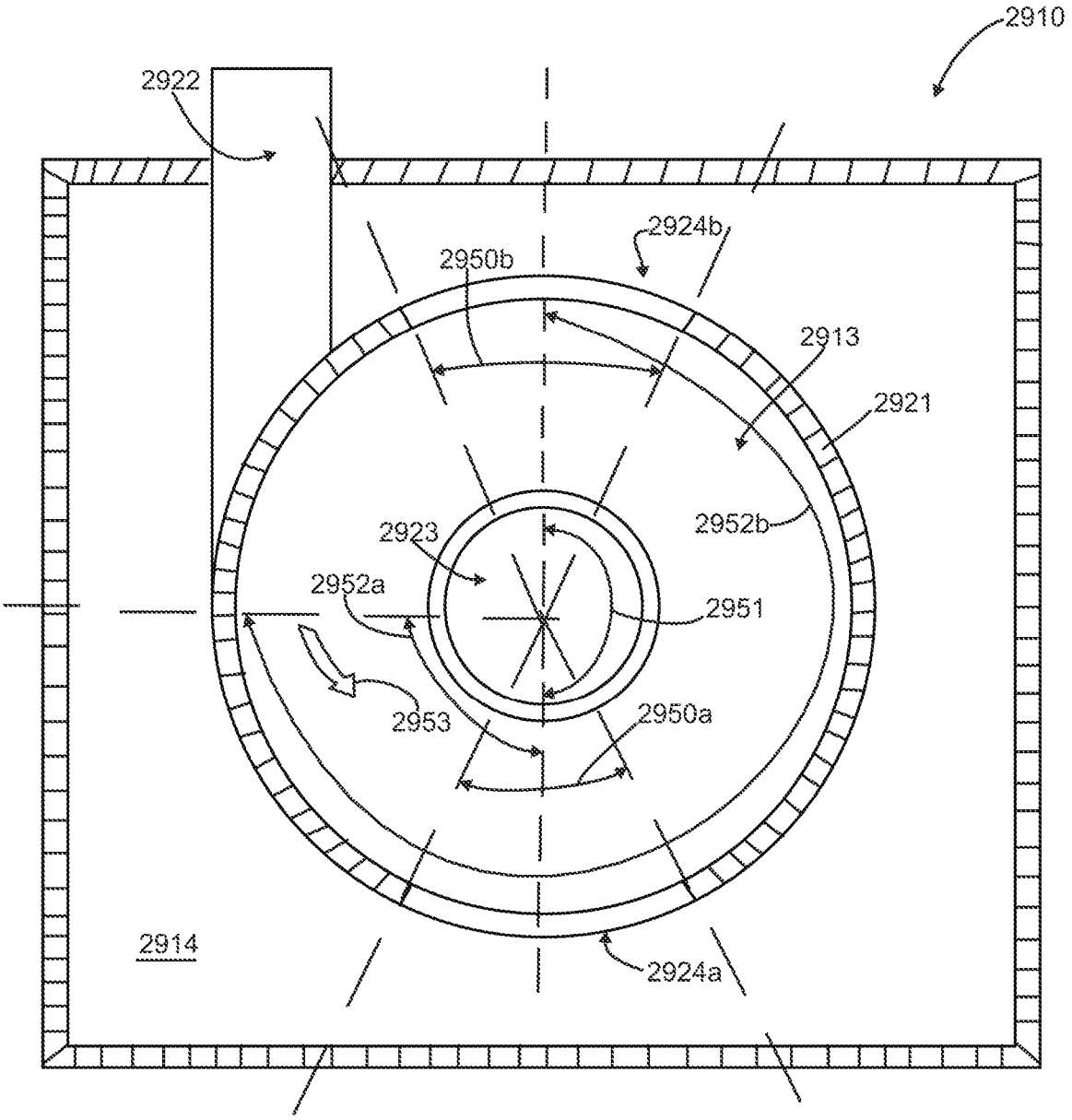
FIG. 12 is a schematic top plan representation of an example of a cyclone bin assembly.

Referring to FIG. 12, a cross-sectional schematic representation of an alternate embodiment of a cyclone bin assembly 2910 is shown. The cyclone bin assembly 2910 is generally similar to cyclone bin assembly 910 and analogous features are indicated using like reference characters indexed by 2000. This schematic illustrates a top view of an example of a circular cyclone chamber 2913 positioned within a generally square dirt collection chamber 2914. The cyclone chamber 2913 includes a tangential air inlet 2922 and an air outlet 2923. Two dirt outlets 2924*a* and 2924*b* are provided in the cyclone chamber sidewall 2921. The angle 2951 between the dirt outlets 2924*a*, 2924*b* is about 180°. In this embodiment, the angle 2952 between the air inlet 2922 (measured from the point of tangential intersection between the air inlet and the cyclone chamber sidewall 2921) and the first dirt slot 2924*a*, in the direction of air circulation (arrow 2953), is approximately 90°, and the angle 2952*b* between the air inlet 2922 and the second dirt slot 2924*b* is about 270°. Alternatively, angles 2952*a* and 2952*b* may be different.

In the illustrated configuration, each slot subtends an angle 2950*a*, 2950*b* that is about 45°, the leading edge (in the direction of air circulation) of dirt slot 2924*a* is aligned with the leading edge of dirt slot 2924*b*, and the trailing edge (in the direction of air circulation) of dirt slot 2924*a* is aligned with the trailing edge of dirt slot 2924*b*.

Figure 13:
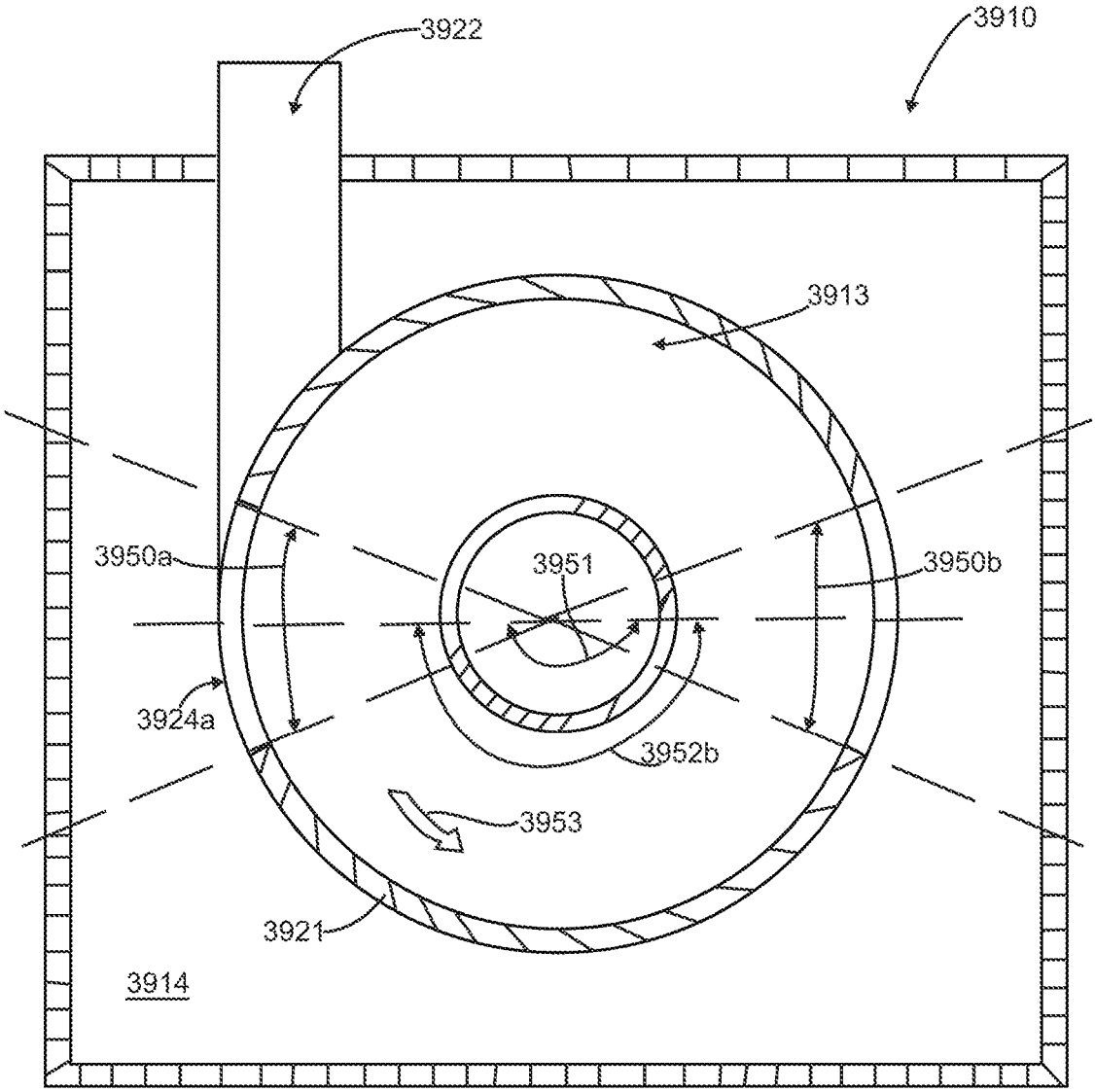
FIG. 13 is a schematic top plan representation of another example of a cyclone bin assembly.

Referring to FIG. 13, a cross-sectional schematic representation of another alternate embodiment of a cyclone bin assembly 3910 is shown. Cyclone bin assembly 3910 is generally similar to cyclone bin assembly 910, and analogous features are identified using like reference characters indexed by 3000. This embodiment is similar to the embodiment of FIG. 12, except that the position of the dirt outlets 3924*a* and 3924*b* has been shifted by 90° relative to the air inlet 3922. In this configuration, the angle 3951 between the dirt outlets 3924*a*, 3924*b* remains 180°, but the angle between the dirt outlet 3924*a* and the air inlet is 0° and the angle 3952*b* between the dirt outlet 3924*b* and the air inlet is 180°.

Figure 14:
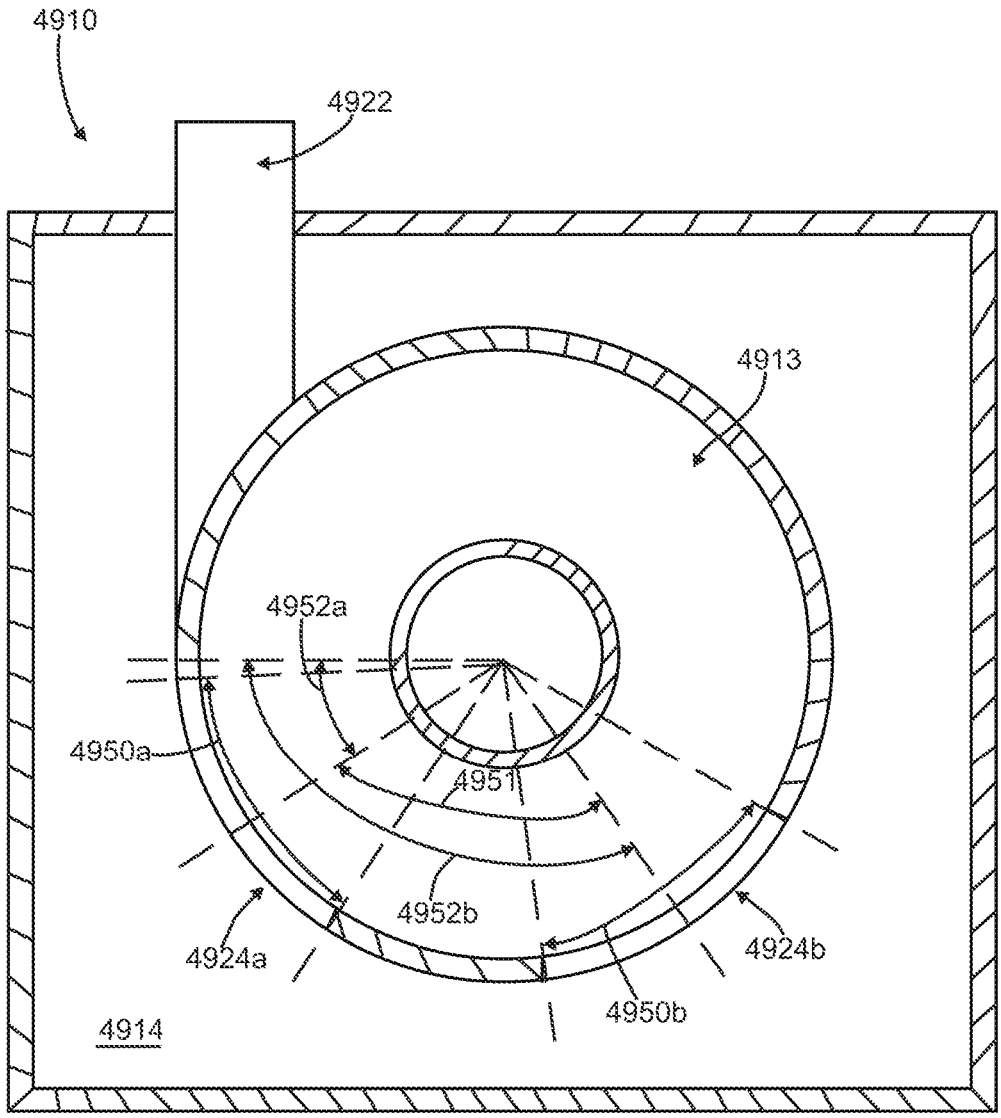
FIG. 14 is a schematic top plan representation of another example of a cyclone bin assembly.

Referring to FIG. 14, a cross-sectional schematic representation of another alternate embodiment of a cyclone bin assembly is shown. Cyclone bin assembly 4910 is generally similar to cyclone bin assembly 910, and analogous features are identified using like reference characters indexed by 4000. In this example, the individual dirt slots 4924*a* and 4924*b* have the same configuration as the slots illustrated in FIGS. 12 and 13, but are positioned differently. In this configuration, the first dirt slot 4924*a* is positioned generally adjacent the air inlet 4922, and the angle 4952*a* between the air inlet 4922 and the first dirt slot 4924*a* is about 30° downstream from the air inlet, and the angle 4952*b* between the first dirt slot and the second dirt slot 4924*b* is about 90°. In this configuration, both dirt slots 4924*a* and 4924*b* are positioned on the same side of the cyclone chamber 4913 (i.e. within 180° of each other).

Figure 15:
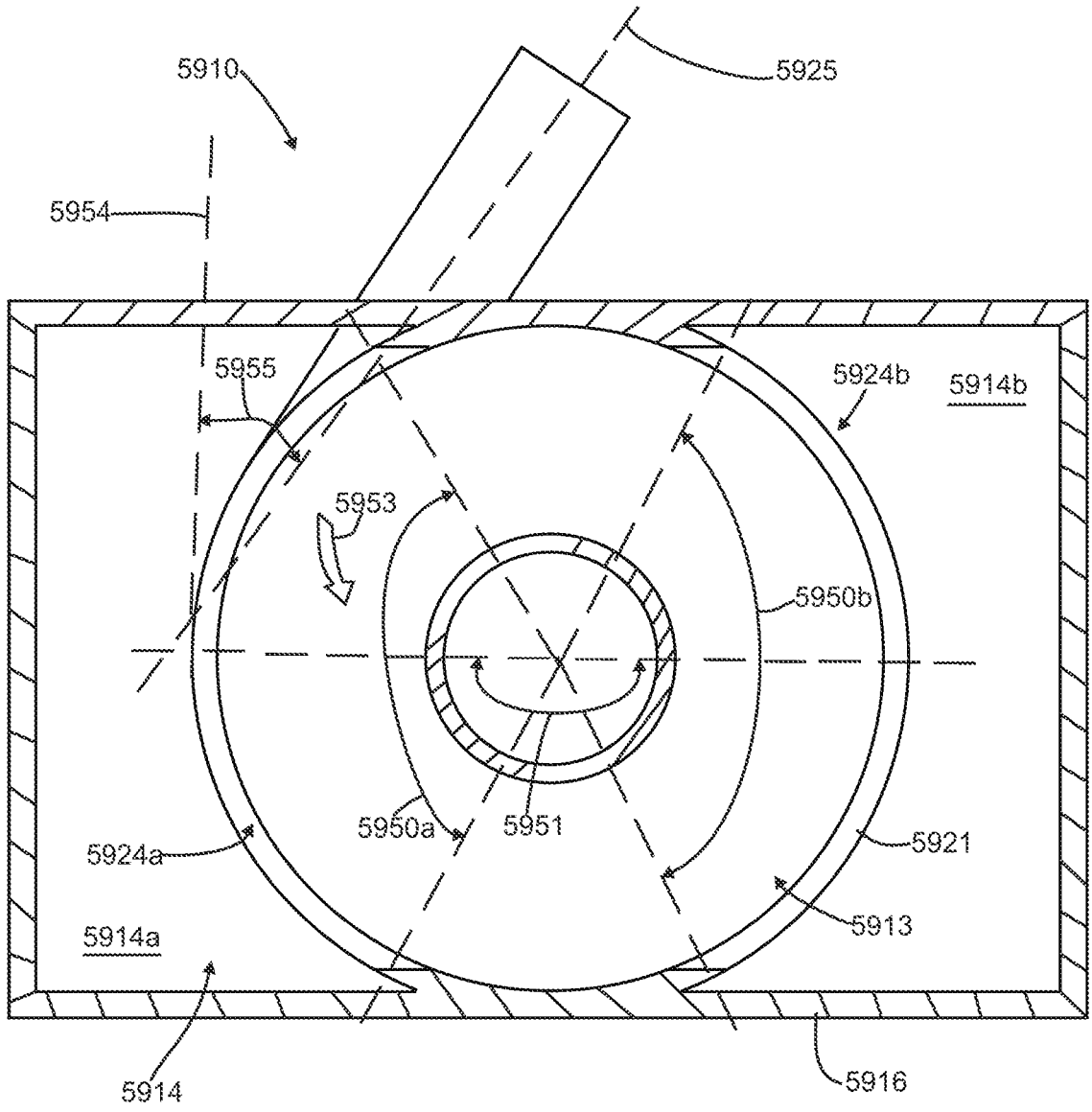
FIG. 15 is a schematic top plan representation of another example of a cyclone bin assembly.

Referring to FIG. 15, a cross-sectional schematic representation of another alternate embodiment of a cyclone bin assembly is shown. Cyclone bin assembly 5910 is generally similar to cyclone bin assembly 910, and analogous features are identified using like reference characters indexed by 5000. In this example, the dirt slots 5924*a* and 5924*b* are opposite each other (i.e. the angle 5951 is about 180°) but each dirt slot 5942*a* and 5924*b* is much wider than the other illustrated examples, such that the angles 5950*a* and 5950*b* subtended by each dirt slot is about 150°. In this configuration, the dirt slots 5942*a* and 5924*b* represent more than 50% of the total perimeter of the cyclone chamber 5913. Also in this embodiment, portions of the cyclone chamber sidewall 5921 are coincident with the dirt collection chamber sidewalls 5916. Optionally, if the cyclone chamber walls 5921 extend the entire height of the dirt collection chamber 5914, in this configuration the cyclone chamber 5913 may sub-divide the dirt collection chamber 5914 into two different portions 5914*a* and 5914*b*, separated by the cyclone chamber 5913. Each dirt collection region 5914*a* and 5914*b* is in communication with a respective one of the dirt slots 5942*a* and 5924*b*. Also, in this illustrated embodiment, the air inlet axis 5925 is not tangentially oriented (i.e. is not parallel to a tangential plane 5954). Instead, the air inlet 5922 is arranged at an angle 5955, relative to the tangential plane 5954. This may alter the characteristics of the air flow entering the cyclone chamber.

Referring again to FIG. 7, in the illustrated embodiment the dirt outlets 924*a* and 924*b* are arranged generally opposite each other, are arranged at approximately 180° from each other (measured as a centre-to-centre angle 951 in FIG. 5). In this configuration, dirt outlet 924*a* is positioned at the front of the cyclone chamber 913 (e.g. in a portion of the sidewall that is located toward the connector and air inlet) and the dirt outlet 924*b* is positioned at the back of the cyclone chamber 913. When the surface cleaning apparatus 900 is in use, dirt and debris may accumulate within the dirt collection chamber 914 and when the surface cleaning apparatus is manipulated by a user, dirt within the dirt collection 914 chamber may tend to shift and may collect toward the lowest portion of the dirt collection 914 chamber due to gravity. For example, when the surface cleaning apparatus is tipper forward, so that the connector is angled downward and the handle is lifted (FIG. 7), dirt 956 may tend to collect toward the front of the dirt collection chamber 914. If the level of the dirt 956 is sufficiently high it may partially or completely block the front dirt outlet 924*a* as illustrated. In this configuration the first dirt outlet 924*a* may be blocked, but the rear dirt outlet 924*b* remains free. Similarly, if the surface cleaning apparatus is tipped rearward, the dirt may tend to collect in a rear portion of the dirt collection chamber (FIG. 8) and may partially or completely block the rear dirt outlet 924*b*. In this configuration the rear dirt outlet 924*b* is blocked, but the front dirt outlet 924*a* is free. Providing two dirt outlets 924*a* and 924*b* on opposite sides of the cyclone chamber may help ensure that at least one outlet 924*a* and 924*b* remains free and unblocked to allow dirt to exit the cyclone chamber 913 even if the surface cleaning apparatus 900 is tilted forward or backward. Alternatively, instead of being provided toward the front and back of the cyclone chamber, the dirt slots may be positioned in other locations. For example, the cyclone chamber may be configured to have a rear dirt outlet and a side dirt outlet, or two side outlets provided toward the left and right sides of the cyclone chamber.

Premotor Filter

Optionally, one or more pre-motor filters may be placed in the air flow path between the cyclone bin assembly and the suction motor. Alternatively, or in addition, one or more post-motor filters may be provided downstream from the suction motor. The following is a description of a pre-motor filter housing construction that may be used by itself in any surface cleaning apparatus or in any combination or sub-combination with any other feature or features disclosed herein.

Reference is now made to FIGS. 3, 36, 39, 40A, 44, and 49, which illustrate surface cleaning apparatus 900, 200, 800, 1000, 1100, and 2100, respectively in accordance with several embodiments. In the illustrated embodiments, a pre-motor filter chamber or housing 956, 241, 841, 1041, 1186, 2248 is provided as a portion of the body or main housing 901, 220, 820, 1020, 1112, 2112 of the surface cleaning apparatus 900, 200, 800, 1000, 1100, and 2100, respectively. Pre-motor filter chamber 956 of apparatus 900 is positioned above the cyclone bin assembly 910. Pre-motor filter chamber 241, 841, 1041, 2248 of apparatus 200, 800, 1000, 2100 is positioned laterally of the cyclone bin assembly 262, 862, 1062, 2110. Pre-motor filter chamber 1186 of apparatus 1100 is positioned below cyclone bin assembly 1110. In all cases, the longitudinal axis of the cyclone chamber extends through the pre-motor filter chamber. Referring also to FIG. 4, the pre-motor filter chamber 956, 241, 841, 1041, 1186, 2248 is bounded by a bottom wall 957, a sidewall 958 and an upper wall 958*a*. In the illustrated example the upper wall 958*a* is provided by an upper cover 959. Preferably, at least one of the bottom wall, sidewall and upper cover are openable to allow access to the interior of the pre-motor filter chamber. In the illustrated embodiments, a panel such as the upper cover 959 (see e.g., FIG. 3) or the side panel (see e.g., FIG. 37) is removable to provide access to the interior of the chamber 956. the panel may be removable or it may be pivotally openable or otherwise moveably coupled to the main body.

One or more filters may be positioned within the pre-motor filter chamber 956 to filter fine particles from the air stream exiting the air outlet, before it flows into inlet of the suction motor. The filters may be of any suitable configuration and formed from any suitable materials. In the illustrated embodiment, a foam filter 960 and a downstream felt filter 961 are positioned within the pre-motor filter chamber 956.

In the illustrated example of FIG. 4, the bottom wall 957 includes a plurality of upstanding support ribs 962 to support the filters 960, 961 positioned within the chamber 956. The support ribs 962 may hold the filters 960, 961 above the surface 963 of the bottom wall 957 to define a lower header or headspace 964, to allow for air to flow laterally between the bottom surface 965 of filter 961 and the bottom wall 957.

Figure 25:
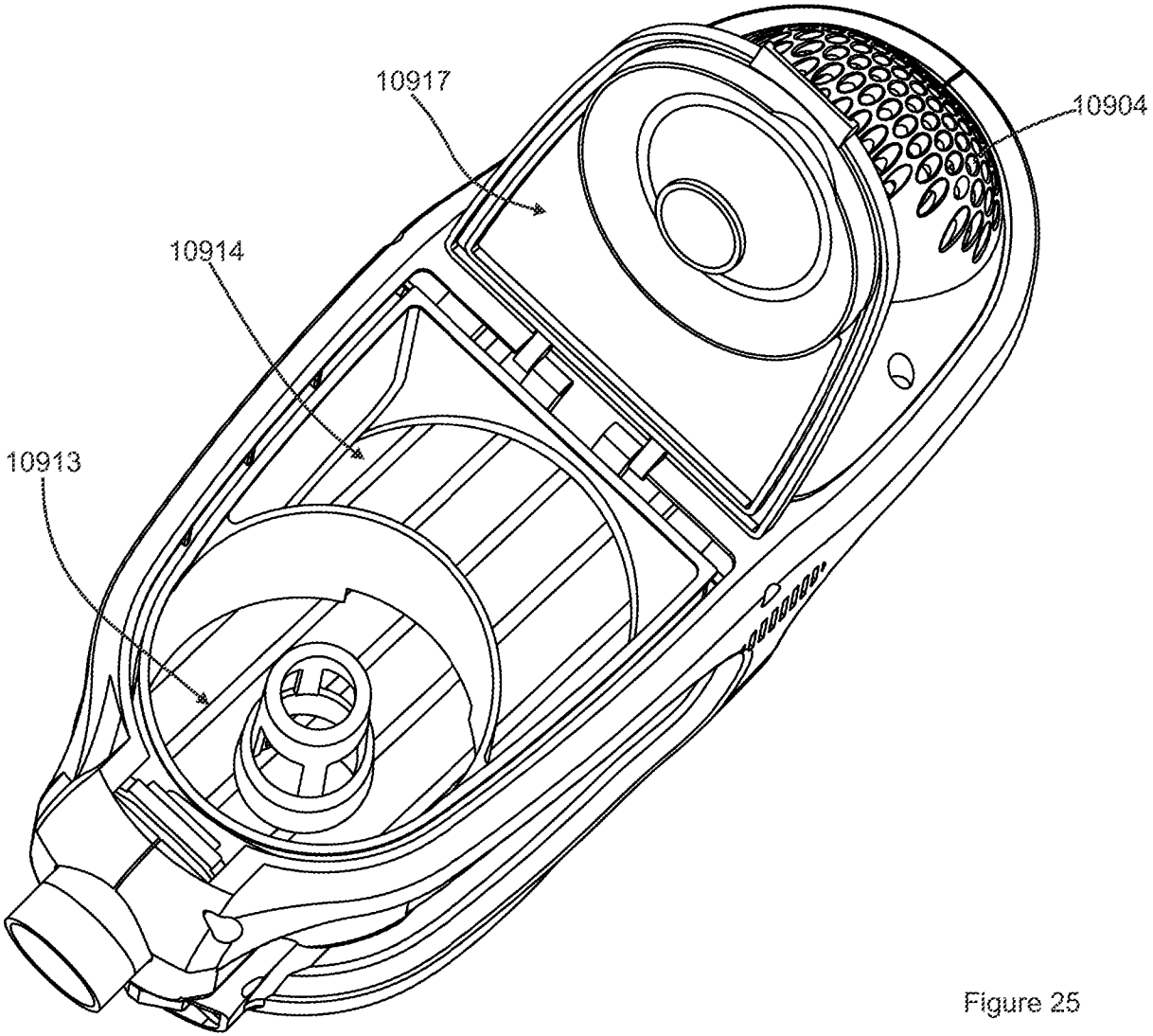
FIG. 25 is a bottom perspective view of the surface cleaning apparatus of FIG. 19.

In the illustrated embodiment, the lower or downstream headspace 964 is defined between the outer surface 965 of the felt 961 and the surface 963 of the bottom wall 957. See also the embodiment of FIG. 25.

To help reduce the overall size of the surface cleaning apparatus, in the illustrated embodiment the pre-motor filter chamber 956, and the filters therein 960, 961, is positioned above the cyclone chamber 913 and covers the upper end of the cyclone chamber 913. In this configuration, a plane 966 containing the foam filter 960 is generally parallel and spaced above a plane 967 containing the air outlet 923 of the cyclone chamber 913, and both planes 966, 967 are generally perpendicular to the cyclone axis 920. Arranging the filters in this configuration results in the upstream side of the pre-motor filter (in this example the upper side 968 of the foam filter 960) being spaced further apart from the cyclone chamber 913 than the downstream side of the pre-motor filter (in this example the lower surface 965 of the felt filter 961). Alternatively, in other embodiments, the pre-motor filter chamber may cover only a portion of the upper end of the cyclone chamber and/or may be laterally spaced apart from the cyclone chamber and/or may be inclined with respect to plane 967. Similar configurations may be used when the filter is positioned laterally from the cyclone chamber as exemplified in FIGS. 36 and 49 or below the cyclone chamber as exemplified in FIG. 44.

In the illustrated embodiment, the pre-motor filter chamber or downstream header 956 is configured so that the upstream side 968 of the foam filter 960 is provided toward the top of the chamber, and air flows generally downwardly through the filters. In this configuration, the upper cover 959 is shaped so that when it is closed (FIG. 8) an upper or upstream headspace or header 970 is provided between the inner surface of the upper cover 959 and the upstream side 968 of the foam filter 960. To provide air flow communication between the cyclone air outlet 923 and the upstream headspace 970, it is preferred that the vortex finder 927 or an extension thereof extends through the pre-motor filters and preferably extends into the interior of the pre-motor filter chamber 956, through the filters 960, 961 therein, and has an outlet end 971 that is located within the upstream head space 970 and above filters 960, 961. To accommodate the extension of the vortex finder 927, each filter includes a correspondingly shaped conduit aperture 972 (FIG. 4). Similarly, as exemplified in FIGS. 36 and 49, the upstream side of the foam filter may be provided toward the outer lateral side of the pre-motor filter chamber and the air may flow laterally inwardly through the pre-motor filter (see e.g., air outlet 264 of FIG. 36) or the upstream side of the foam filter may be provided toward the bottom of the pre-motor filter chamber and the air may flow upwardly through the pre-motor filter (see e.g., air outlet 1230 of FIG. 44). It will be appreciated that other flow paths may be used to connect vortex finder 927 in air communication with upstream headspace 970.

When the surface cleaning apparatus is in use, air exiting the cyclone chamber 913 may flow into the upstream head space 956 via the vortex finder 927. See also air outlet 264 of FIG. 36 and air outlet 1230 of FIG. 44). Within the upstream headspace the air can flow laterally across the upstream surface 968 of the foam filter 960, and down through the filters 960, 961 into the downstream head space 964.

In this configuration, the upper side 988 of the foam filter 960 is exposed to the dirty air exiting the cyclone air outlet 923, and may become dirty or soiled during use. Optionally, the upper cover 959 may include at least one transparent region overlying the upper side 968 of the filter 960. For example, some or all of the upper cover may be formed from a transparent material (such as plastic) or one or more windows may be provided within the upper cover member. Providing a transparent region allows a user to visually inspect the condition of the upstream side 698 of the filter 960 without having to open the upper cover 959. Alternatively, the upper cover 959 need not include any type of transparent portion or inspection region, and a user may inspect the upstream side 968 of the filter 960 when the upper cover 959 is opened or removed.

Alternatively, the pre-motor filter may be provided laterally from the vortex finder. For example, referring to FIG. 16, a cross sectional view of another embodiment of a surface cleaning apparatus 6900 is shown. Apparatus 6900 is similar to apparatus 900, and analogous features are identified using like reference numerals indexed by 6000. In this embodiment, the pre-motor filter 6960 is spaced laterally from the vortex finder 6927. An extension 6927*a* of the vortex finder extends above the top of filter 6960 to define a dirt collection area, which may be emptied when the lid is opened and the surface cleaning apparatus is inverted.

Figure 3:
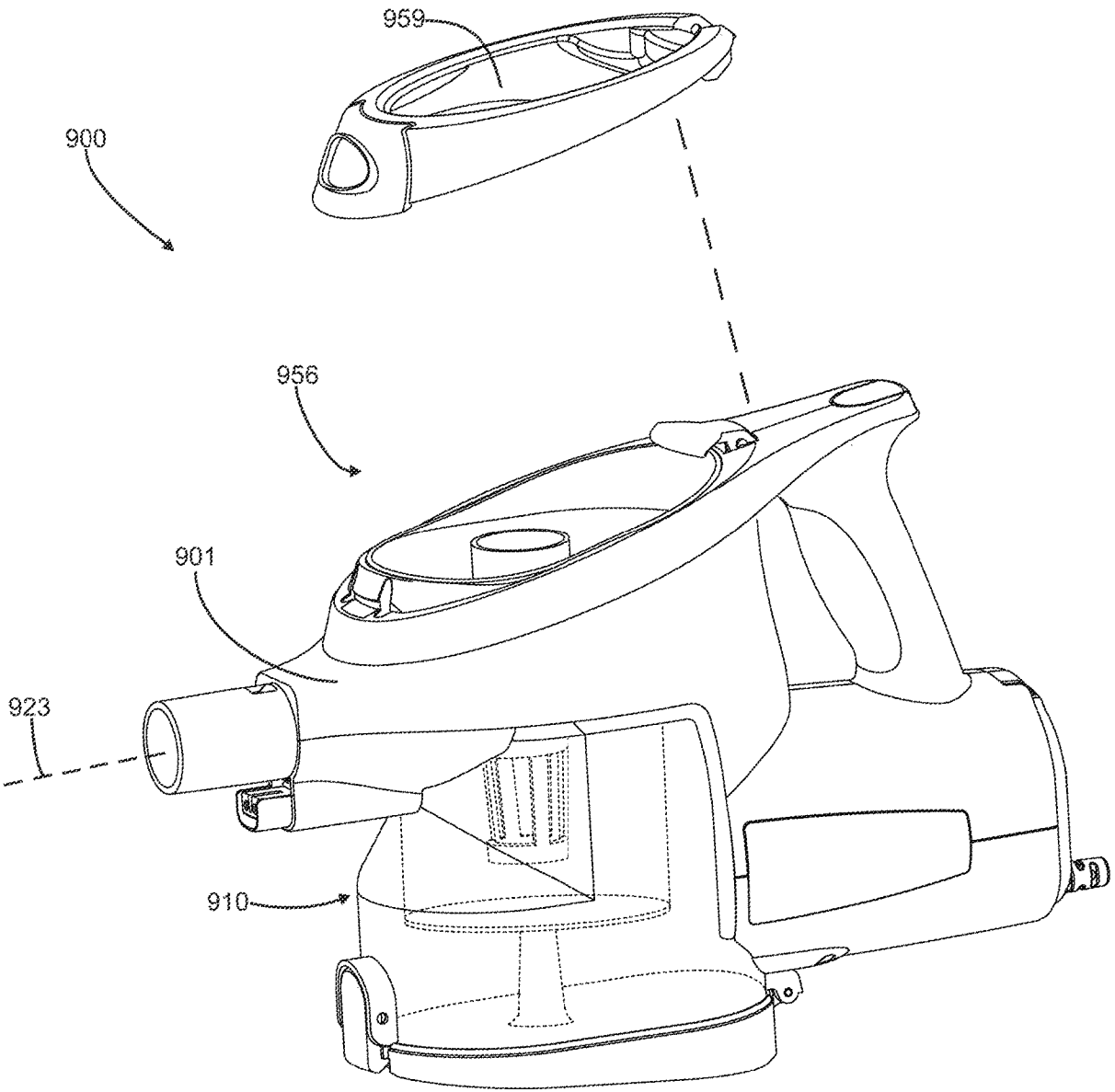
FIG. 3 is a partially exploded perspective view of the surface cleaning apparatus of FIG. 1.
Figure 4:
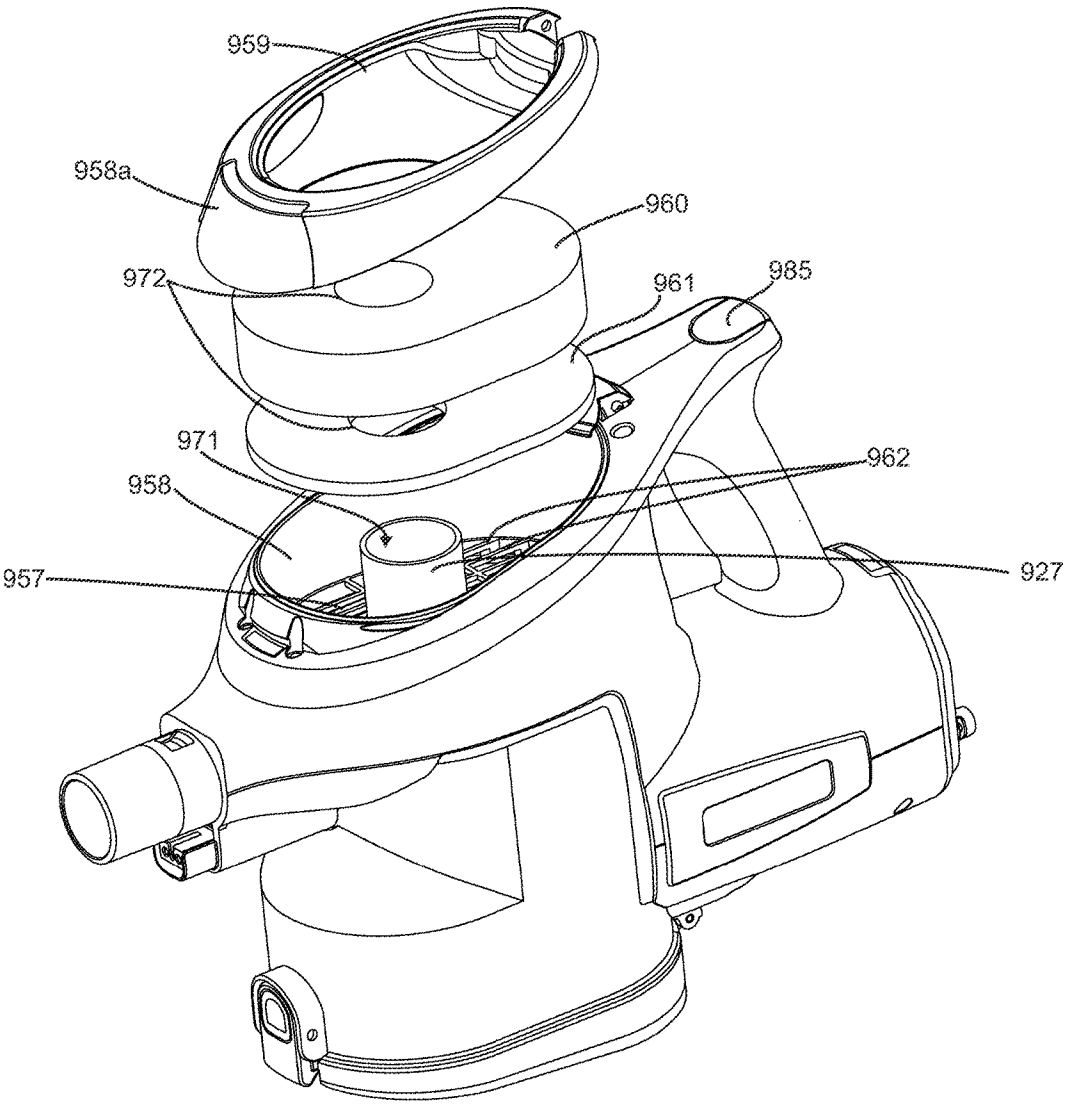
FIG. 4 is another partially exploded perspective view of the surface cleaning apparatus of FIG. 1.

A more detailed discussion of the embodiments of FIGS. 36, 39, 40A, 44, and 49 follows the discussion of the embodiment of FIG. 3.

Downflow Conduit

Optionally, the inlet of the suction motor is positioned along the length of one side (preferably the rear side) of the cyclone bin assembly. The following is a description of a flow path that may be used by itself in any surface cleaning apparatus or in any combination or sub-combination with any other feature or features disclosed herein.

The suction motor preferably has an axis that is generally perpendicular to the cyclone axis and has an air inlet between the upper end and lower end of the cyclone bin assembly and preferably, between the upper end and the lower end of the cyclone chamber. Accordingly, from the downstream head space 964, the air may flow to the inlet 973 of the suction motor 911 via an internal air conduit 974 formed within the body 901. Air may be drawn through the suction motor 911 and then be exhausted from a motor outlet 975, and expelled via the clear air outlet 904 (see also FIG. 6).

In the illustrated embodiment, the internal air conduit 974 is formed within the main body 901 and is external the cyclone chamber 913 and the dirt collection chamber 914 and is partially bounded by an exterior surface of the cyclone chamber sidewall 921 and an exterior surface of the dirt collection chamber sidewall 915. The air conduit 974 extends generally vertically between the pre-motor filter chamber 956 and the suction motor 911, and is positioned laterally intermediate the suction motor 911 and the cyclone chamber 913. The suction motor 911 is positioned at an elevation where its air inlet 973 is vertically between the upper and lower ends of the cyclone chamber 913, and the motor axis 926 passes through the cyclone chamber 913 (above the dirt collection chamber—see FIG. 6). In the illustrated embodiment the inlet axis 925 intersects the air conduit 974 and is positioned below and does not intersect the pre-motor filter chamber 956.

The internal air conduit 974 may extend downwardly at an angle to the vertical. It may or may not be bounded on one side by the sidewall of the cyclone chamber and/or the dirt collection chamber.

Bleed Valve

Optionally, a bleed valve 976 may be provided to supply bleed air to the suction motor inlet 973 in case of a clog in the air flow path upstream from the suction motor 911. When the surface cleaning apparatus is in use, the air flow path may become clogged or otherwise blocked in a number of different ways, including, for example if a cleaning wand and/or suction hose becomes blocked with debris, if the cyclone chamber becomes fouled with debris and/or if the pre-motor filters are soiled to an extent that it significantly impedes airflow through the filters. Preferably the bleed valve 976 can be positioned and configured to supply bleed air into the airflow path at a location that is upstream from the suction motor inlet 973 and downstream from the likely clog or blockage locations.

The following is a description of the positioning and orientation of a bleed valve that may be used by itself in any surface cleaning apparatus or in any combination or sub-combination with any other feature or features disclosed herein.

For example, the bleed valve 976 may be positioned to supply bleed air to the air flow path 974 between the pre-motor filter chamber 956 and the suction motor inlet 973. The bleed valve 976 may be any suitable valve, including a pressure sensitive valve that is opened automatically when there is a blockage in the air flow path upstream from the suction motor 911.

In the illustrated embodiment, the bleed valve 976 extends along a valve axis 977 that is generally parallel to the suction motor axis 926, and is generally orthogonal to the cyclone axis 920. To provide outside air, a port 978 is provided in the main body 901, in air flow communication with the inlet end of the bleed valve 976. The outlet end of the bleed valve is in communication with the air conduit 974.

In the illustrated embodiment, the bleed valve 976 is located at an elevation between the pre-motor filter chamber 956 and the suction motor 911, partially laterally underlies the pre-motor filter chamber 956 (and the filters 960, 961 therein) and partially laterally overlies the suction motor 911 and its housing 912. Alternatively, the bleed valve 976 may be located at a different elevation (for example below the suction motor and/or in line with or above the pre-motor filter chamber) and need not laterally overlap the suction motor, pre-motor filter chambers or the filters therein.

Figure 16:
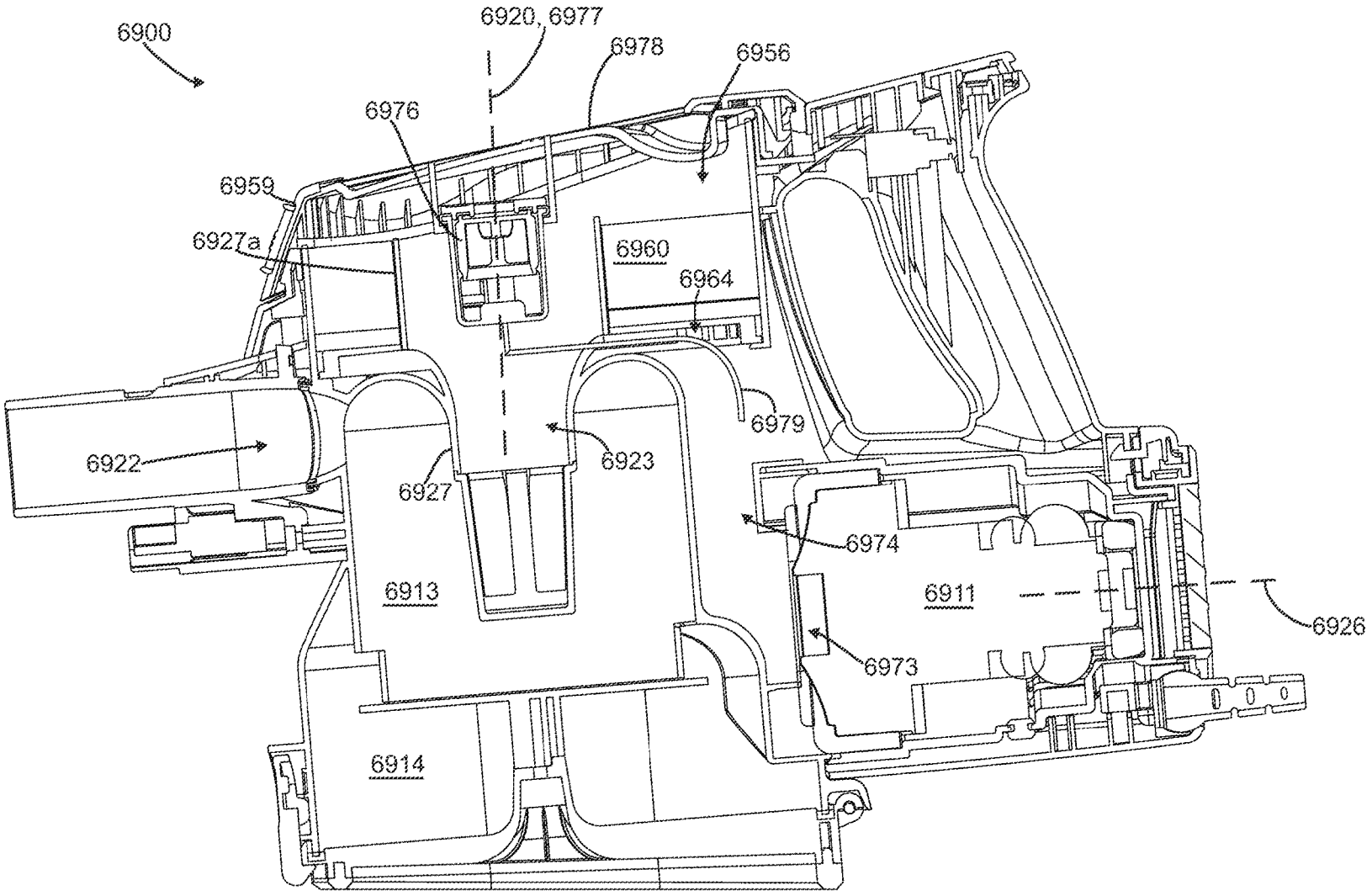
FIG. 16 is a cross sectional view of another embodiment of a surface cleaning apparatus.

Alternatively, instead of extending laterally through the main body of the surface cleaning apparatus, the bleed valve may be provided in a different location. Referring to FIG. 16, a cross sectional view of another embodiment of a surface cleaning apparatus 6900 is shown. Apparatus 6900 is similar to apparatus 900, and analogous features are identified using like reference numerals indexed by 6000. In this embodiment, the bleed valve 6976 is positioned within the pre-motor filter chamber 6956 and is generally vertically oriented, along axis 6977. In the illustrated example, the bleed valve 6976 is generally co-axial with the cyclone chamber 6913. To supply outside air to the bleed valve, a port 6978 is provided in the upper cover 6959 of the pre-motor filter housing 6956 and is in air flow communication with the inlet end of the bleed valve 6976. The outlet end of the bleed valve 6976 is in air flow communication with the air conduit 6974 via a conduit 6979 or optionally via the downstream headspace 6964, to supply the outside air to the suction motor in the event that the pre-motor filters are blocked. The conduit 6979 can be any suitable conduit and can be sized to supply a desired quantity of air to the suction motor 6911.

Handle

Optionally, the surface cleaning apparatus may be provided with one or more handles to allow a user to grasp and manipulate the surface cleaning apparatus. Each handle may have one or more grip portions and may be configured to allow the user to grasp the handle in one or more configurations and/or orientations. Providing a generally upright or pistol-grip style handle may allow a user to grasp the surface cleaning apparatus while keeping his/her wrist in a comfortable, ergonomic position.

The following is a description of the positioning and orientation of a handle that may be used by itself in any surface cleaning apparatus or in any combination or sub-combination with any other feature or features disclosed herein.

Figure 9:
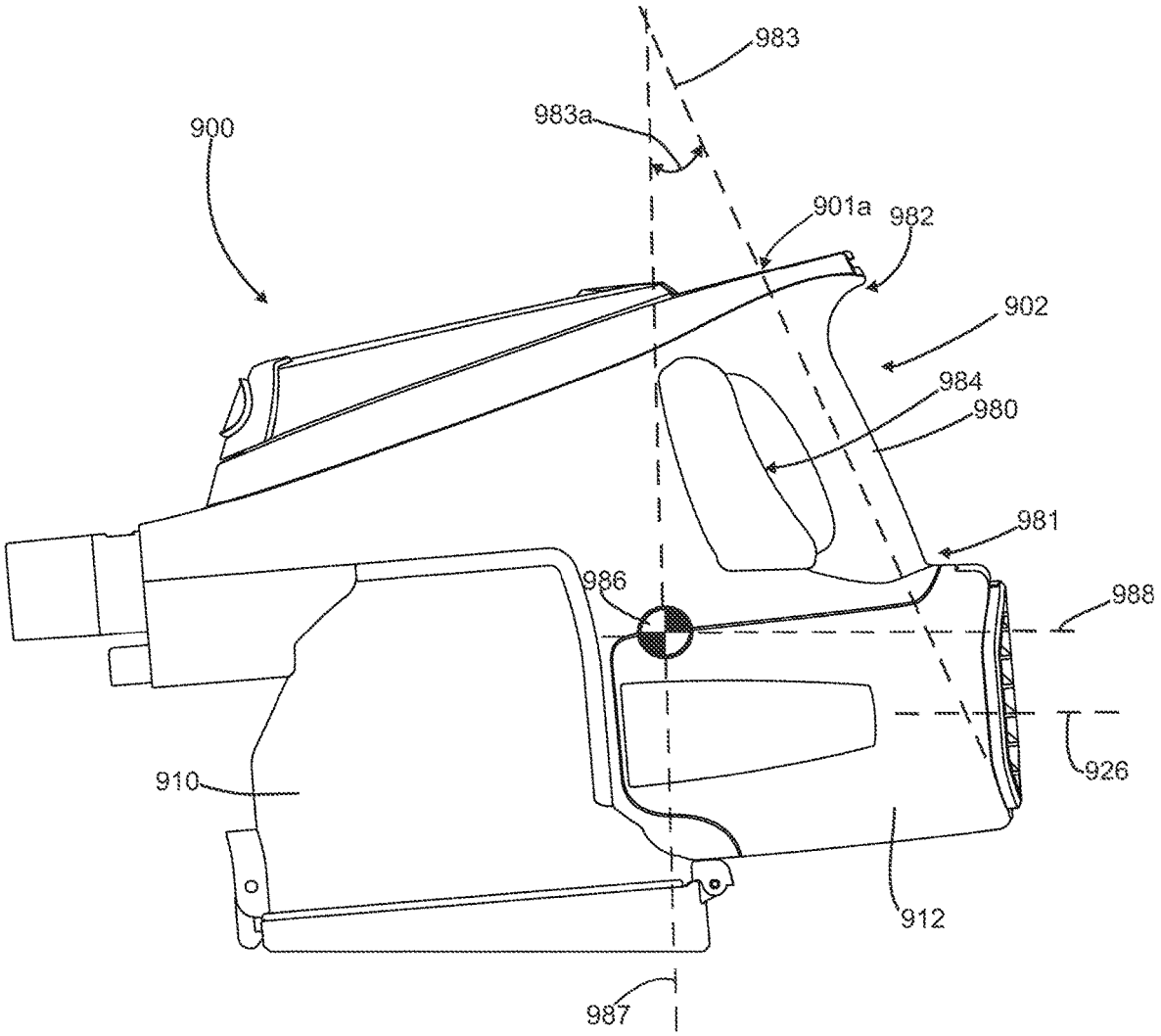
FIG. 9 is a side view of the surface cleaning apparatus of FIG. 1.

Referring to FIG. 9, in the illustrated embodiment, handle 902 is configured as a generally upright handle and includes a grip portion 980 that is configured as a pistol-grip style handle. The handle 902 has a first or bottom end 981 that is adjacent the suction motor housing 912 (e.g., the upper surface thereof) and a second or upper end 982 that is spaced above from the lower end 981. The upper end 981 of the handle may be adjacent the rear side wall of the housing of the pre-motor filter chamber 956 or may be attached to bridge portion that extends rearwardly from the pre-motor filter housing.

The hand grip portion 980 may extend along a handle axis 983. In the illustrated embodiment, the handle axis 983 is inclined slightly forwardly, and forms and angle 983*a*, relative to a vertical axis. The angle 983*a* can be any suitable angle, and preferably is between about 0-45°, and may be between about 20-35°. The handle axis 983 intersects the cyclone axis, the suction motor axis 926 and suction motor housing 912 and a bridge portion 901*a* of the main body that is an extension of the pre-motor filter housing 956.

When grasping the hand grip portion 980, a user's fingers may pass through an opening 984 in front of the hand grip portion 980. In the illustrated embodiment, the perimeter of the opening 984 is formed by an upper portion 912*a* (FIG. 7) of the suction motor housing 912, the front surface 980*a* of the hand grip portion 980, a rear portion of the pre-motor filter chamber sidewall 958 and connecting portions of the main body. Optionally, the air inlet port for the bleed valve 976 may be formed in one of the surfaces forming the perimeter of the handle opening 984.

Preferably, the primary on/off power switch for the surface cleaning apparatus is positioned proximate the handle 902, so that a user may turn the vacuum cleaner on or off while holding it by the handle 902. Referring to FIGS. 4 and 7, in the illustrated embodiment, the primary power switch 985 is provided on the upper end of the handle 902 and is configured so that it can be pressed by the thumb of a user while holding the hand grip portion 980. The hand grip portion 980 can include an internal passage for routing electrical wires or mechanical linkages to provide communication between the primary power switch and the electrical circuit powering the suction motor 911. Optionally, the primary power switch 985 can be positioned so that it is intersected by the handle axis 9083. Alternatively, the primary power switch 985 may be provided at another suitable location.

Optionally, the handle 902 can be positioned so that the hand weight of the surface cleaning apparatus when held in a horizontally disposed position (e.g., axis 988 is horizontal) is less than 2 lbs, preferably less than 1 lbs and more preferably about 0 lbs, thereby reducing the stress on a user's wrist. Accordingly, the user may experience only a slight down force even though the motor is below the handle. The handle 902 may accordingly be positioned so that it is behind the centre of gravity of the surface cleaning apparatus. Preferably, the handle may also be configured so that all or a portion of it (e.g., the portion gripped by a user) is located at a higher elevation than the centre of gravity.

Positioning the handle behind and optionally above the centre of gravity may result in the surface cleaning apparatus tending to tip forwardly when being held horizontally by a user. This may tend to rotate the front of the surface cleaning apparatus downwardly when the surface cleaning apparatus is in use and may allow at least a portion of the weight of the surface cleaning apparatus to be carried by a surface cleaning head (or other tool) that rollingly contacts the floor.

For example, referring to FIG. 9, in the embodiment illustrated, the centre of gravity 986 is located in a vertical plane 987 that is forward of the handle and horizontal plane 988 that lies below the lower end 981 of the handle 902. In the illustrated embodiment the handle axis 983 does not intersect the centre of gravity of the surface cleaning apparatus.

Detachable Motor Housing

The following is a description of detachable motor housing may be used by itself in any surface cleaning apparatus or in any combination or sub-combination with any other feature or features disclosed herein.

Figure 10:
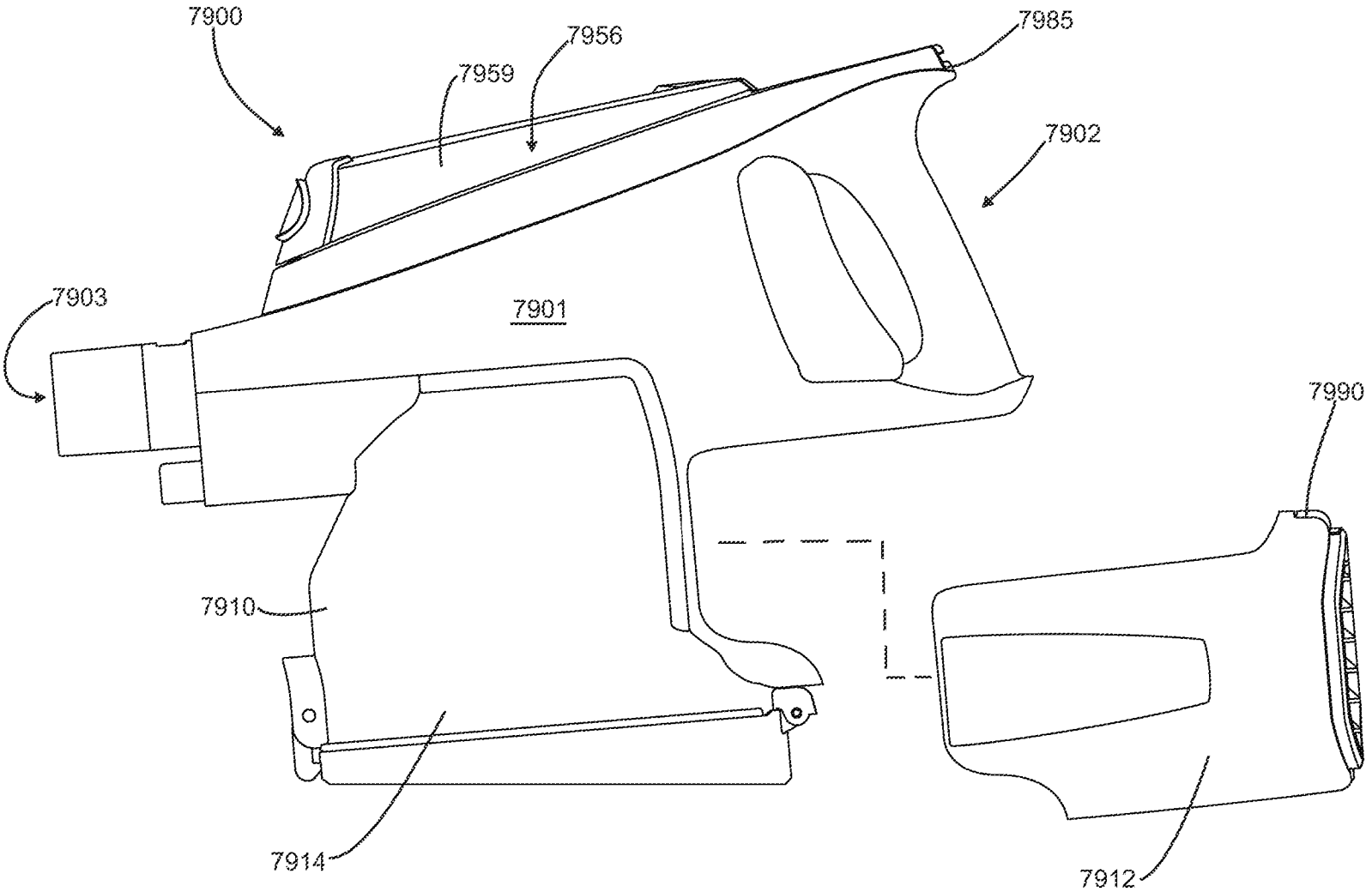
FIG. 10 is a side view of another embodiment of a surface cleaning apparatus with the cyclone bin assembly and handle removed for emptying.
Figure 11:
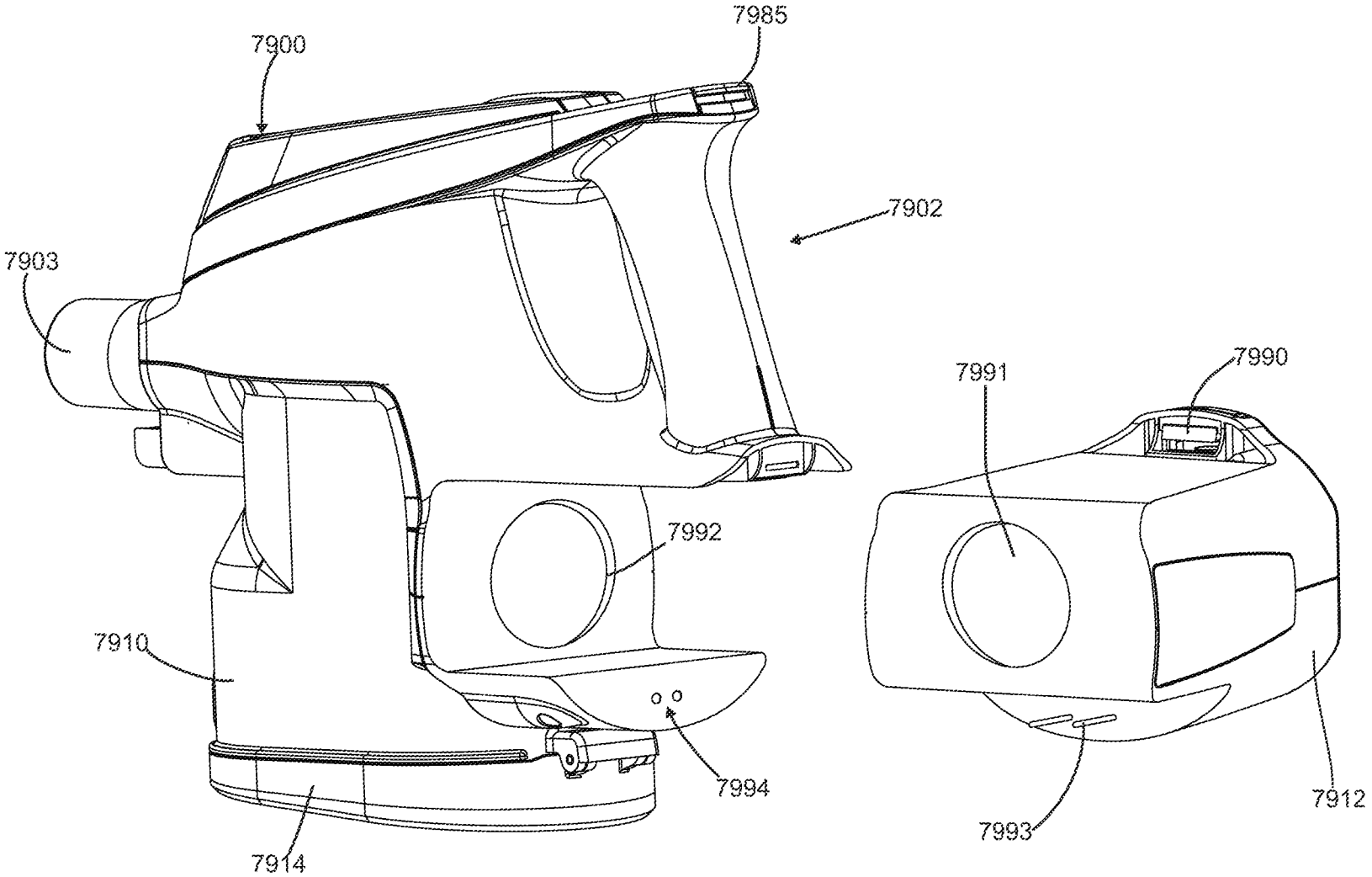
FIG. 11 is a rear perspective view of the surface cleaning apparatus of FIG. 10.

Optionally, the suction motor and at least a portion of its surrounding motor housing may be detachable from the main body of the surface cleaning apparatus. Referring to FIGS. 10 and 11, an alternate embodiment of a surface cleaning apparatus 7900 is shown. Apparatus 7900 is generally similar to apparatus 900 and analogous features are identified using like reference characters indexed by 7000. In this embodiment the suction motor housing 7912 can be detachably connected to the main body 7901, so that the suction motor housing 7912, and the suction motor therein, can be separated from the cyclone bin assembly 7910, handle 7902 and, preferably, pre-motor filter housing 7956. The suction motor and related electrical components may form a significant portion of the weight of the surface cleaning apparatus 7900. Separating the suction motor housing 7912 from the main body 7901 may allow a user to manipulate the main body 7901 and empty the dirt collection chamber 7914 and cyclone 7913 using the handle 7902 without having to carry around the extra weight of the suction motor.

The detachable suction motor housing module 7912 may removably coupled to the main body 7901 using any suitable attachment mechanisms. In the illustrated embodiment the attachment mechanism is a latch 7990 that can be triggered by a user. In this embodiment, the suction motor module 7912 includes an air inlet port 7991 that is configured to be coupled to a reciprocal air outlet port 7992 on the main body 7901. The ports 7991, 7992 may be of any compatible configurations, and one or more seals or gasket members may be provided at their interface to help provide an air-tight connection.

If the primary on/off switch 7985 is provided on the main body portion (as described above) in addition to the air flow connection, the suction motor module 7912 also includes at least one control/electrical connection that is configured to mate with a corresponding control port on the main body 7901. In the illustrated example, the on/off switch 7985 on the main body 7901 is an electrical switch, and the control connection between the suction motor module 7912 and the main body includes mating electrical connectors (e.g., male prongs 7993 and a female electrical socket 7994) to supply electricity to the switch 7985. Alternatively, primary on/off switch 7985 may be a mechanical switch that is connected to the suction motor module via a mechanical linkage. In such a configuration, the control connection can include a mechanical linkage to translate movements of the on/off switch to open and close an electrical circuit in the suction motor housing. Alternatively, control signals may be transmitted wireless (e.g. via radio signal) or in any other suitable manner between the on/off switch and the suction motor housing. In such configurations, the suction motor module and the main body need not include a physical control connection.

Optionally, the surface cleaning apparatus 7900 can be configured so that most or all of the electrical components are located within the suction motor housing 7912. In such a configuration, when the motor housing 7912 is separated from the main body 7901, substantially all of the components remaining in the main body 7901 may be washed without exposing the suction motor and other electrical components to water or other cleaning materials. This may help prevent inadvertent damage to the electrical components when washing the surface cleaning apparatus 7900.

The Surface Cleaning Apparatus

Figure 17:
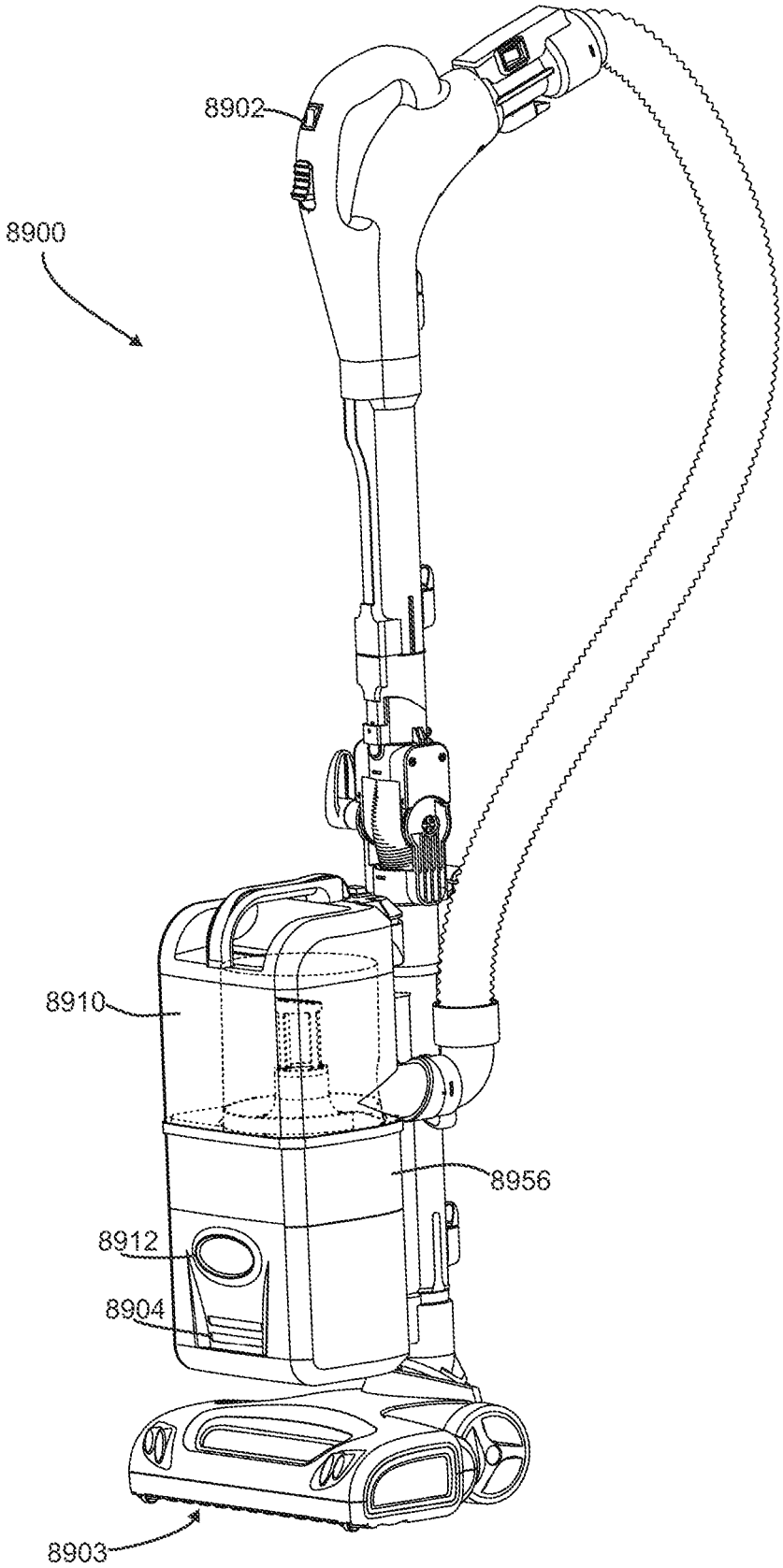
FIG. 17 is a perspective view of another embodiment of a surface cleaning apparatus.

Optionally, instead of a hand-held or carriable surface cleaning apparatus, the surface cleaning apparatus may be an upright-style surface cleaning apparatus or a canister-style cleaning apparatus that includes a cyclone bin assembly having some or all of the features described herein. Referring to FIG. 17, an alternate embodiment of a surface cleaning apparatus 8900 is shown. Apparatus 8900 includes a dirty air inlet 8903, a clean air outlet 8904 and a cyclone bin assembly 8910 mounted to a suction motor housing 8912. A pre-motor filter chamber 8956 is defined between the cyclone bin assembly 8910 and the motor housing 8912. The cyclone bin assembly 8910, suction motor housing 8912 and pre-motor filter chamber 8956 may include some or all of the features described herein, alone or in combination with each other.

Figure 18:
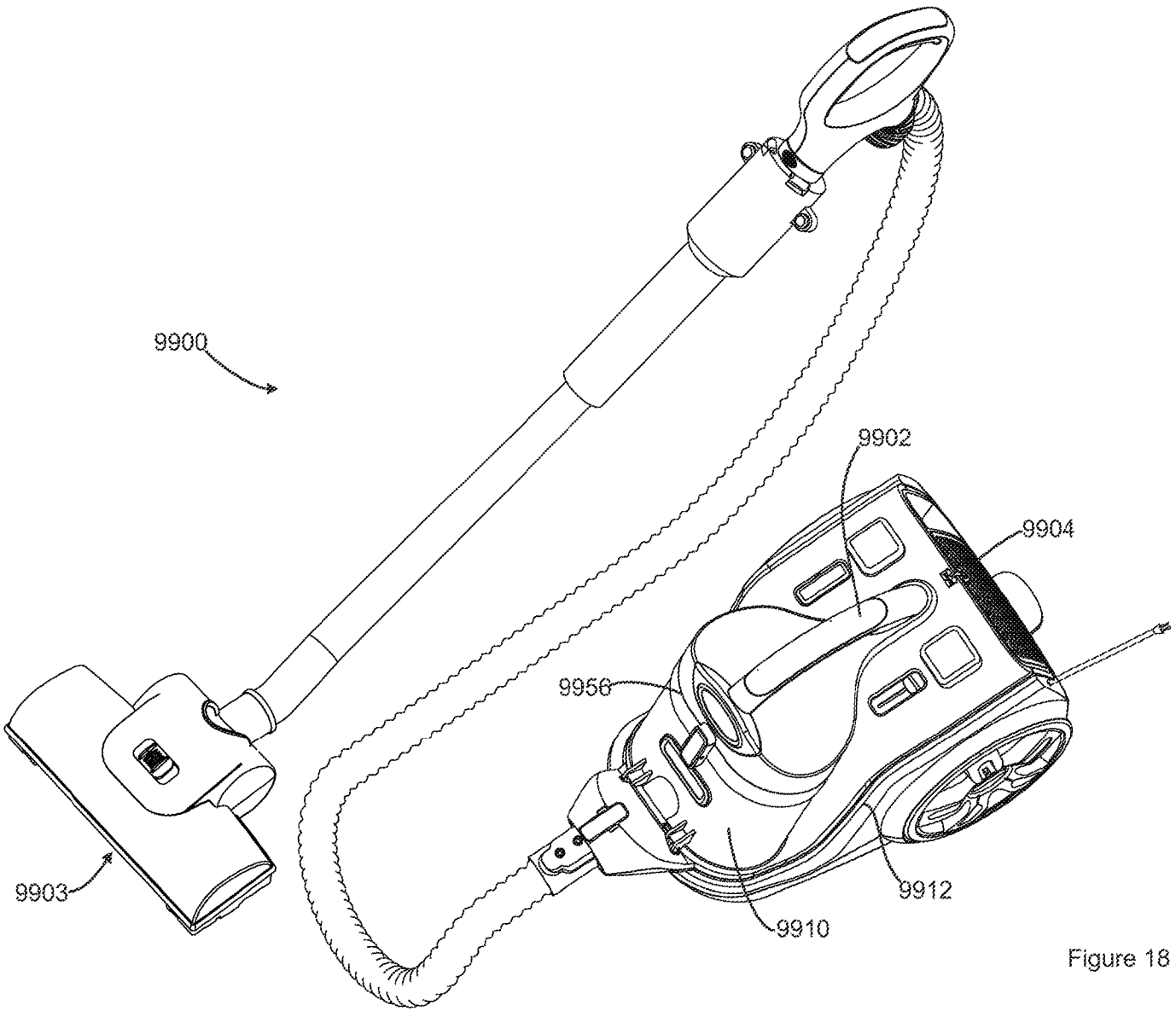
FIG. 18 is a perspective view of another embodiment of a surface cleaning apparatus.

Referring to FIG. 18, an alternate embodiment of a surface cleaning apparatus 9900 is shown. Apparatus 9900 includes a dirty air inlet 9903, a clean air outlet 9904 and a cyclone bin assembly 9910 mounted to a suction motor housing 9912. A pre-motor filter chamber 9956 is defined between the cyclone bin assembly 9910 and the motor housing 9912. The cyclone bin assembly 9910, suction motor housing 9912 and pre-motor filter chamber 9956 may include some or all of the features described herein, alone or in combination with each other.

Alternate Hand Carriable Surface Cleaning Apparatus

Figure 19:
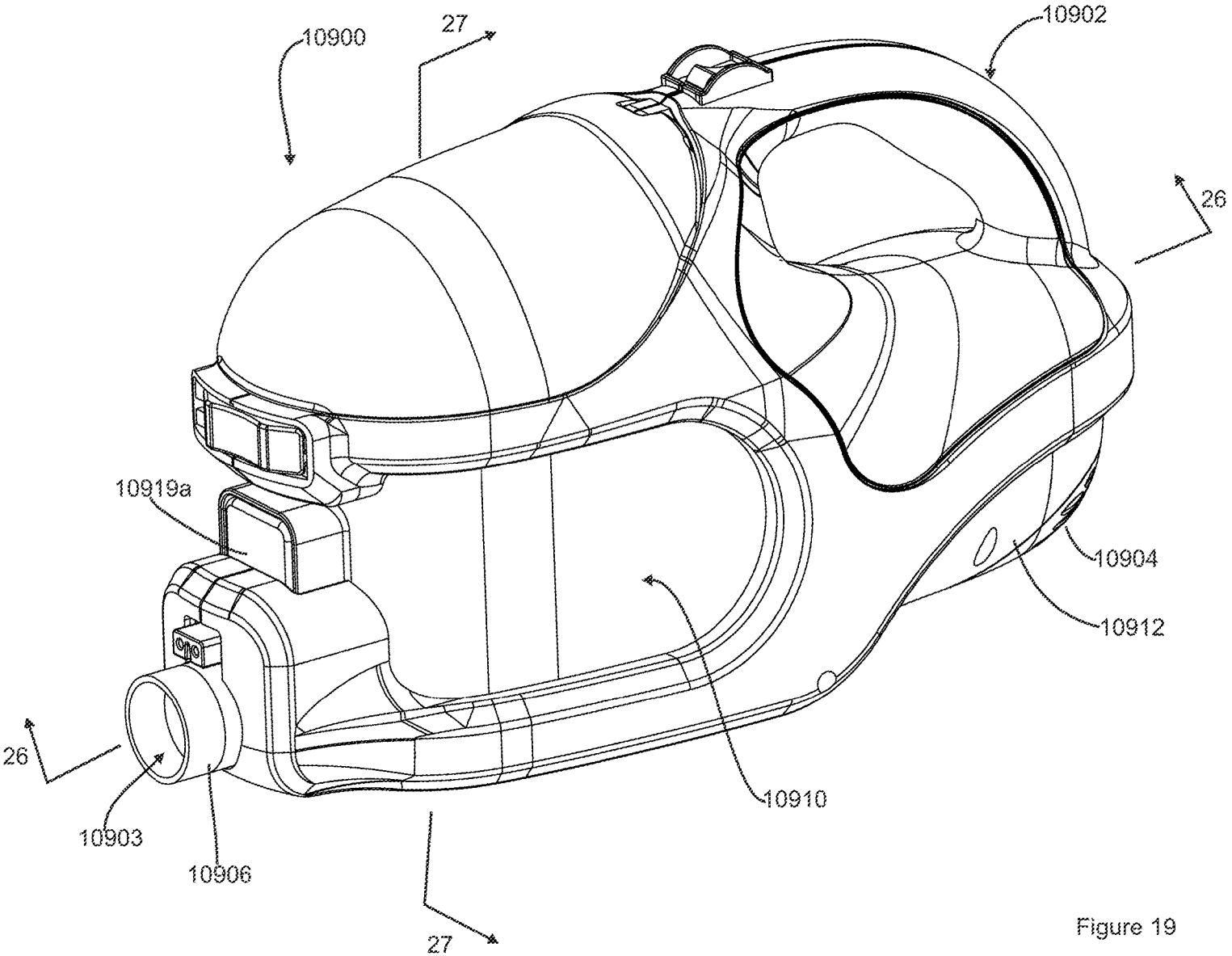
FIG. 19 is a perspective view from the front of another embodiment of a surface cleaning apparatus.

The following description exemplifies a number of the features disclosed herein in an alternate construction for a hand carriable surface cleaning apparatus. Referring to FIG. 19, another embodiment of a hand carriable surface cleaning apparatus 10900 is shown. The surface cleaning apparatus 10900 is similar to surface cleaning apparatus 900, and like features are indicated using analogous reference numbers indexed by 10,000.

The surface cleaning apparatus 900 includes a main body 10901 having a handle 10902, a dirty air inlet 10903, a clean air outlet 10904 (see for example FIG. 26) and an air flow path extending therebetween. In the embodiment shown, the dirty air inlet 10903 is the inlet end of connector 10906. Optionally, the inlet end 10905 can be used to directly clean a surface. Alternatively, the inlet end can be connected to the downstream end of any suitable cleaning tool or accessory, including, for example a wand, a nozzle and a flexible suction hose.

Figure 20:
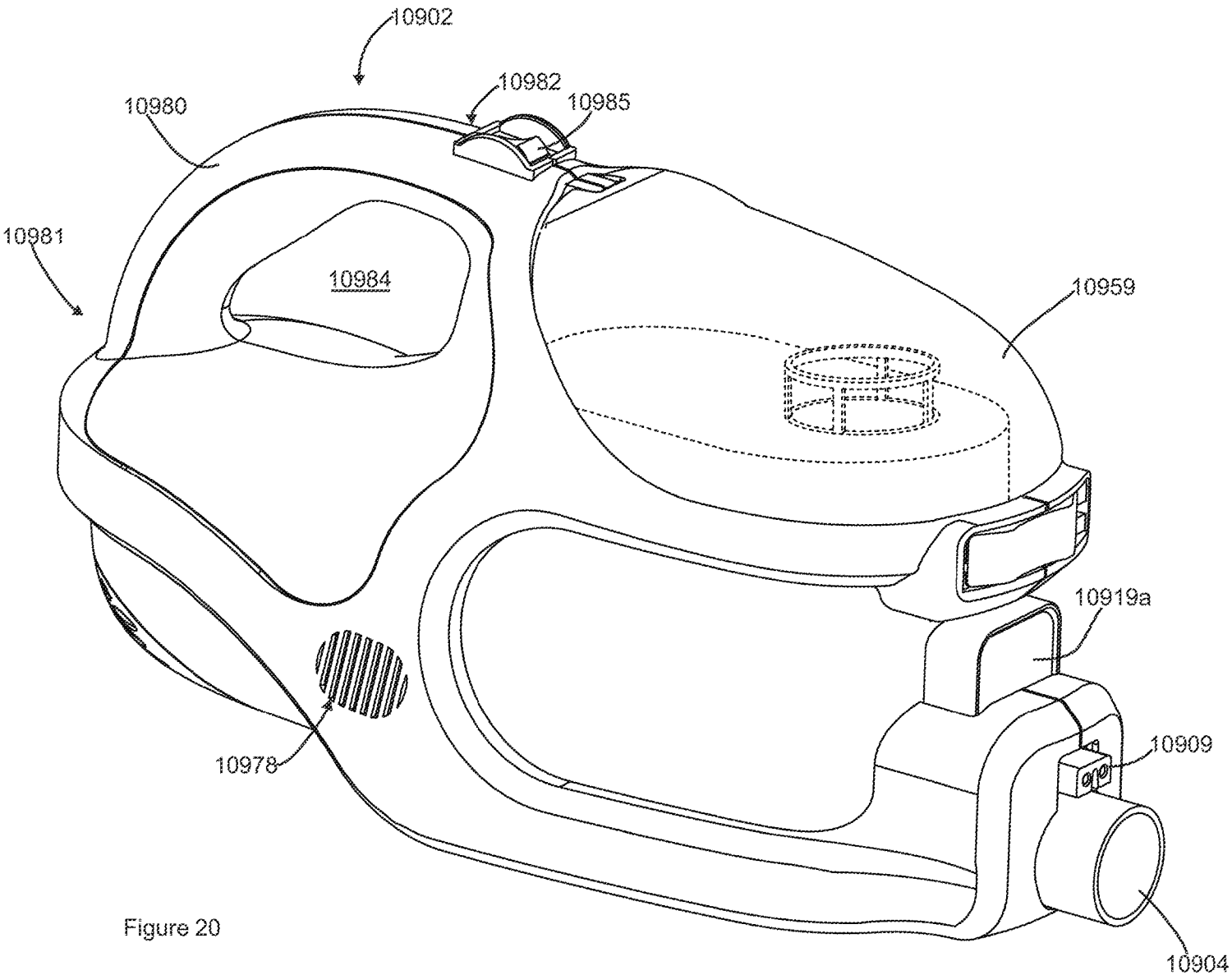
FIG. 20 is another perspective view from the rear of the surface cleaning apparatus of FIG. 19.

The connector 10906 may be any suitable connector that is operable to connect to, and preferably detachably connect to, a cleaning tool or other accessory. Optionally, in addition to provide an air flow connection, the connector may also include an electrical connection 10909 (FIG. 20). Providing an electrical connection 10909 may allow cleaning tools and accessories that are coupled to the connector 10906 to be powered by the surface cleaning apparatus 10900. For example, the surface cleaning unit 10900 can be used to provide both power and suction to a surface cleaning head, or other suitable tool. In the illustrated embodiment, the connector 10909 includes an electrical coupling in the form of a female socket member, and a corresponding male prong member may be provided on the cleaning tools and/or accessories. Providing the female socket on the electrified side of the electrical coupling may help prevent a user from inadvertently contacting the electrical contacts.

Figure 21:
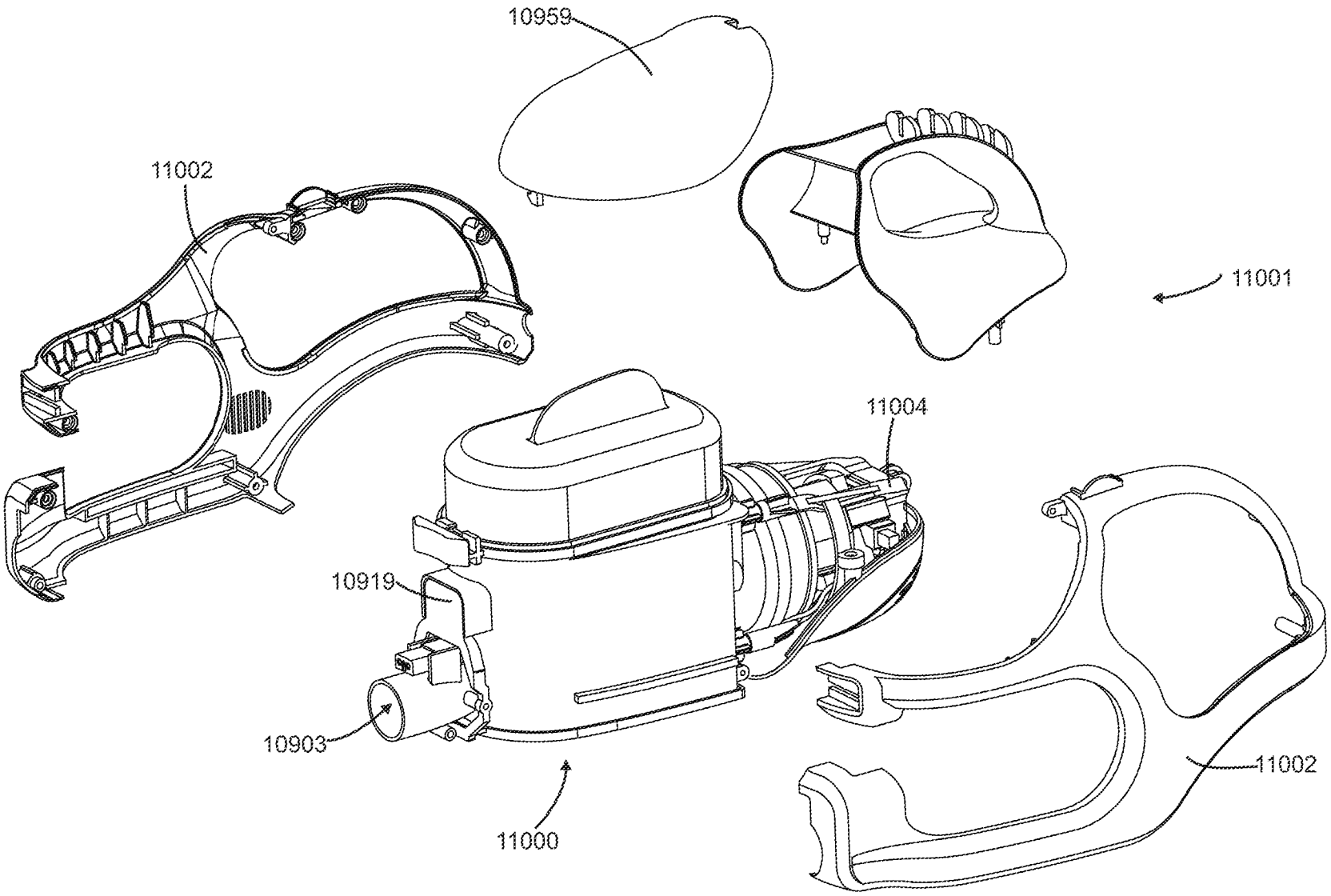
FIG. 21 is a partially exploded perspective view of the surface cleaning apparatus of FIG. 19.
Figure 22:
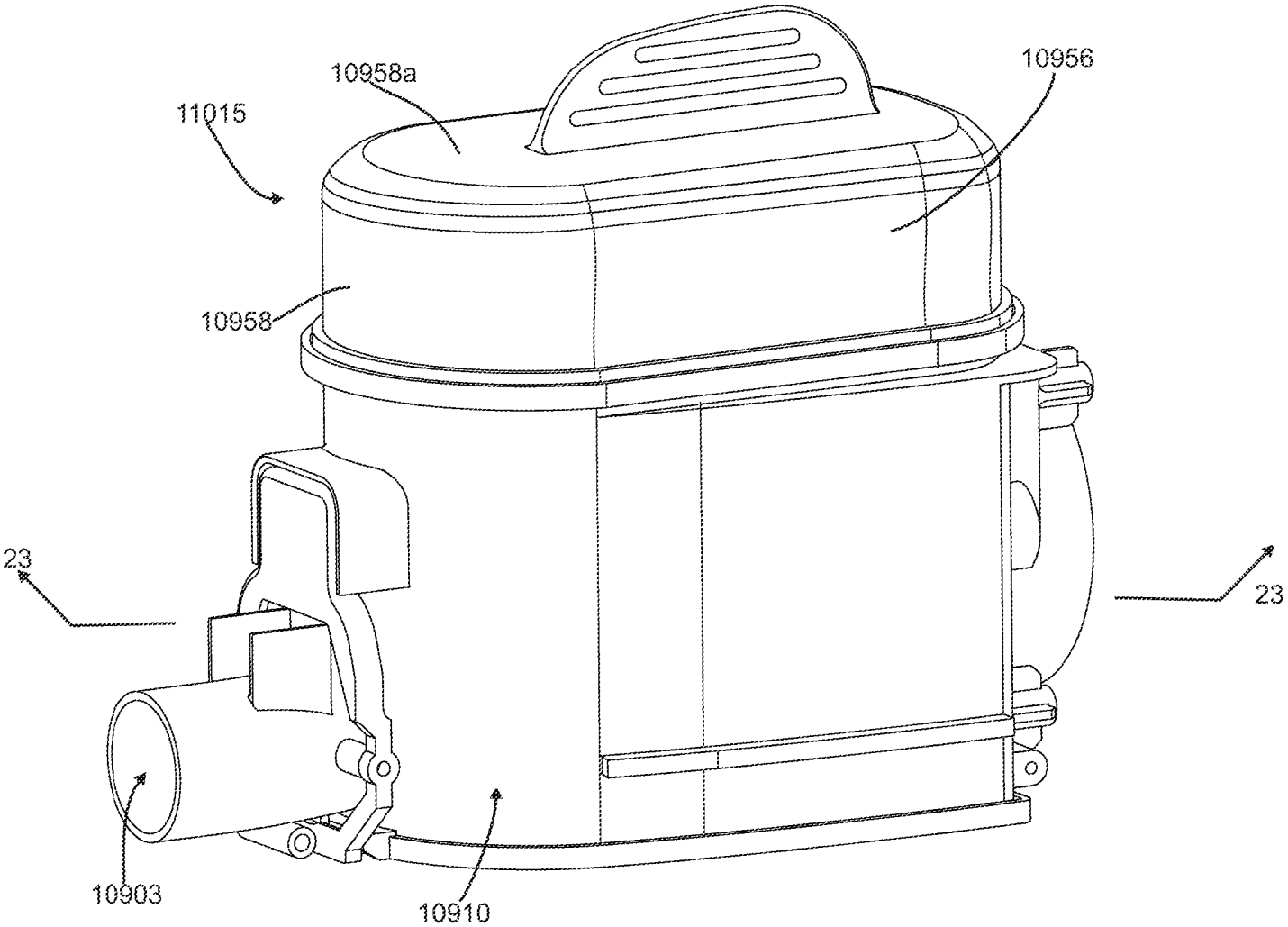
FIG. 22 is a perspective view of a portion of the surface cleaning apparatus of FIG. 19.

Referring to FIG. 21, a construction technique that may be used by itself or with any other feature disclosed herein is exemplified. In this embodiment, the main body portion 10901 of the surface cleaning apparatus includes a core cleaning unit 11000 and an outer shell 11001. In the illustrated example, the core cleaning unit 11000 is a generally, self-contained functional unit that includes the dirty air inlet 10903, air treatment member 10910, pre-motor filter chamber 10956, suction motor 10911 and clean air outlet 10904. The outer shell includes mating side panels 11002, the handle portion 11003 of the surface cleaning apparatus (including the primary power switch 10985) and an openable pre-motor filter chamber cover 10959. When the outer shell 11001 is assembled around the core cleaning unit 11000 the exposed outer surfaces of the surface cleaning apparatus 10900 are formed from a combination of portions of the core cleaning unit 11000 and the outer shell 11001. For example, the external suction motor housing 10912 and handle 10902 are provided by the outer shell 11001, whereas the shell is shaped so that portions of the cyclone bin assembly 10910 sidewalls remain visible in the assembled configuration. If these portions are at least partially transparent, they can allow a user to see into the dirt collection chamber 10914 to determine if the dirt collection chamber 10914 is getting full.

From the dirty air inlet 10903, the air flow path extends through the cyclone bin assembly 10910 which forms part of the main body of the surface cleaning apparatus. A suction motor 10911 (see FIG. 26) is mounted within a motor housing frame 11004 (FIG. 21) of the core cleaning unit 11000 and is in fluid communication with the cyclone bin assembly 10910. In this configuration, the suction motor 10911 is downstream from the cyclone bin assembly 10910 and the clean air outlet 10904 is downstream from the suction motor 10911.

Figure 23:
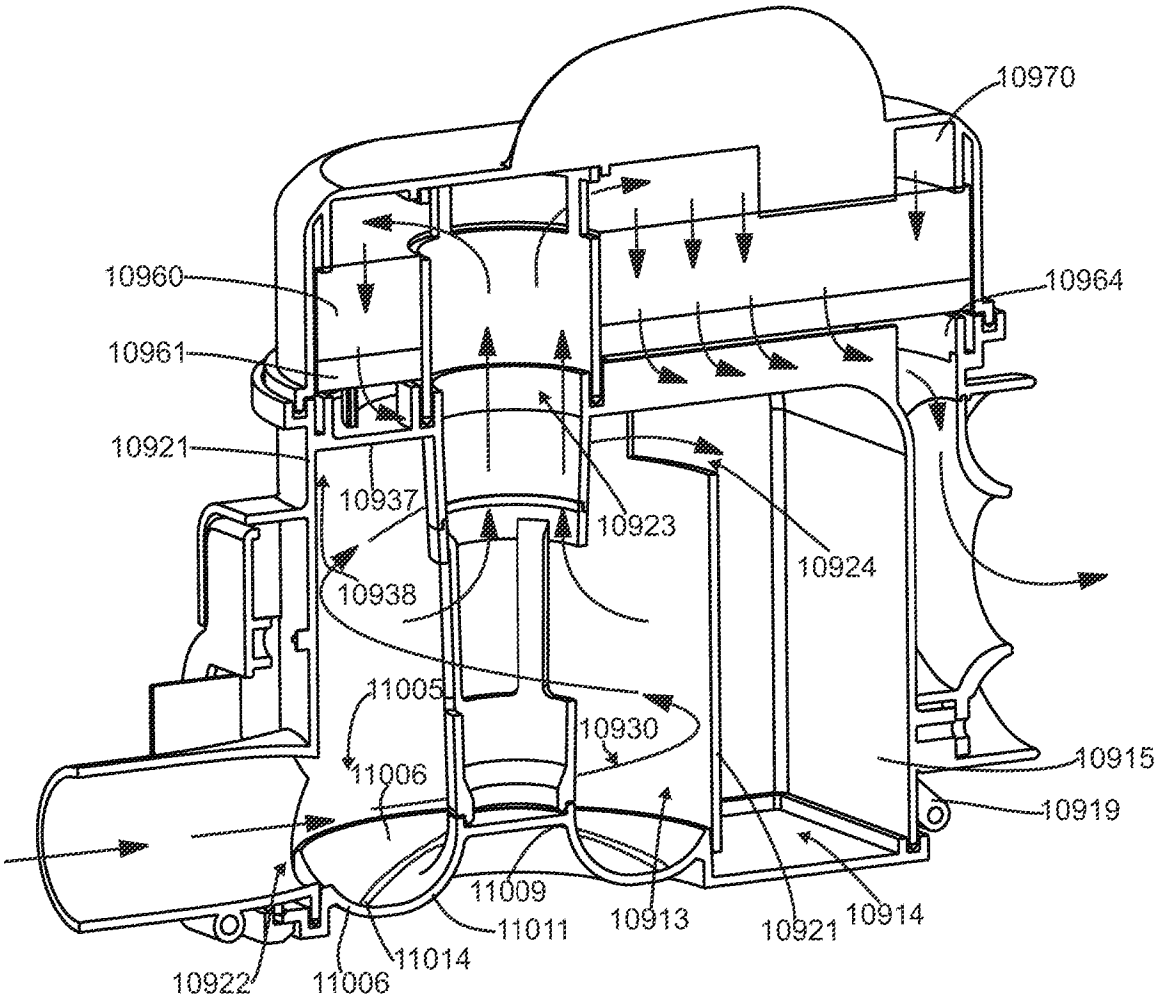
FIG. 23 is a cross sectional view of the FIG. 22, taken along line 23-23 in FIG. 22.
Figure 24:
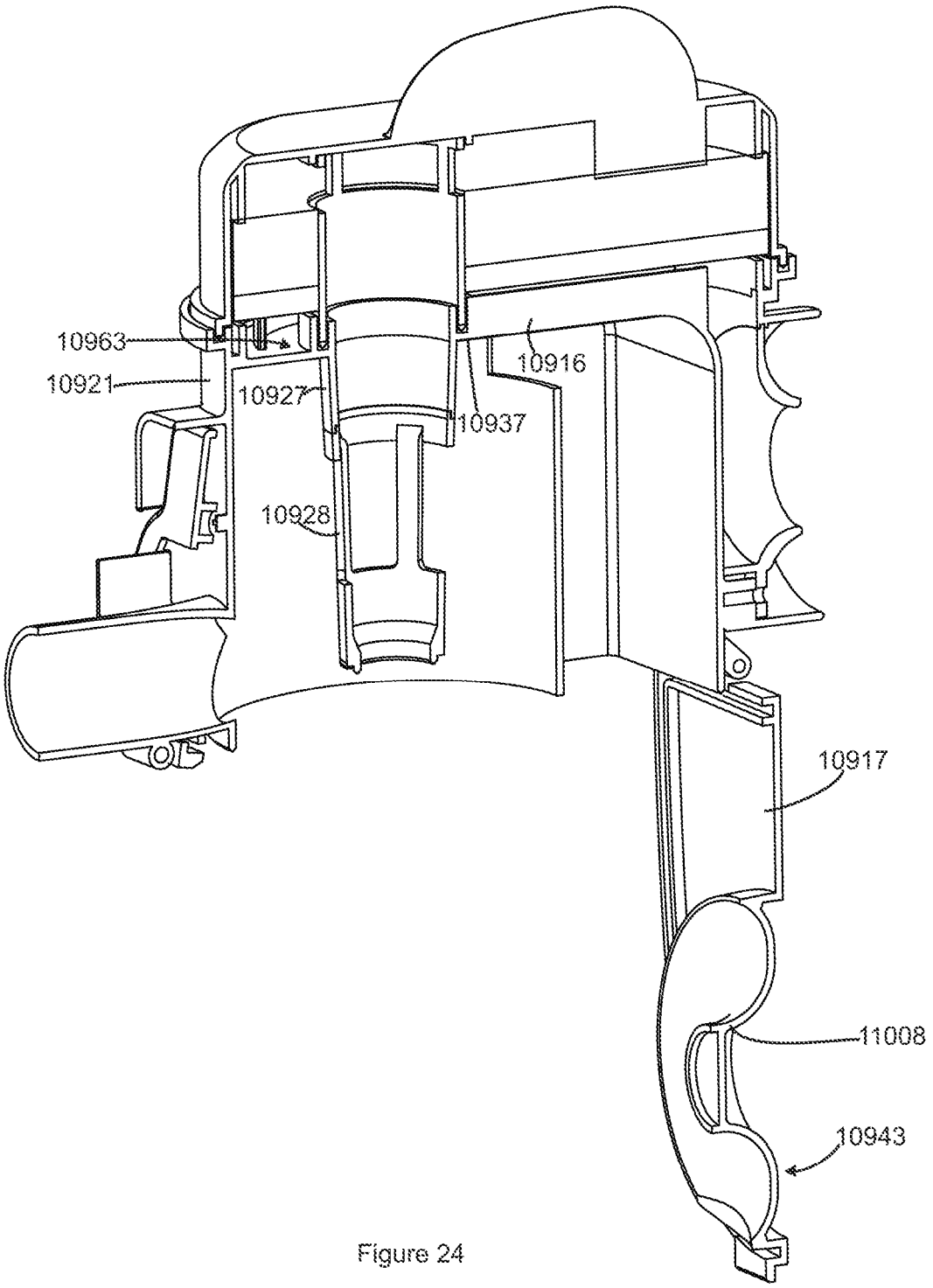
FIG. 24 is the cross sectional view of FIG. 23 with a bottom door in an open position.
Figure 26:
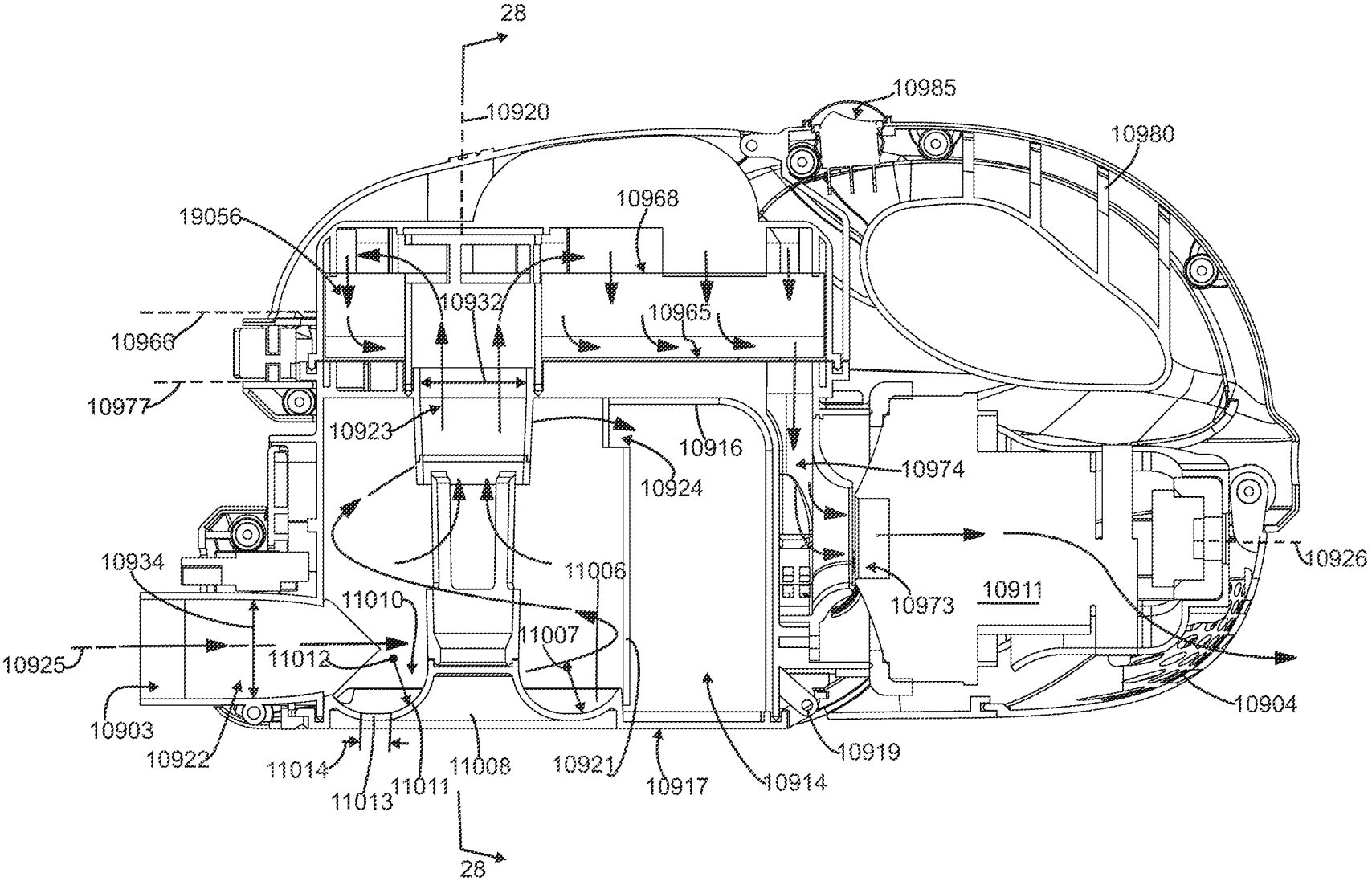
FIG. 26 is a cross sectional view of the surface cleaning apparatus of FIG. 19, taken along line 26-26 in FIG. 19.

Referring to FIGS. 23 and 26, a uniflow cyclone and/or a cyclone with rounded junctures, and/or a cyclone with an insert member any of which may be used by itself or with any other feature disclosed herein is exemplified. In the illustrated embodiment, the cyclone bin assembly 10901 includes a cyclone chamber 10913 and a dirt collection chamber 10914. The dirt collection chamber 10914 comprises a sidewall 10915, a first end wall 10916 and an opposing second end wall 10917. The dirt collection chamber 10914 may be emptyable by any means known in the art and is preferably openable concurrently with the cyclone chamber 10913. Preferably, the second dirt collection chamber end wall 10917 is pivotally connected to the dirt collection chamber sidewall by hinge 10919. The second dirt collection chamber end wall 10913 functions as an openable door to empty the dirt collection chamber 10914 and can be opened (FIGS. 24 and 25) to empty dirt and debris from the interior of the dirt collection chamber 10914. The second dirt collection chamber end wall 10917 can be retained in the closed position by any means known in the art, such as by a releasable latch 10919*a*. In the illustrated example, the hinge 10919 is provided on a back edge of the end wall 10917 and the latch 10919*a* is provided at the front of the end wall 10917 so that the door swings backwardly when opened. Alternatively, the hinge 10919 and latch 10919*a* may be in different positions, and the door 10917 may open in a different direction or manner. Optionally, instead of being openable, the end wall 10917 may be removable.

In the embodiment shown, the cyclone chamber 10913 extends along a cyclone axis 10920 and is bounded by a sidewall 10921. The cyclone chamber 10913 includes an air inlet 10922 and an air outlet 10923 that is in fluid connection downstream from the air inlet 10922 and one dirt outlet 10924 in communication with the dirt collection chamber 10914. In this embodiment, the dirt collection chamber 10914 is positioned adjacent the cyclone chamber 10913 and at least partially surrounds the cyclone chamber 10913 in a side-by-side configuration.

Preferably, the air inlet 10922 is generally tangentially oriented relative to the sidewall 10921, so that air entering the cyclone chamber will tend to swirl and circulate within the cyclone chamber 10913, thereby dis-entraining dirt and debris from the air flow, before leaving the chamber via the air outlet 10923. The air inlet 10922 extends along an inlet axis 10925 that is generally perpendicular to the cyclone axis 10920, and in the illustrated example is generally parallel to and offset above the suction motor axis 10926.

In the illustrated example, the cyclone air outlet 10923 includes a vortex finder 10927. Optionally, a screen 10928 can be positioned over the vortex finder 10927 to help filter lint, fluff and other fine debris. Preferably, the screen 10928 can be removable.

The air inlet 10922 has an inlet diameter 10934, and a related inlet flow cross-sectional area (measure in a plane perpendicular to the inlet axis). Preferably, the air outlet 10923 is sized so that the diameter 10932 of the air outlet 10923, and therefore the corresponding flow area of the air outlet 10923, is the same as the diameter of the air inlet. Alternatively, the air outlet diameter 10932 may be between about 50% and about 150%, and between about 85-115% of the air inlet diameter 10925.

In the example illustrated the cyclone bin assembly 10910, and the cyclone chamber 10913 are arranged in a generally vertical, uniflow cyclone configuration. In a uniflow cyclone, the air inlet is located toward one end of the cyclone chamber and the air outlet is provided toward the other end of the cyclone chamber. In this configuration, air enters one end of the cyclone chamber and generally exits via the other end of the cyclone chamber, as opposed to the cyclone chamber illustrated in the embodiment of FIGS. 1 to 18, in which air enters and exits the cyclone chamber via the same end. In the illustrated example, the air inlet 10922 is provided toward the lower end of the cyclone chamber 10913 and the air outlet 10923 is provided toward the upper end of the cyclone chamber 10913, such that air flows into the bottom of the cyclone chamber 10913 and exits at the top of the cyclone chamber 10913. Alternatively, the locations of the air inlet and outlet can be reversed.

Optionally, instead of a vertical configuration, the cyclone bin assembly 10910 and cyclone chamber 10913 can be provided in another orientation, including, for example, as a horizontal cyclone.

Optionally, some or all of the cyclone sidewall 10921 can coincide with portions of the external sidewalls of the cyclone bin assembly 10910 and the dirt collection chamber sidewall 10915. Referring to FIG. 23, in the illustrated embodiment the front portion of the cyclone chamber sidewall 10921 is coincident with the outer sidewall of the cyclone bin assembly 10910, and the rear portion of the cyclone sidewall 10921 helps separate the cyclone chamber 10913 from the dirt collection chamber 10914. This may help reduce the overall size of the cyclone bin assembly 10910. Alternative, the sidewall 10921 may be distinct from the sidewalls 10915. In alternative embodiments, the cyclone chamber 10913 may include only two dirt outlets 10924, or more than two dirt outlets.

In the illustrated embodiment, the cyclone chamber 10913 includes a first or upper end wall 10937 (FIG. 23) and a second or lower end wall 10943. The upper end wall 10937 is connected to the upper end of the sidewall 10921. In the illustrated example, a juncture 10938 between the end wall 10937 and the side wall 10921 is a relatively sharp corner that does not include any type of angled or radiused surface. In contrast, the lower end wall 10943 meets the lower end of the cyclone sidewall 10921 at a juncture 11005 that includes a curved juncture surface 11006 (see also FIG. 27). The radius 11007 of the curved surface 11006 may be selected based on the radius of the air inlet (e.g. half of the diameter 10934), and optionally may be the selected so that the juncture surface 11006 has the same radius as the air inlet 10922.

The curved juncture surface can be provided as a portion of the sidewall or as a portion of the endwall. In the illustrated embodiment, the curved juncture surface 11006 is provided as part of an insert member 11008 that is provided on the bottom end wall and extends upward into the interior of the cyclone chamber 10913. The insert member also includes an upwardly extending projection member 11009 that extends into the interior of the cyclone chamber and engages the distal end 10930 of the screen (FIG. 23). Together, the vortex finder 10927, screen 10928 and projection member 11009 form a generally continuous internal column member that extends between the first and second end walls 10937 and 10943 of the cyclone chamber 10910. Providing the projection member 11009 may help direct air flow within the cyclone chamber, and may help support and/or stabilize the distal end 10930 of the screen 10928.

Optionally, the juncture 11010 between the end wall 10943 and the projection member 11009 may include a curved surface 11011 (see FIGS. 23 and 26), and preferably is sized so that the surface 11011 has a radius 11012 that is the same as radius 11007. Providing curved surfaces 11006 and 11011 at the junctures between the end wall 10943 and the sidewall 10921, may help reduce backpressure and may help improve cyclone efficiency. Preferably, the two curved juncture surfaces 11006 and 11011 are separated by a generally flat, planar transition surface 11013, having a width 11014. Providing a flat transition surface 11013 may help improve air flow, and/or reduce back pressure to help improve cyclone efficiency.

In the illustrated embodiment, the second end wall 10943 of the cyclone chamber 10913, and the insert member 11008 provided thereon, is integral with the openable bottom door 10917 that provides the bottom wall of the dirt collection chamber 10914. In this configuration, opening the door simultaneously opens the cyclone chamber 10913 and the dirt collection chamber 10914 (see for example FIGS. 24 and 25) for emptying.

In the illustrated embodiment, the dirt outlet 10924 is in the form of a slot having bottom and side edges provided by the cyclone chamber sidewall 10921, and a top edge provided by the upper end wall 10937. Alternatively, all four edges of the slot 10924 may be provided by the cyclone chamber sidewall 10921. The dirt slot 10924 is positioned at the back of the cyclone chamber 10921 and is generally opposite the air inlet 10922. In the illustrated embodiment, the upper wall 10937 of the cyclone chamber is integral with the upper wall 10916 (FIGS. 23 and 26) of the dirt collection chamber 10914.

Optionally, one or more pre-motor filters may be placed in the air flow path between the cyclone bin assembly 10910 and the suction motor 10911. Alternatively, or in addition, one or more post-motor filters may be provided downstream from the suction motor.

Figure 27:
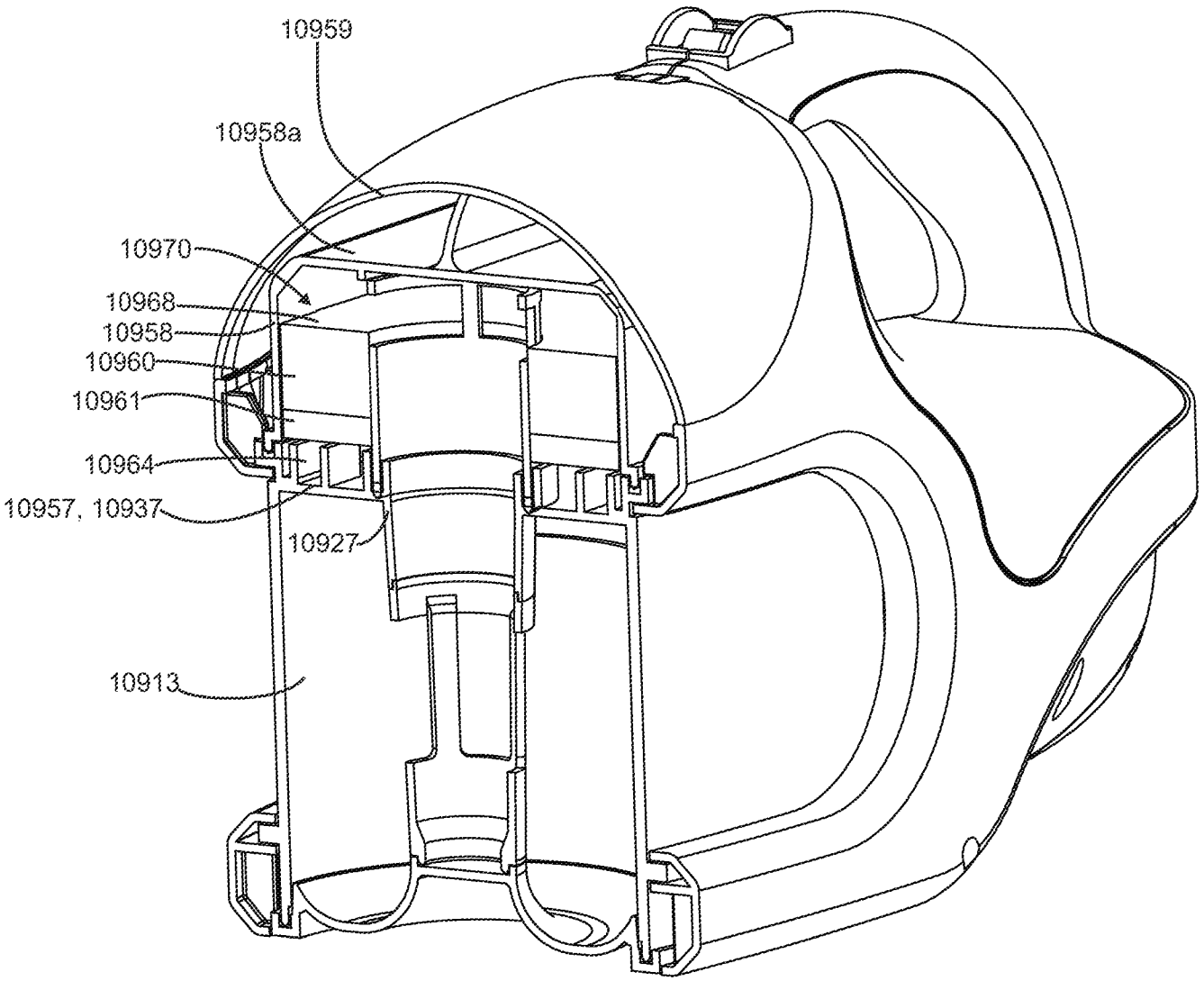
FIG. 27 is a cross sectional view taken along line 27-27 in FIG. 19.
Figure 28:
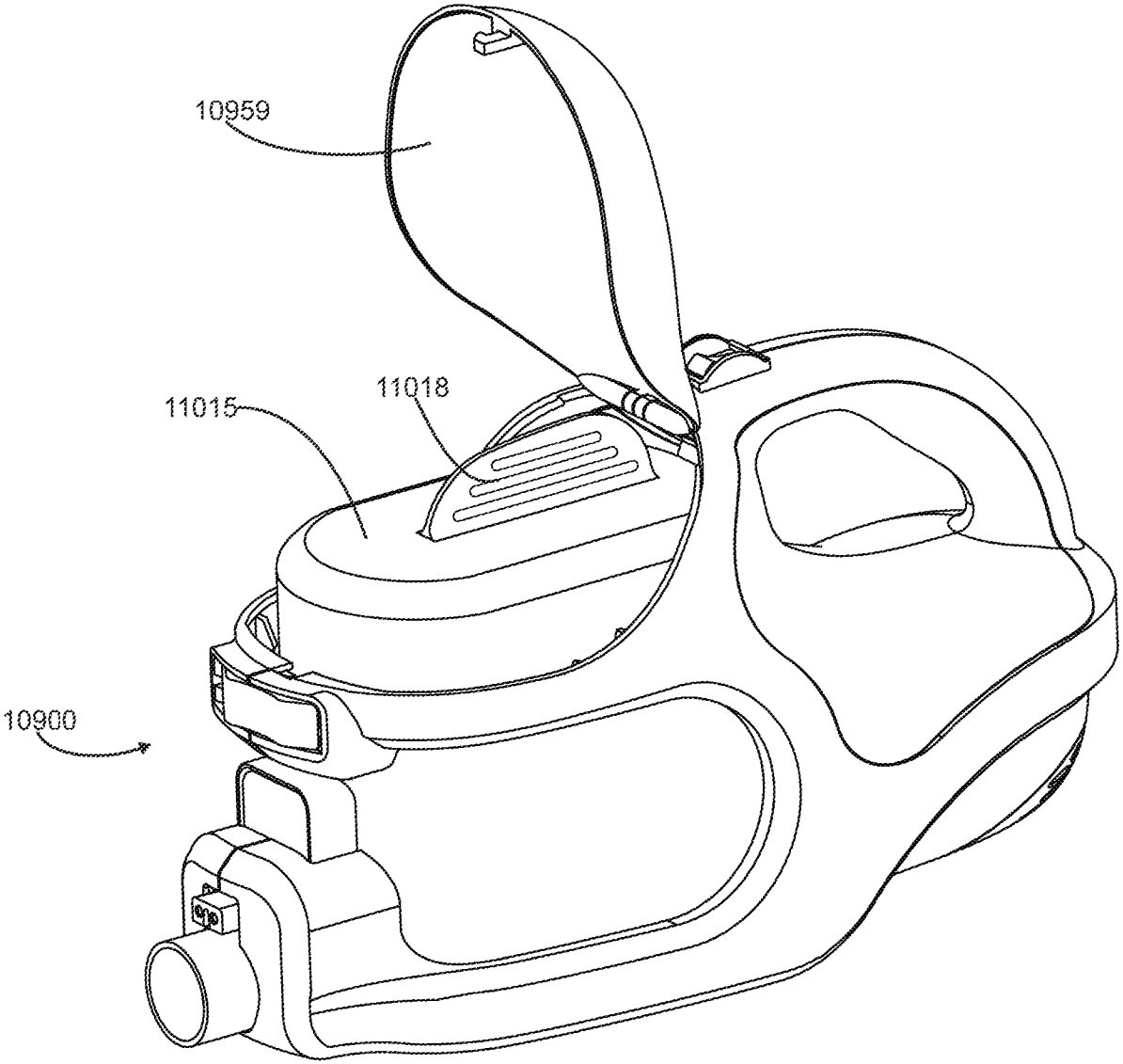
FIG. 28 is a perspective view of the surface cleaning apparatus of FIG. 19 with a cover open.
Figure 29:
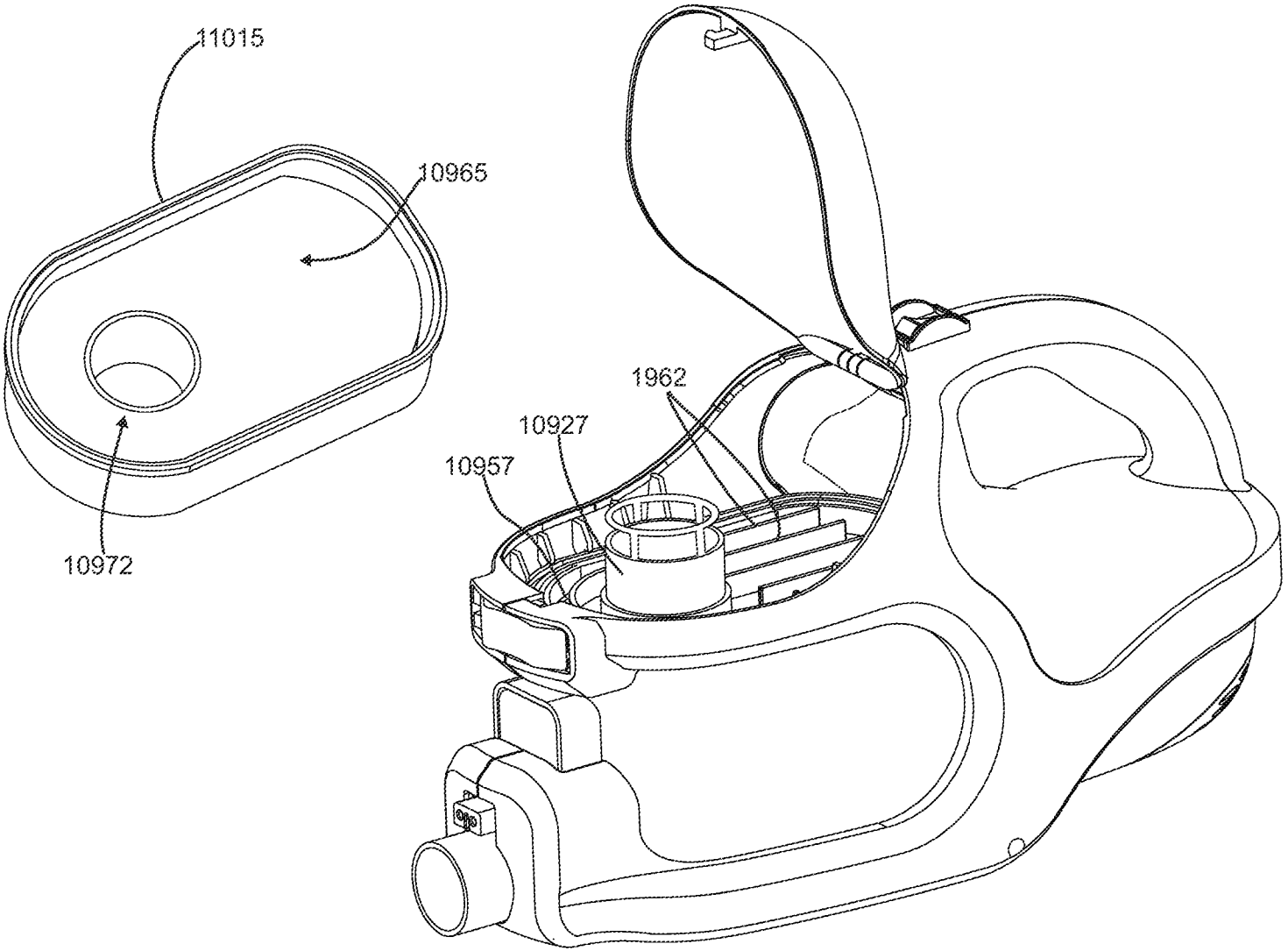
FIG. 29 is the perspective view of FIG. 28 with a filter cartridge removed.
Figure 30:
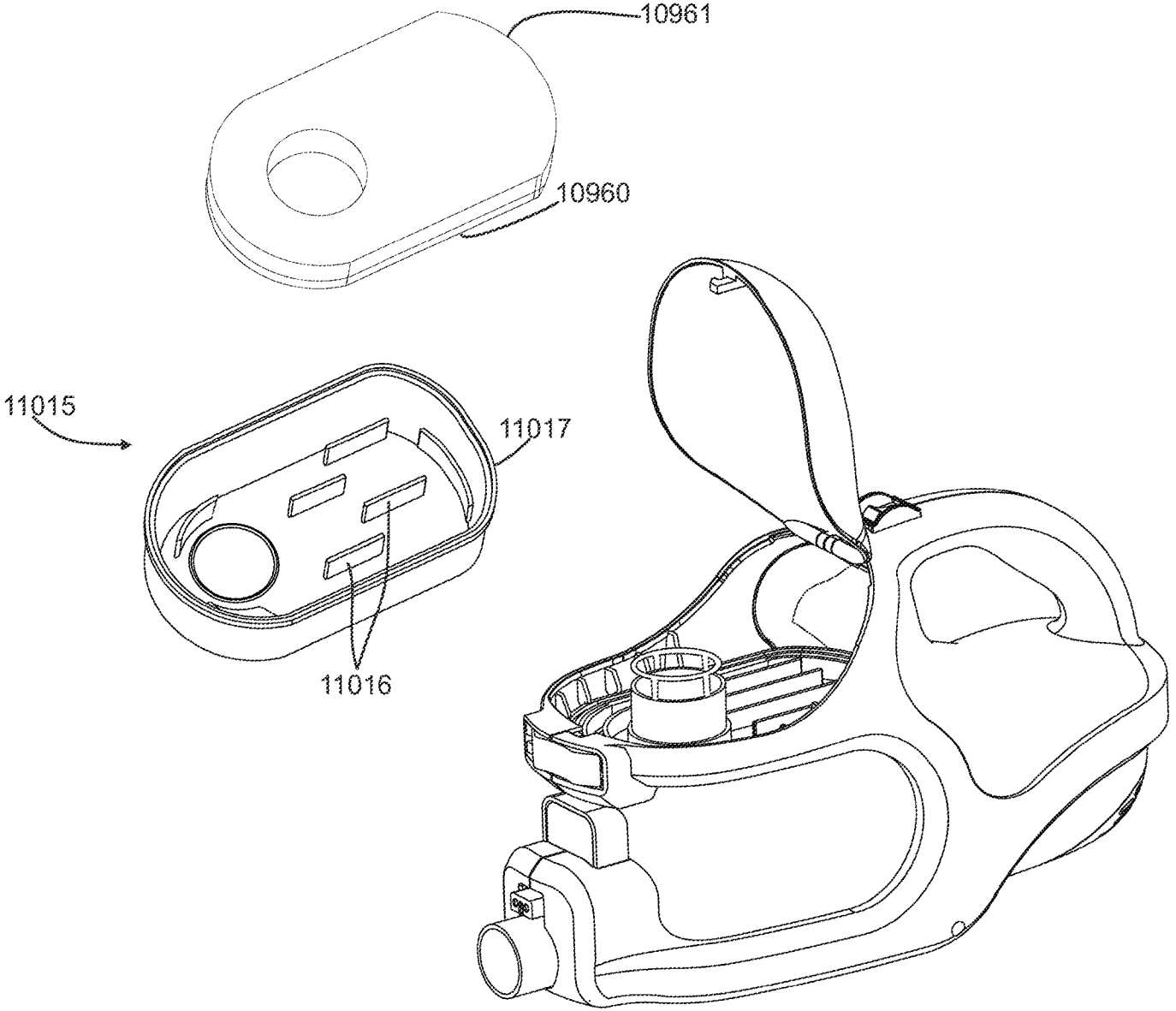
FIG. 30 is the perspective view of FIG. 29 with a filter removed from the filter cartridge.

Referring to FIGS. 27, a filter housing construction that may be used by itself or with any other feature disclosed herein is exemplified. In the illustrated embodiment a pre-motor filter chamber or housing 10956 is provided between the upper walls 10937, 10916 of the cyclone 10913 and dirt collection chambers 10914 and the openable cover 10959. In this configuration, the bottom wall 10957 of the pre-motor filter chamber 10956 is integral with the upper walls 10937, 10916 of the cyclone 10913 and dirt collection chambers 10914, and the upper wall **10958*a* and sidewall 10958 of the pre-motor filter chamber 10956 are provided via a filter cartridge housing 11015 (see also FIG. 28). The filter cartridge housing 11015 is separate from the openable cover 10959. One or more filters may be positioned within the pre-motor filter chamber to filter fine particles from the air stream exiting the air outlet, before it flows into inlet of the suction motor. The filters may be of any suitable configuration and formed from any suitable materials. In the illustrated embodiment, a foam filter 10960 and a felt filter 10961 (FIG. 30) are positioned within the pre-motor filter chamber 10956**.

Referring to FIGS. 27-30, the filter cartridge is a generally dome shaped member that includes a upper wall **10958*a* and a sidewall 10958 extending downwardly from the upper wall to surround the pre-motor filters 10960, 10961. The pre-motor filters 10960, 10961 are shaped to fit within the cartridge member 11015, and when inserted within the cartridge member (FIG. 29) the downstream side 10965 of the felt filter 10961 forms the bottom surface of the filter cartridge 11015. When the filter cartridge 11015 is inserted in its use position (FIG. 28) the downstream side 10965 of the pre-motor filter rests on the support ribs 10962 (see FIG. 29) on the bottom wall 10957, and the downstream headspace 10964 (FIG. 27) is defined between the downstream side 10965 of the filter 10961 and the bottom wall 10957**.

In this embodiment, the upstream headspace 10970 (FIG. 27) is provided between the upstream side 10968 of the pre-motor filter 10960 and the upper wall **10958*a* of the cartridge housing 11015 (instead of being formed by the cover 10959). To provide air into the upstream headspace 1970, the vortex finder 10927 projects upwardly from the bottom wall 10957 and the filters 10960 and 10961 are provided with a corresponding aperture 10972 to receive the vortex finder 10927. Preferably, a plurality of spacing ribs 11016 (FIG. 30) are provided on the inner surface of the upper wall 10958*a* to keep the upstream surface 10968 of the filter 10960 spaced apart from the inner surface of the upper wall 10958*a* to maintain the upstream headspace 10970**.

The lower rim 11017 of the filter cartridge 11015 housing is configured to seal against the bottom wall 10957 (for example via snap fit or by using any type of suitable gasket or sealing member) to provide a generally air tight pre-motor filter chamber 10956. The sealed chamber 10956 is then covered by openable chamber cover 10959. As the filter cartridge housing 11015 provides a sufficiently air tight connection to the bottom wall, the chamber cover 10959 need not be air tight. Preferably, at least a portion of both the chamber cover 10959 and the filter cartridge 11015 housing is transparent so that a user can inspect the upstream side 10968 of the pre-motor filter 10960 without having to remove it from the chamber 10956. Optionally, both the chamber cover 10959 and filter cartridge housing 11015 may be formed from transparent plastic.

When a user wishes to remove, clean, change or otherwise access the pre-motor filter 10960, 10961 he/she may open the chamber cover 10959 (FIG. 30) to expose the filter cartridge housing 11015. The user may then detach the filter cartridge housing 11015 and separate it from the bottom wall 10957. Preferably, the pre-motor filters 10960, 10961 are snugly received within the filter cartridge housing 11015 (or otherwise retained therein) so that the filters 10960, 10961 are removed with the filter cartridge housing 11015 and remain inside the filter cartridge housing 11015 until removed by a user. In this embodiment, the dirty, upstream side 10968 of the filter 10960 remains enclosed by the filter cartridge housing 11015 when separated from the core cleaning unit 11000, and only the relatively clearer downstream side 10965 of the filter 10961 is exposed. This may help prevent dirt on the upstream side 10968 of the filter 10960 from spilling or from otherwise contacting the user. When at a desired location, for example at a trash receptacle or a sink, a user can grasp the clean, downstream side 10965 of the filter and remove it from the filter cartridge housing 11015. The upstream side 10968 of the filter can then be cleaned and inspected as desired.

To assist a user, the upper side 1958*a* of the filter cartridge housing 11015 may be provided with a grip member, for example the flange 11018 in the illustrated embodiment (FIG. 28), which may allow a user to firmly grasp and manipulate the filter cartridge housing 11015. The grip member 11018 may be of any suitable configuration and optionally may be provided on other portions of the filter cartridge housing (for example as a ridge or groove in the sidewall). Alternatively, the filter cartridge housing 11015 need not include a separate grip member. To help reduce the overall size of the surface cleaning apparatus, in the illustrated embodiment the pre-motor filter chamber 10956, and the filters therein, is positioned above the cyclone chamber 10913 and covers the upper end of the cyclone chamber 10913. In this configuration, a plane 10966 (FIG. 26) containing the foam filter 10960 is generally parallel and spaced above a plane 10977 containing the air outlet 10923 of the cyclone chamber 10913, and both planes 10966, 10967 are generally perpendicular to the cyclone axis 10920. Arranging the filters 10960, 10961 in this configuration results in the upstream side of the pre-motor filter (in this example the upper side 10968 of the foam filter 10960) being spaced further apart from the cyclone chamber 10913 than the downstream side of the pre-motor filter (in this example the lower surface 10965 of the felt filter 10961). Alternatively, in other embodiments, the pre-motor filter chamber 10956 may cover only a portion of the upper end of the cyclone chamber and/or may be laterally spaced apart from the cyclone chamber.

When the surface cleaning apparatus is in use, air exiting the cyclone chamber 10913 can flow into the upstream head space 10970 via the vortex finder 10927. Within the upstream headspace 10970 the air can flow laterally across the upstream surface 10968 of the foam filter 10960, and down through the filters into the downstream head space 10964. From the downstream head space 10964, the air can flow to the inlet 10973 of the suction motor via an internal air conduit 10974 (FIG. 26) formed within the body 10901. In the illustrated embodiment, the internal air conduit 10974 is formed within the main body 10901 and is external the cyclone chamber 10913 and the dirt collection chamber 10914 and is partially bounded by an exterior surface exterior surface of the dirt collection chamber sidewall 10915. The air conduit 10974 extends generally vertically between the pre-motor filter chamber 10956 and the suction motor 10911, and is positioned laterally intermediate the suction motor 10911 and the cyclone chamber 10913. The suction motor 10911 is positioned at an elevation where its air inlet 10973 is vertically between the upper and lower ends of the cyclone chamber 10913, and the motor axis passes 10926 through the cyclone chamber 10913 and the dirt collection chamber 10914.

Figure 33:
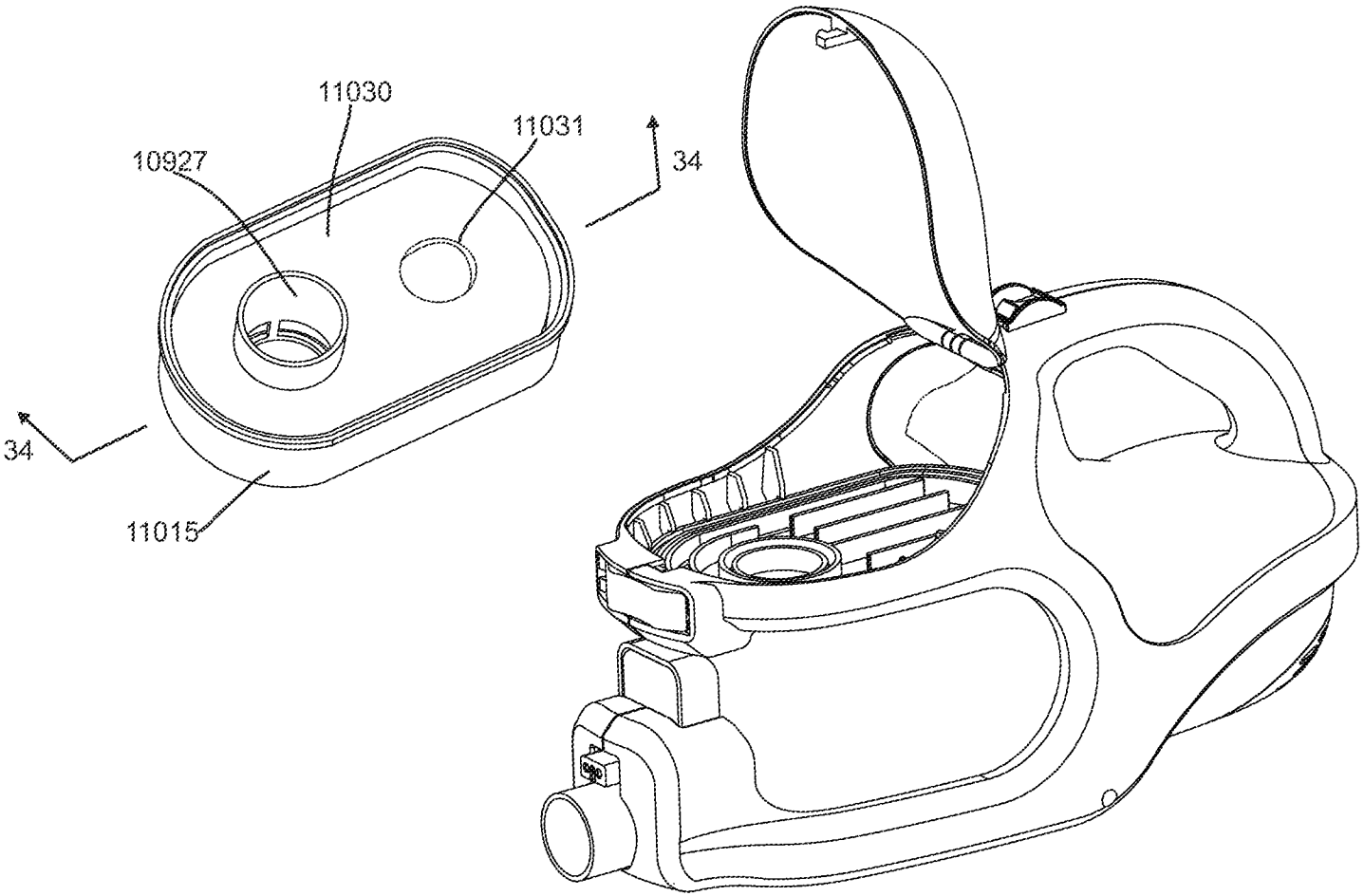
FIG. 33 is the perspective view of FIG. 29 with a different embodiment of a filter cartridge; and, FIG. 34 is a cross sectional view of the filter cartridge taken along line 34-34 in FIG. 33 with the filter cartridge in the surface cleaning apparatus.
Figure 34:
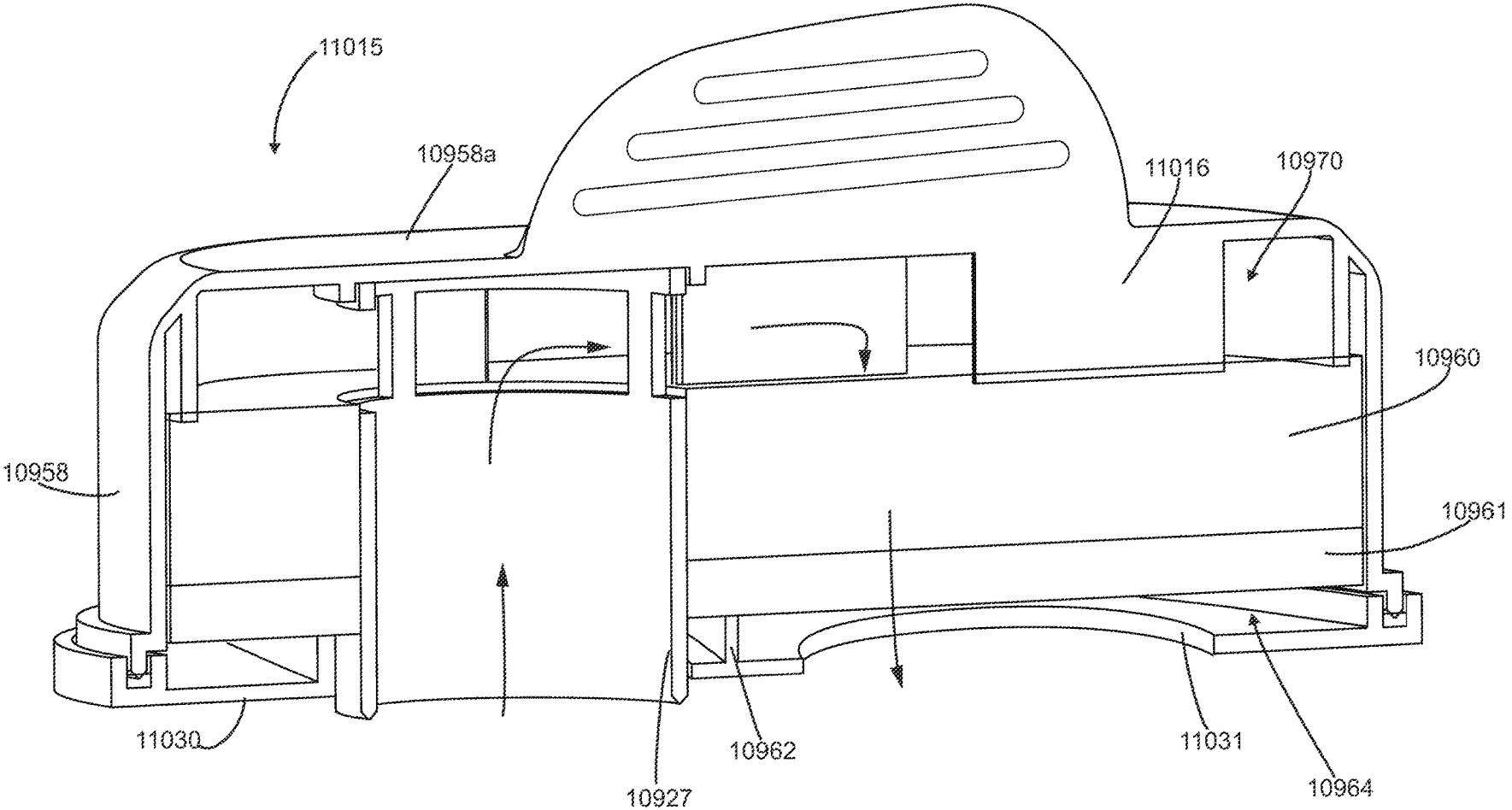

Optionally, the cartridge member 11015 can be provided with a bottom cover 11030 to encase the filters 10960 and 10961 and to provide a self-contained pre-motor filter chamber 10956. Referring to FIGS. 33 and 34, in such a configuration, the bottom cover 11030 may provide the bottom wall 10957 of the pre-motor filter chamber 10956, and may be provided with internal ribs 10962 to support the filters 10960, 10961 and to provide the downstream headspace 10964. An outlet port 11031 provided in the bottom cover 11030 allows air to exit the cartridge enclosure 11015 and flow into conduit 10974. Providing a sealed cartridge may help further contain dirt within the cartridge prior to emptying, and may help keep the filters 10960 and 10961 in position.

Referring to FIG. 20, in the illustrated embodiment, handle 10902 has a first or bottom end 10981 that is adjacent the suction motor housing 10912, a second or upper end 10982 that is spaced above from the lower end 1981 and a grip portion 10980 extending therebetween. When grasping the hand grip portion 10980, a user's fingers may pass through an opening 10984.

Figure 31:
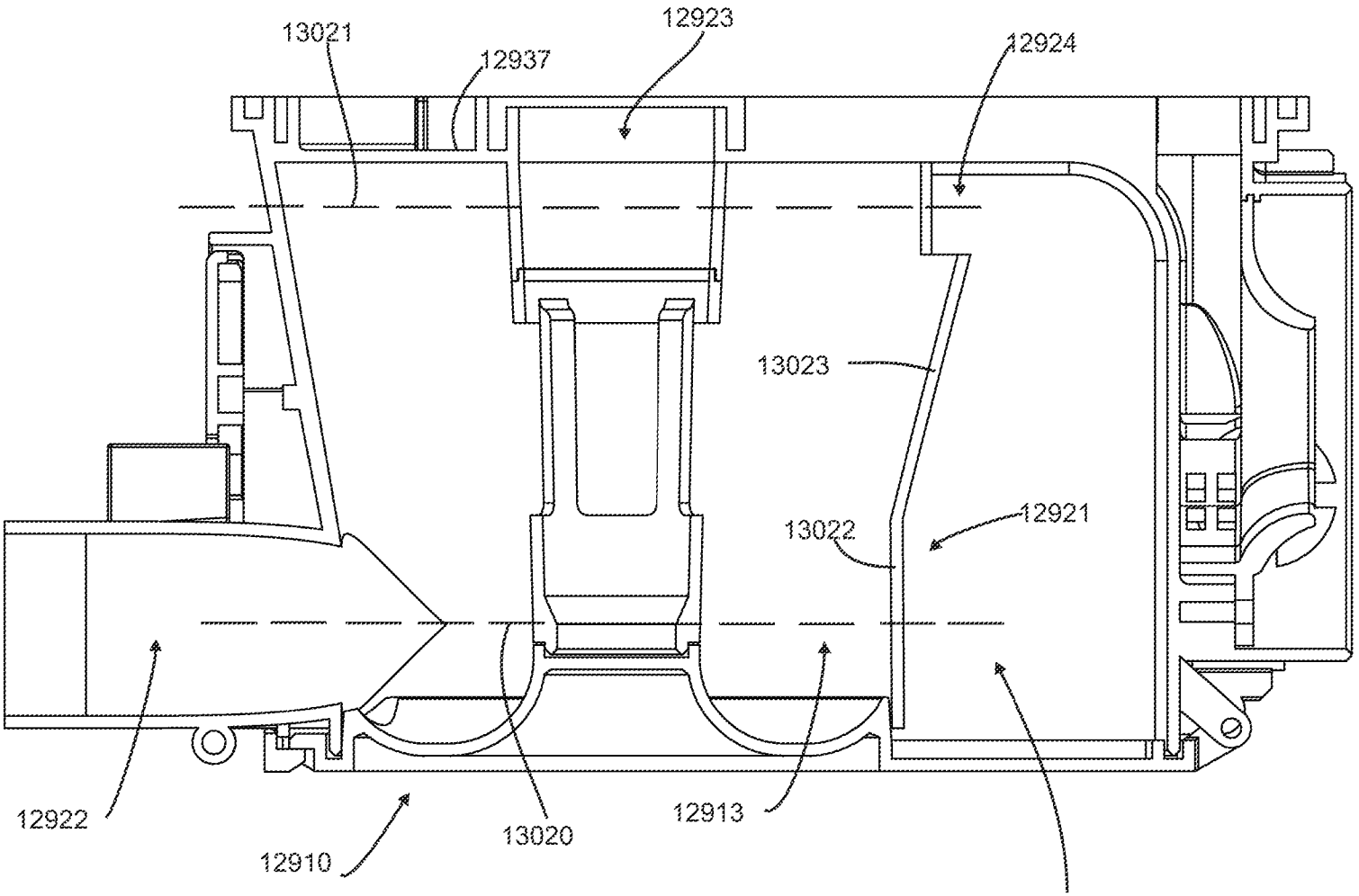
FIG. 31 is a cross sectional view of a portion of another embodiment of a surface cleaning apparatus.

Referring to FIG. 31, a sectional view of an alternate embodiment cyclone bin assembly portion 12910 of a core cleaning unit 13000 that may be used by itself or with any other feature disclosed herein is exemplified. The cyclone bin assembly 12910 is similar to bin assembly 10910, and like features are identified using like reference numerals indexed by 2000. The cyclone bin assembly 12910 is illustrated in isolation with the outer shell, filter cartridge member and the suction motor removed. In this embodiment the cyclone chamber 12913 is flared such that the cross-sectional area taken in a plane 13020 that passes through the air inlet 12922 (toward the bottom of the cyclone chamber 12913) is smaller than the cross-sectional area taken in a plane 13021 that passes through the dirt outlet 12924, and is smaller than the cross-section area of the upper end wall 12937 of the cyclone chamber 12913 (which includes the air outlet 12923). In this configuration, the cyclone chamber sidewall 12921 includes a vertical portion 13022 and a generally frusto-conical portion 13023 positioned above the vertical portion 13022. In this embodiment the volume of the cyclone chamber 12913 increases toward the top to the cyclone chamber, which may help improve cyclone efficiency and/or may help dis-entrained dirt exit via the dirt outlet.

Figure 32:
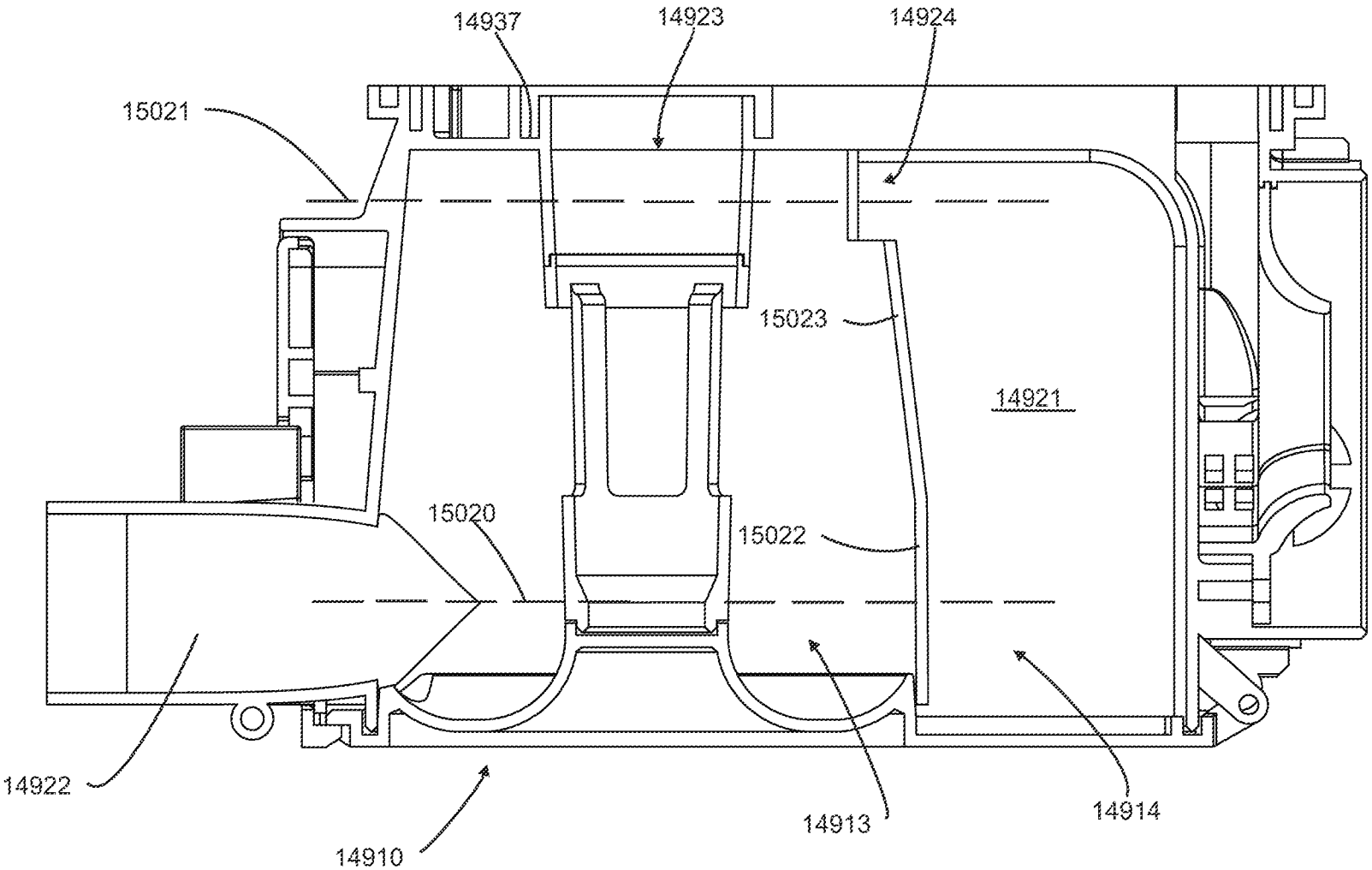
FIG. 32 is a cross sectional view of a portion of another embodiment of a surface cleaning apparatus.

Referring to FIG. 32, a sectional view of an alternate embodiment cyclone bin assembly 14910 portion of the core cleaning unit 15000 that may be used by itself or with any other feature disclosed herein is exemplified. The cyclone bin assembly 14910 is similar to cyclone bin assembly 10910, and like elements are represented using analogous reference numbers indexed by 4000. The cyclone bin assembly 14910 is illustrated in isolation with the outer shell, filter cartridge member and the suction motor removed. In this embodiment the cyclone chamber 14913 is tapered such that the cross-sectional area taken in a plane 15020 that passes through the air inlet 14922 (toward the bottom of the cyclone chamber 14913) is larger than the cross-sectional area taken in a plane 15021 that passes through the dirt outlet 14924, and is larger than the cross-section area of the upper end wall 14937 of the cyclone chamber 14913 (which includes the air outlet 14923). In this configuration, the cyclone chamber sidewall 14921 includes a vertical portion 15022 and a generally inwardly-tapering frusto-conical portion 15023 positioned above the vertical portion. In this embodiment the volume of the cyclone chamber 14913 decreases toward the top to the cyclone chamber, which may help improve cyclone efficiency and/or may help dis-entrained dirt exit via the dirt outlet.

Another Alternate Hand Carriable Surface Cleaning Apparatus

Figure 35:
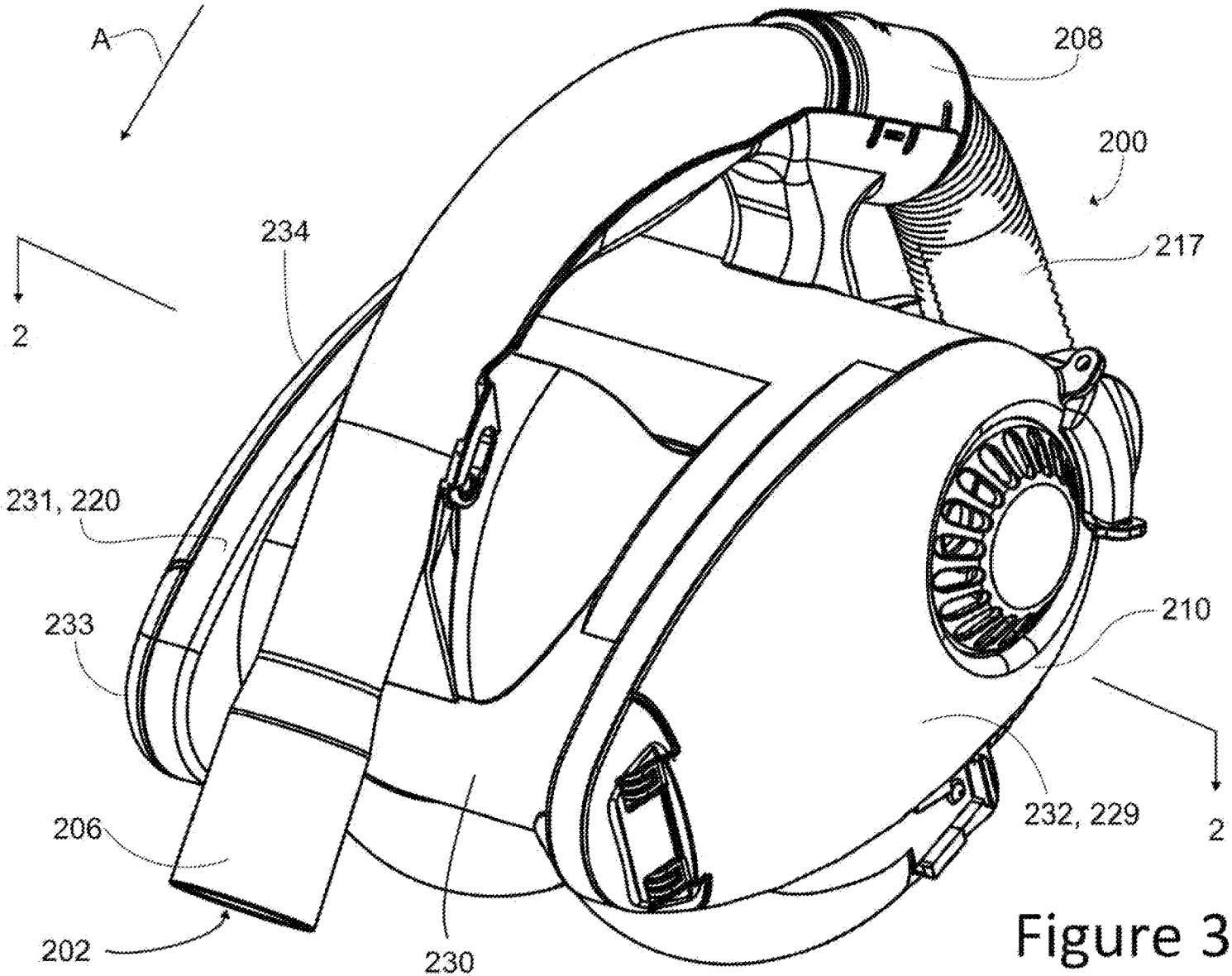
FIG. 35 is a perspective illustration of an embodiment of a surface cleaning apparatus.

Referring to FIG. 35, an embodiment of a surface cleaning apparatus 200 is shown. In this embodiment the surface cleaning apparatus 200 is a hand operable surface cleaning apparatus. The surface cleaning apparatus 200 is usable in a forward direction of motion, indicated by arrow A in FIG. 35.

Figure 36:
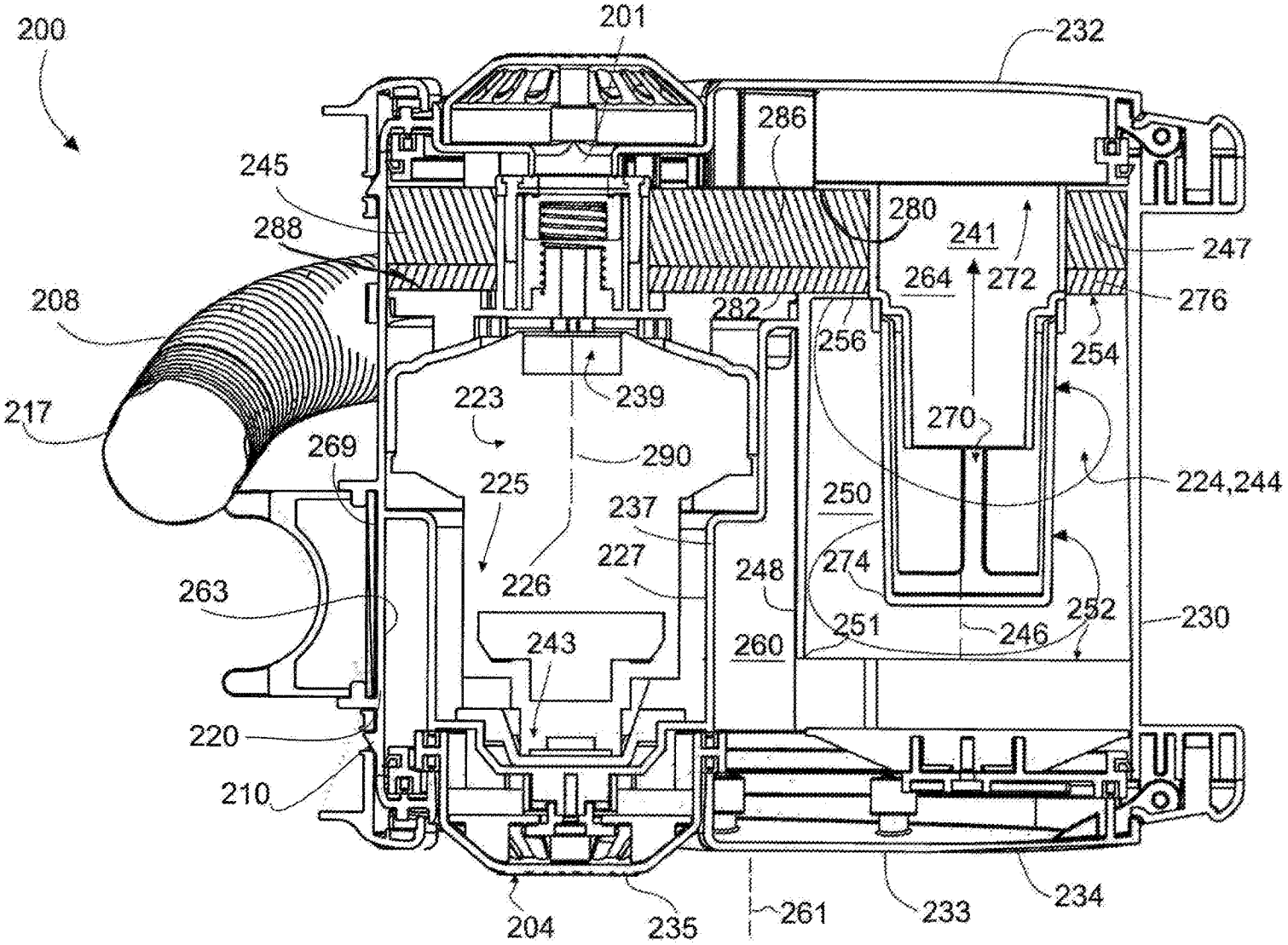
FIG. 36 is a cross section taken along line 2-2 in FIG. 35.

Referring to FIG. 36, the surface cleaning apparatus 200 has a dirty air inlet 202, a clean air outlet 204 (shown in FIG. 36), and an air flow passage extending therebetween. In the embodiment shown, the dirty air inlet 202 is provided in a nozzle 206. From the dirty air inlet 202, the airflow passage extends through the nozzle 206, and through an air conduit 208, to a suction and filtration unit 210. The clean air outlet 204 is provided in the suction and filtration unit 110. In the embodiment shown, the air conduit 108 includes a wand 214, and a hose 217.

Referring now to FIGS. 35 and 36, the suction and filtration unit 210 includes a main housing 220. A filtration member 224 is provided in the main housing 220, and the filtration member 224 is positioned in the airflow passage downstream of the dirty air inlet 202, for removing particulate matter from air flowing through the airflow passage.

A suction motor 226 is also provided in the main housing 220, downstream of the filtration member 224, for drawing air through the airflow passage. The suction motor 226 may be any suitable type of suction motor. In the embodiment shown, the suction motor 226 includes a fan 223, and a motor 225.

In the embodiment shown, the filtration member 224 and suction motor 226 are positioned side-by-side. Further, the filtration member 224 extends along an axis 246, and the suction motor extends along an axis 290, and the axes 246, 290 are generally parallel. Further, the filtration member 224 and suction motor 226 are each positioned transverse to the forward direction of motion (indicated by arrow A in FIG. 34) of the hand surface cleaning apparatus 100.

Referring to FIG. 35, in the embodiment shown, the main housing 220 includes a central wall 230, a first side wall 232, and a second side wall 234. The first side wall 232 is pivotally mounted to the central wall 230, and serves as a first openable door 229. The second sidewall 234 has a first portion 233 adjacent the filtration member 224, and a second portion 235 adjacent the suction motor 226. The second sidewall 234 is pivotally mounted to the central wall 230, and serves as a second openable door 231. Further, the second portion 235 is removable from the first portion 233.

Referring to FIG. 36, an interior wall 237 extends within the main housing 220 to separate the suction motor 226 from the filtration member 224, so that fluid communication between the filtration member 224 and the suction motor 226 may generally only occur between a filtration member air outlet 264, and a suction motor air inlet end 239, as will be described in further detail hereinbelow. The interior wall 237 generally surrounds the suction motor 226 to form a motor housing 227, and is integral with the central wall 230, so that a portion 269 of the motor housing 227 forms part of the housing 220.

Referring to FIG. 36, in the embodiment shown, the filtration member 224 is a cyclone 244. In alternate embodiments, the filtration member 224 may be, for example, a filter, such as a filter bag or a foam filter. In further alternate embodiments, the filtration member 224 may include a plurality of cyclone chambers, or a plurality of cyclonic stages.

The cyclone 244 may be of any suitable configuration. The cyclone 244 includes a cyclone wall 248 (also referred to as an outer wall 248), which is integral with the central wall 230, and together with the central wall 230 defines a cyclone chamber 250. That is, a portion of the cyclone wall 248 forms part of the housing 220. A first end 251 of the cyclone wall 148, which is positioned towards the second sidewall 234, defines an opening 252, and an opposed second end 254 of the cyclone wall includes a second end wall 256. The cyclone wall 248 is positioned in the main housing 220 such that it is spaced from the second sidewall 234.

The open first end 252 of the cyclone serves as a dirt outlet for the cyclone 244. Material that is separated form air in the cyclone travels from the dirt outlet to an associated dirt collection chamber 260. Together, the cyclone 244 and dirt collection chamber 260 may be referred to as a cyclone bin assembly 262.

Figure 37:
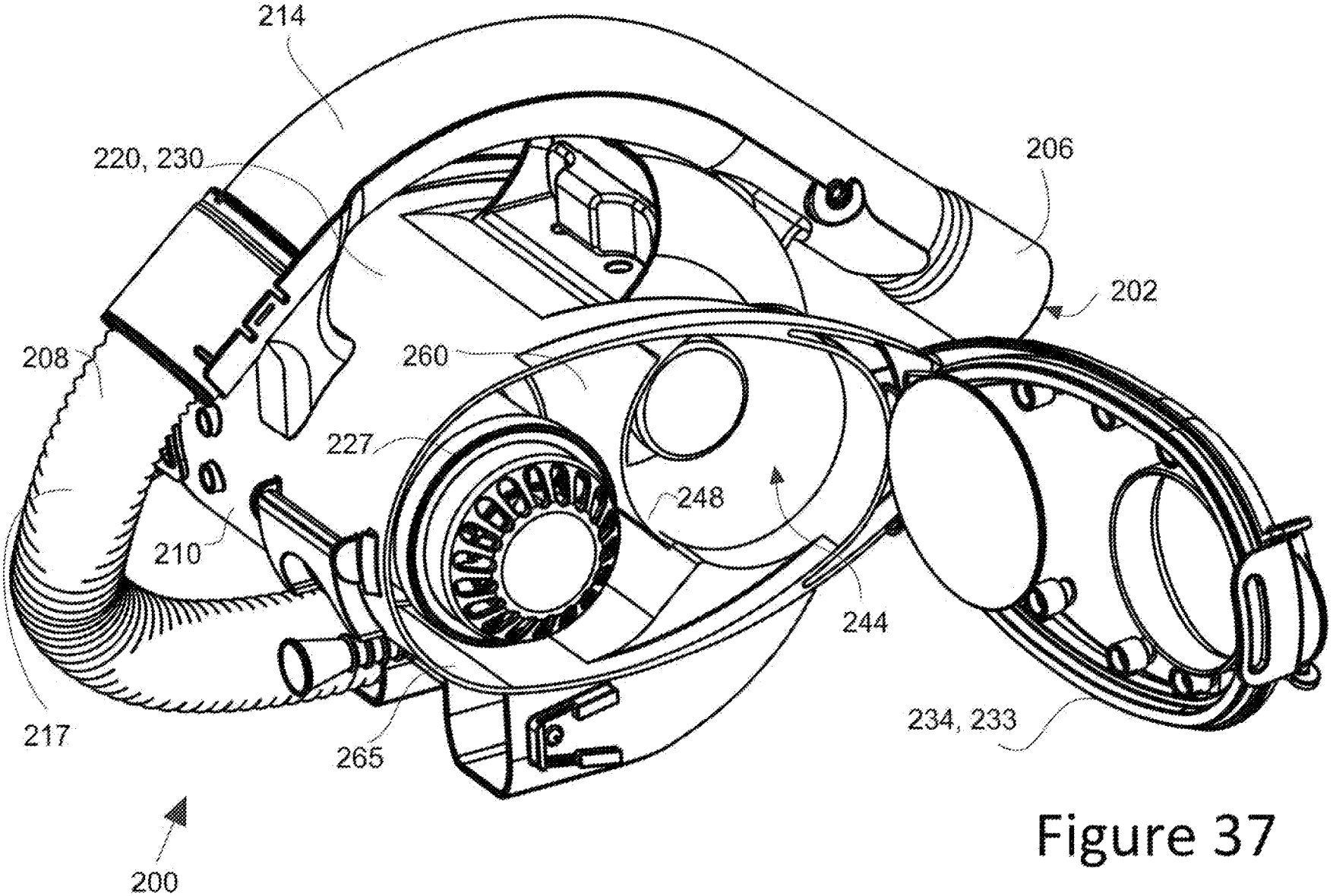
FIG. 37 is a perspective illustration of the surface cleaning apparatus of FIG. 34, showing a second openable door in an open configuration.

Referring to FIGS. 36 and 37, at least a portion of the dirt chamber 260 is preferably positioned in an open volume within the main housing 220. In the embodiment shown, the entire dirt chamber 260 is within an open volume within the main housing 220. The dirt collection chamber 260 is preferably within the main housing 220, exterior to the cyclone 244 and the suction motor 226. The dirt collection chamber extends along a longitudinal axis 261. The longitudinal axis 261 is preferably parallel to the suction motor axis 290.

Referring to FIGS. 36 and 37, at least a portion of the dirt collection chamber 260 is preferably positioned between the cyclone 244 and the suction motor 226. More preferably, at least a portion of the dirt collection chamber 260 surrounds at least a portion of the suction motor 226 and the suction motor housing 227. For example, the dirt collection chamber 260 may surround all of the suction motor 226, or only a portion of the suction motor 226, and/or all of the suction motor housing 227, or only a portion of the suction motor housing 227. As seen most clearly in FIG. 36, in the embodiment shown, the dirt collection chamber 260 fully surround the motor 225 of suction motor 226 and the portion suction motor housing 227 that houses the motor 225.

The dirt collection chamber 260 further preferably surrounds at least a portion of the cyclone. For example, in the embodiment shown, dirt collection chamber 260 extends around approximately one quarter of the cyclone 244. In alternate embodiments, the dirt collection chamber 260 may fully surround the cyclone 244.

Figure 38:
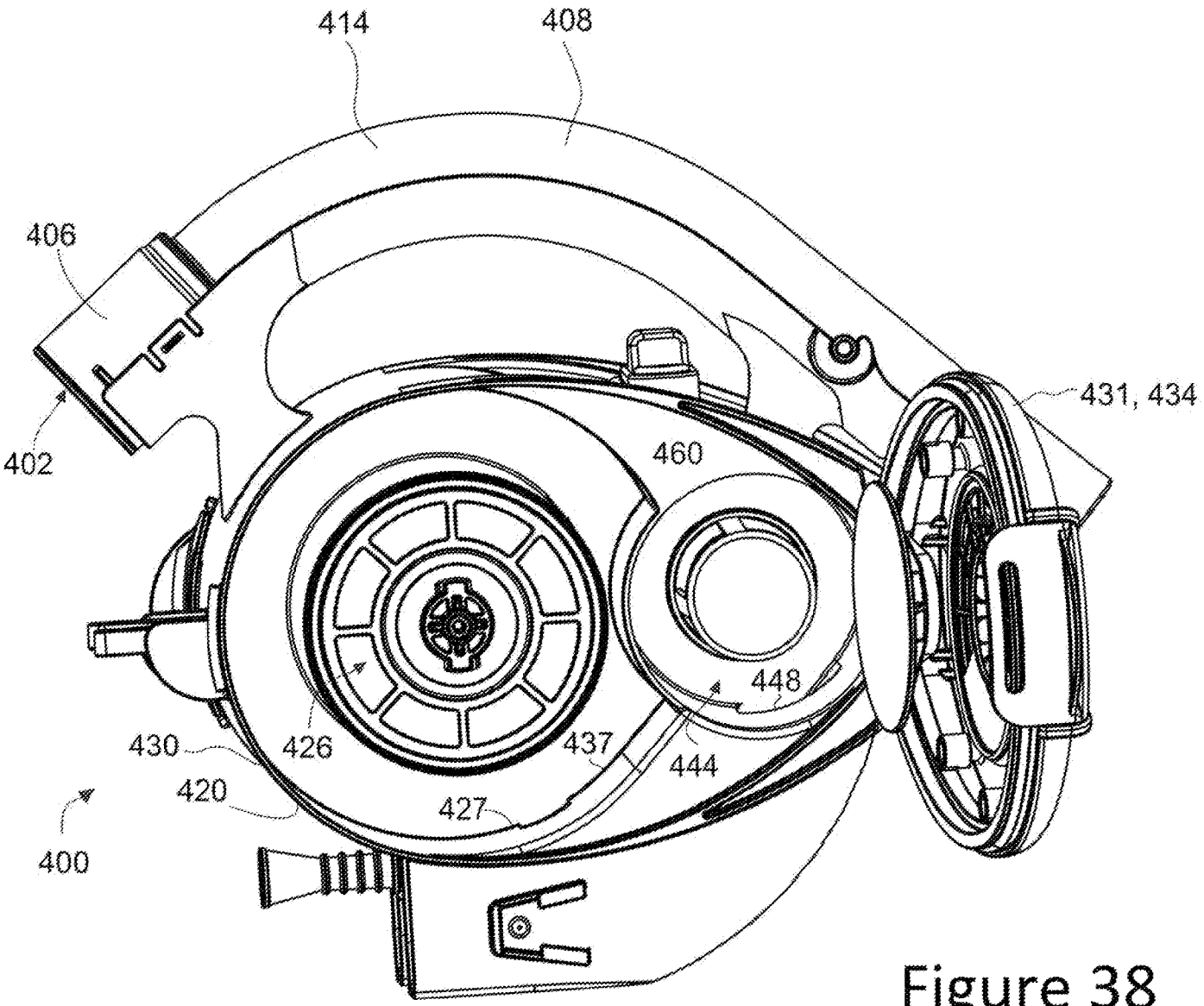
FIG. 38 is a plan view of an alternate embodiment of a surface cleaning apparatus, showing a second openable door in an open configuration.
Figure 38B:
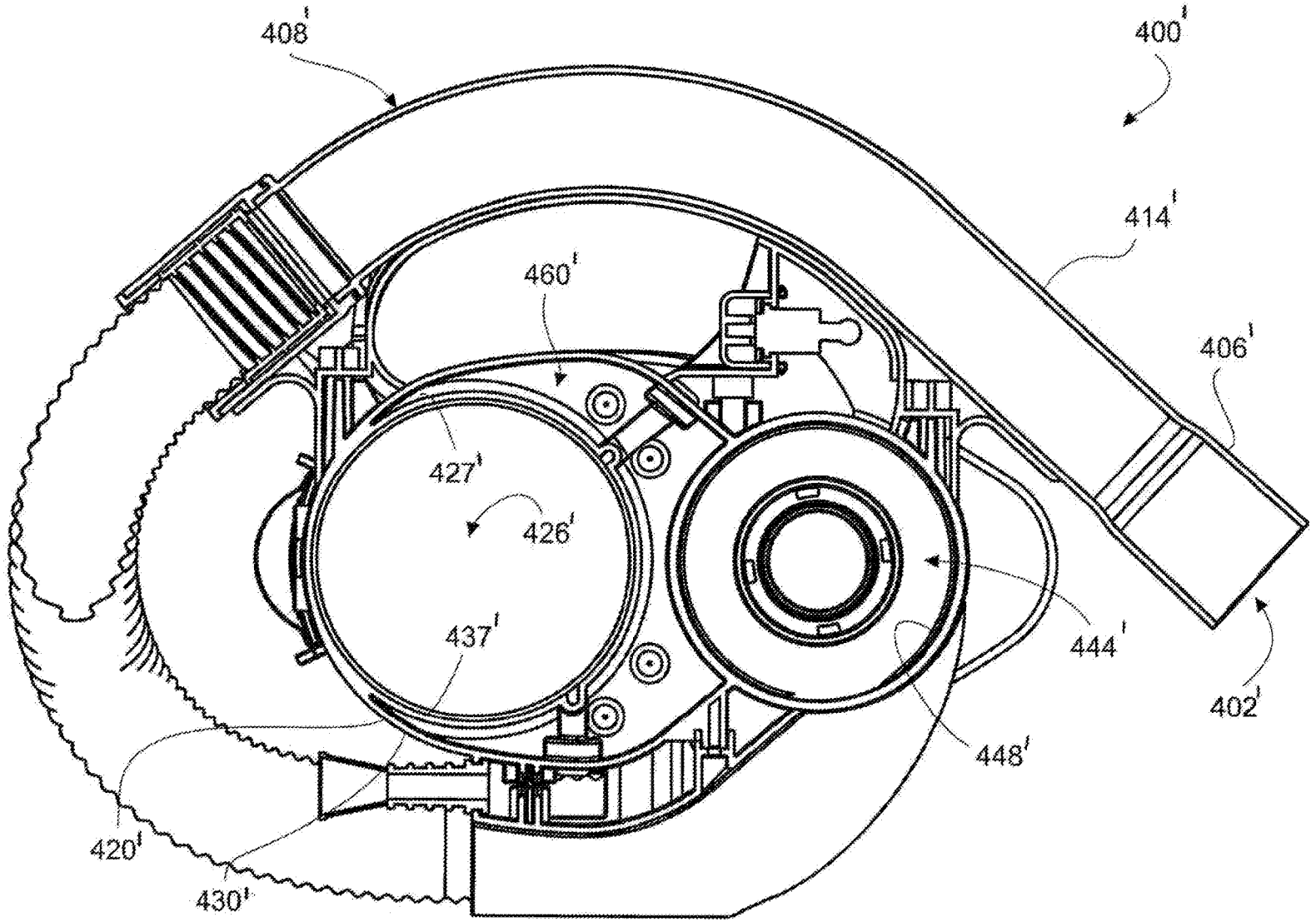
FIG. 38B is a plan view of another alternate embodiment of a surface cleaning apparatus, showing a second openable door in an open configuration.

In an alternate embodiment of a surface cleaning apparatus 400 shown in FIG. 38, wherein like reference numerals are used to refer to like features as in FIGS. 35 to 37, with the first digit incremented to 4, the dirt collection chamber 460 partially surrounds the motor 425 of suction motor 426 and the portion suction motor housing 427 that houses the motor 425. Further, the dirt collection chamber 460 partially surrounds the cyclone 444. Particularly, the dirt collection chamber 460 surrounds approximately three quarters of the cyclone 444. In another alternate embodiment of a surface cleaning apparatus 400' shown in FIG. 39, wherein like reference numerals are used to refer to like features as in FIG. 38, with a prime (') after the reference number, similarly to the embodiment of FIG. 38, the dirt collection chamber 460' partially surrounds the motor 425' of suction motor 426' and the portion suction motor housing 427' that houses the motor 425'. Further, the dirt collection chamber 460' partially surrounds the cyclone 444'. Particularly, the dirt collection chamber 460' surrounds approximately one quarter of the cyclone 444'.

Referring to FIG. 36, the dirt collection chamber 260 has an outer wall 263, and a portion 265 of the outer wall 263 preferably forms part of the main housing 220.

The cyclone 244 further includes a cyclone air inlet (not shown), and a cyclone air outlet 264. The cyclone air inlet extends from a first end that is in communication with the hose 217 through the central wall 230 of the filtration member main housing 220, to a second end that is in communication with the cyclone chamber 250. The cyclone air outlet 264 extends along the axis 246, from a first end 270 that is positioned within the cyclone chamber 250, through the lower wall 256, and to a second end 272 (also referred to herein as an outlet 272 of the cyclone air outlet 264) that is in communication with a chamber 241 adjacent the first sidewall 232 of the suction and filtration unit 210. A screen 274 is preferably mounted over the first end 270 of the cyclone air outlet.

In use, air flows from the hose 217 into the cyclone chamber 250 through the cyclone air inlet. In the cyclone chamber 250, the air flows within the cyclone wall 248 in a cyclonic pattern, and particulate matter is separated from the air. The particulate matter exits the cyclone chamber 250 through the open first end 252, and settles in the dirt collection chamber 260. The air exits the cyclone chamber 250 through the cyclone air outlet 264, and enters the chamber 241.

Figure 37A:
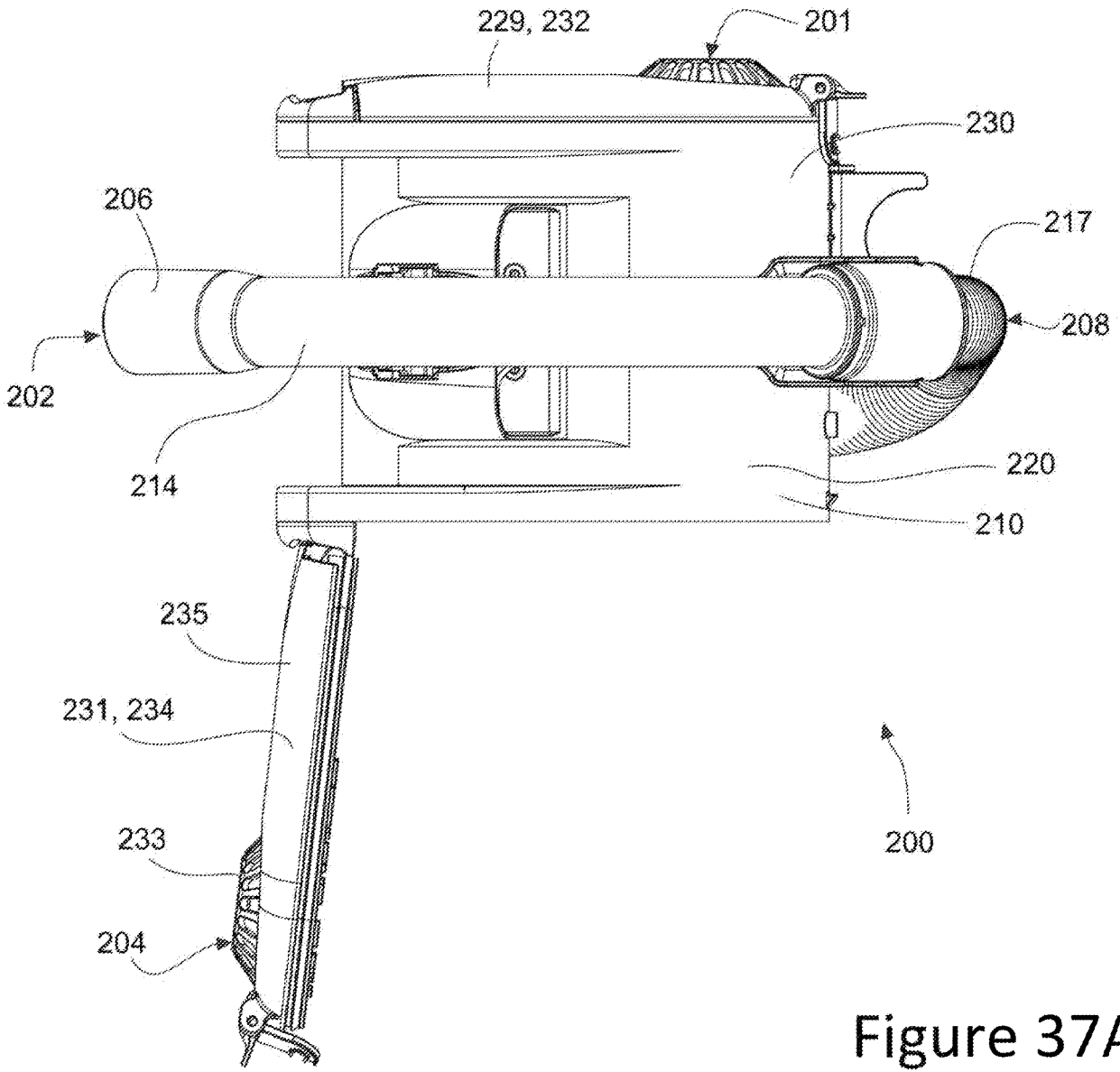
FIG. 37A is a side plan view of the surface cleaning apparatus of FIG. 34, showing a second openable door in an open configuration.

The dirt collection chamber 260 may be emptied in any suitable manner. Referring to FIG. 37A, in the embodiment shown, the second side wall 234 is pivotally openable, so that the dirt collection chamber 260 may be opened.

Referring still to FIG. 36, the surface cleaning apparatus includes a pre-motor filter 276 positioned downstream of the cyclone 244 and upstream of the suction motor 226. The pre-motor filter 276 is preferably housed in the chamber 241, is snugly received within the central wall 230, overlies the suction motor 226 and the cyclone 244, and spaced from the first openable door 229. In the embodiment shown, the pre-motor filter 276 overlies the all of the suction motor 226 and the cyclone 244. In alternate embodiments, the pre-motor filter may overlie only a portion of the suction motor 226 and the cyclone 244. Preferably, the pre-motor filter 276 overlies at least half of the suction motor 226 and the cyclone chamber 250, and more preferably, at least 75% of the suction motor 226 and the cyclone chamber 250. More preferably, the pre-motor filter 276 overlies at least half of the suction motor 226 and the cyclone 244, and more preferably, at least 75% of the suction motor 226 and the cyclone 244. Most preferably, as shown, the pre-motor filter has a portion 245 that is centered over the suction motor 226 and a portion 247 that overlies at least half of the cyclone 244. In the embodiment shown, the portion 247 overlies all of the cyclone 244.

The pre-motor filter has an upstream side 280 that faces the first sidewall 232 of the main housing 220, and an opposed downstream side 282 that faces the second sidewall 234 of the main housing 220. The pre-motor filter 276 may be any suitable type of filter. Preferably, the pre-motor filter includes a foam layer 286 and a felt layer 288.

Referring still to FIG. 36, the cyclone air outlet 264 extends through the pre-motor filter 276, so that air exiting the cyclone 244 is in contact with the upstream side 280 of the pre-motor filter 286.

The air then passes through the pre-motor filter 276, towards a suction motor inlet end 239 that faces the downstream side 282 of the pre-motor filter 276. From the suction motor inlet 239, the air passes towards a suction motor outlet end 243, and out of the clean air outlet 204.

Figure 37B:
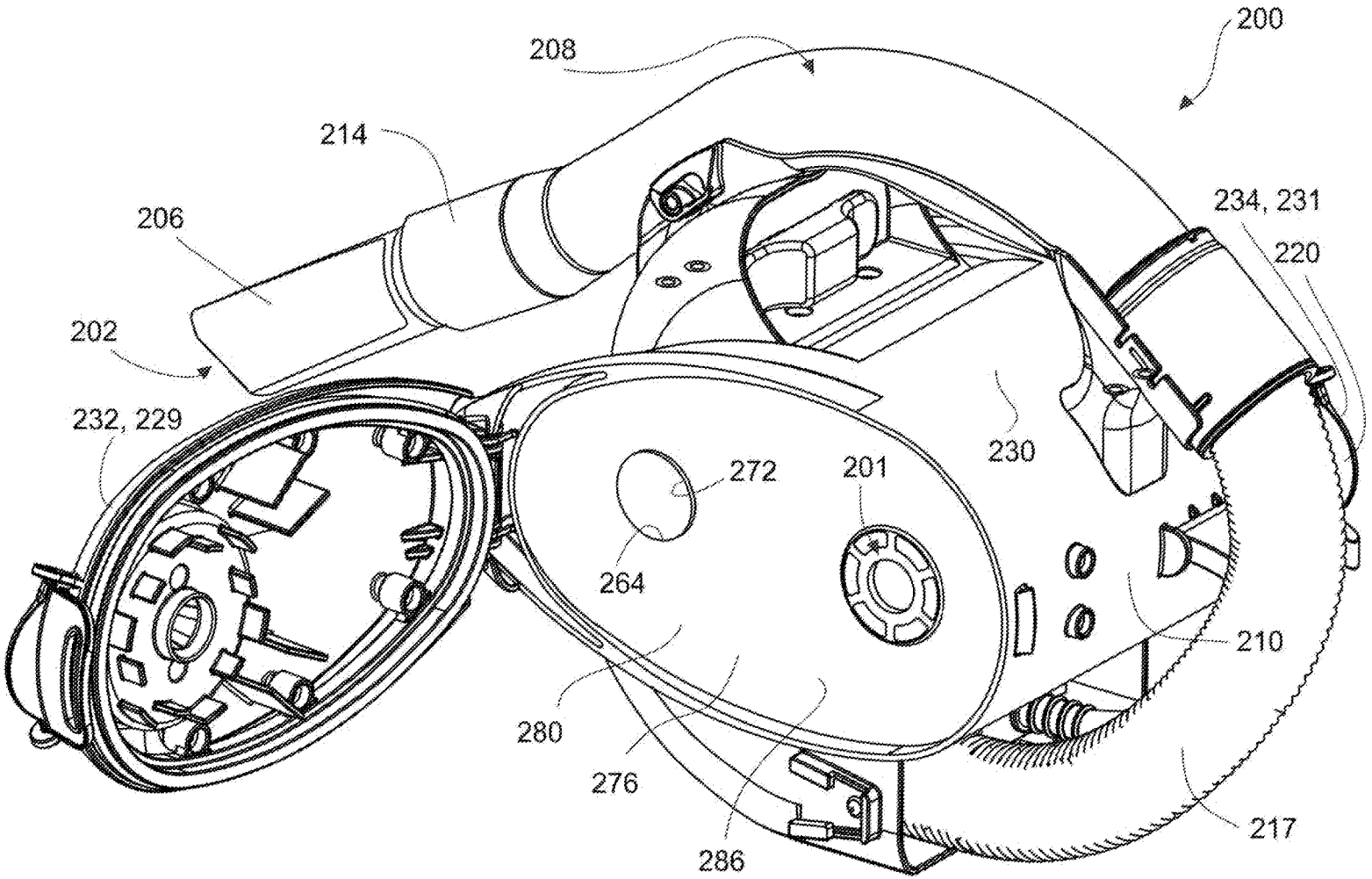
FIG. 37B is a perspective illustration of the surface cleaning apparatus of FIG. 35 showing a first openable door in an open configuration.

Preferably, as shown in FIG. 37B, when the first openable door 229 is open, the upstream side 280 of the pre-motor 276 is visible. By opening the openable door 229, the pre-motor filter may optionally be removed, replaced, or cleaned. Further, the pre-motor filter 276 is preferably mounted to at least one of the cyclone 244 and the suction motor 226, and the pre-motor filter 276 remains in position when the first openable door 229 is opened. For example, as shown, the pre-motor filter 276 is frictionally mounted to the cyclone air outlet 264.

Referring still to FIG. 36, the surface cleaning apparatus further includes a bleed valve 201. The bleed valve 201 allows air to flow from the suction motor inlet 239 to the clean air outlet 204 so that the suction motor 226 does not burn out if a clog occurs.

Figure 39:
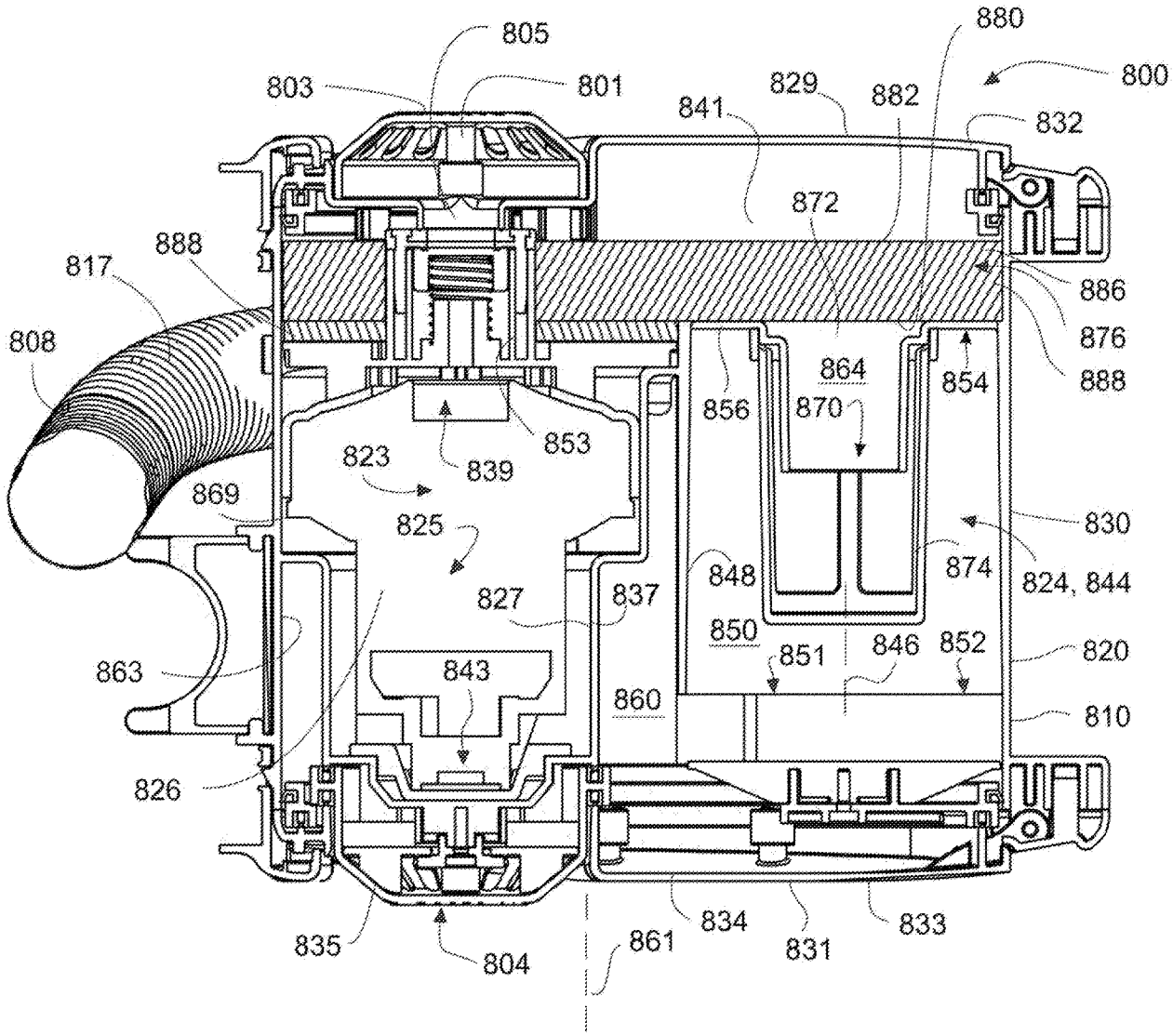
FIG. 39 is a cross section taken along the same line 2-2 through an alternate embodiment of a surface cleaning apparatus.

Referring to FIGS. 38 and 39, a further alternate surface cleaning apparatus 400 is shown. The surface cleaning apparatus is similar to the surface cleaning apparatus 200, and like numerals in the surface cleaning apparatus 800 will be used to describe like features as in the surface cleaning apparatus 200, with the first digit incremented to 8.

In the surface cleaning apparatus 800, the cyclone air outlet 864 does not extend through the pre-motor filter 876. The upstream side 880 of the pre-motor filter 876 faces towards the second sidewall 834 of the housing 820 and faces the cyclone air outlet 864, and the downstream side 882 of the pre-motor filter 876 faces the first sidewall 834. Air passes out of the second end 872 of the cyclone air outlet 864, through the pre-motor filter, and into the chamber 841.

The suction motor 826 has a suction motor inlet duct 853 that extends through the pre-motor filter 876 to the downstream side 882 of the pre-motor filter 876.

In this embodiment, the bleed valve 801 is provided in the openable door, and has an air outlet 805 that is within the chamber 841, so that it is in communication with the suction motor air inlet end 839.

When the openable door is open, the suction motor inlet 839 is visible, and the downstream side 882 of the pre-motor filter 876 is visible.

Figure 40A:
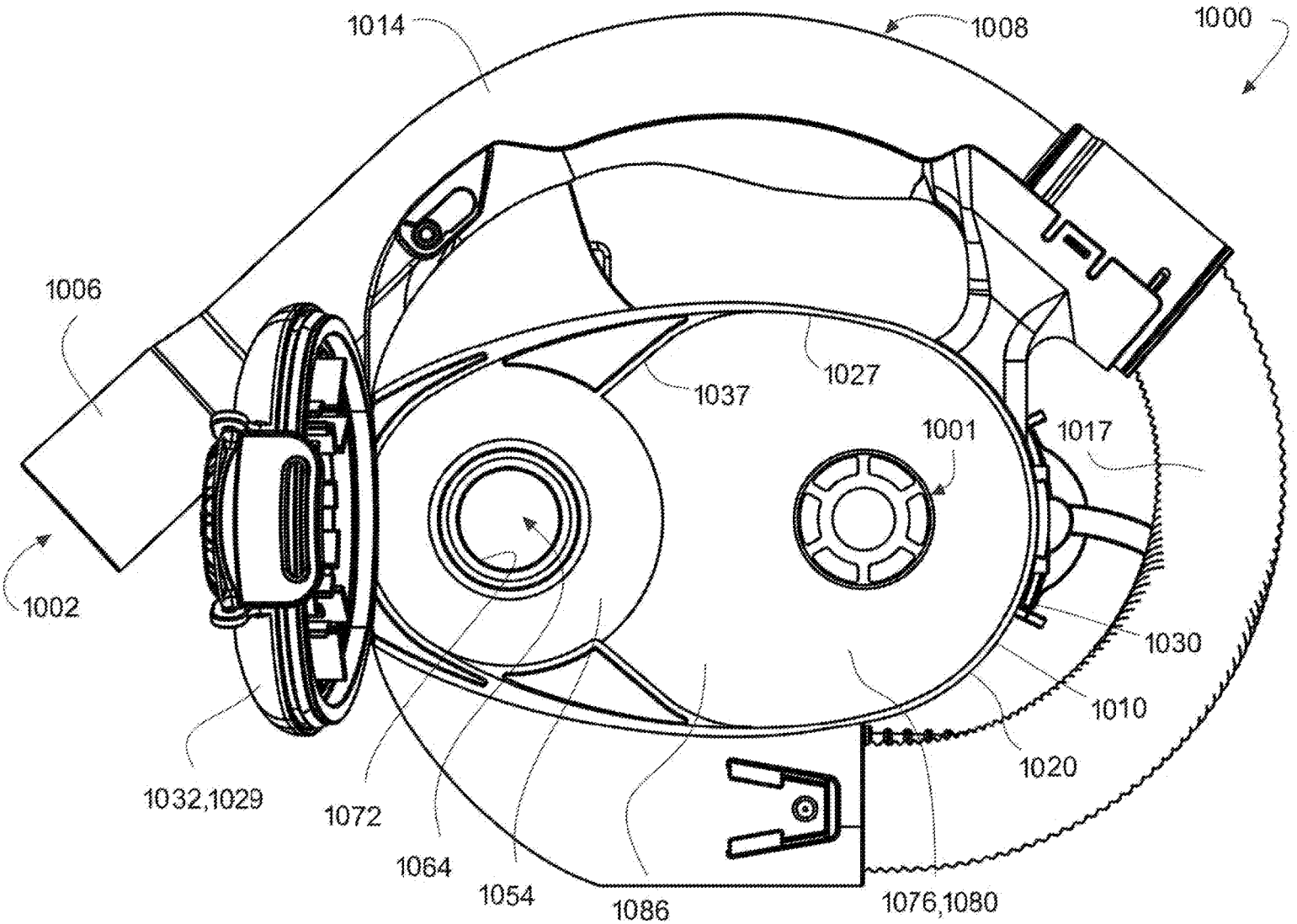
FIG. 40A is a plan view of an alternate embodiment of a surface cleaning apparatus, showing a first openable door in an open configuration.
Figure 40B:
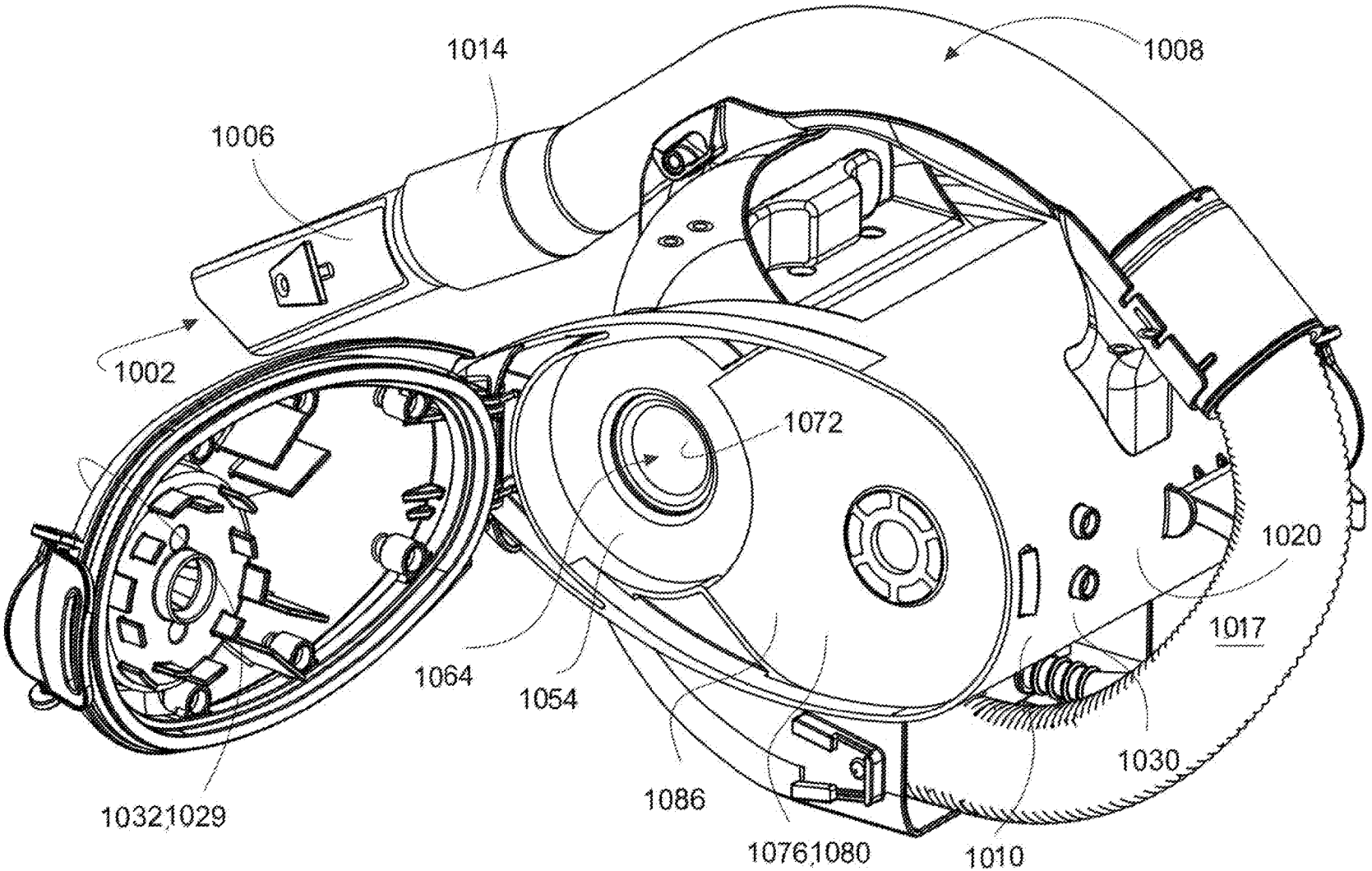
FIG. 40B is a perspective illustration of the surface cleaning apparatus of FIG. 40A.

Referring to FIGS. 40A and 40B, a further alternate surface cleaning apparatus 1000 is shown. The surface cleaning apparatus is similar to the surface cleaning apparatus 200, and like numerals in the surface cleaning apparatus 1000 will be used to describe like features as in the surface cleaning apparatus 200, with the first digit incremented to 9.

In the surface cleaning apparatus 1000, the pre motor filter 1076 overlies only the motor (not shown) and the motor housing 1027, and does not overlie the cyclone 1044. The cyclone outlet 1064 is in communication with the upstream side 1080 of the pre motor filter 1076, which faces towards the first side 1032 of the housing 1020. The downstream side of the pre motor filter 1076 faces the motor inlet end (not shown) and the second side 1034 of the housing 1020. A bleed valve 1001 extends through the pre motor filter 1076.

Another Alternate Hand Carriable Surface Cleaning Apparatus

Referring to FIGS. 41-44, a further alternate surface cleaning apparatus 1100 is shown. In the embodiment illustrated, the surface cleaning apparatus 1100 is a hand operable surface cleaning apparatus. In alternate embodiments, the surface cleaning apparatus may be another suitable type of surface cleaning apparatus, including, for example, an upright vacuum cleaner, a canister vacuum cleaner, a stick vacuum cleaner, a wet-dry vacuum cleaner and a carpet extractor.

Figure 44:
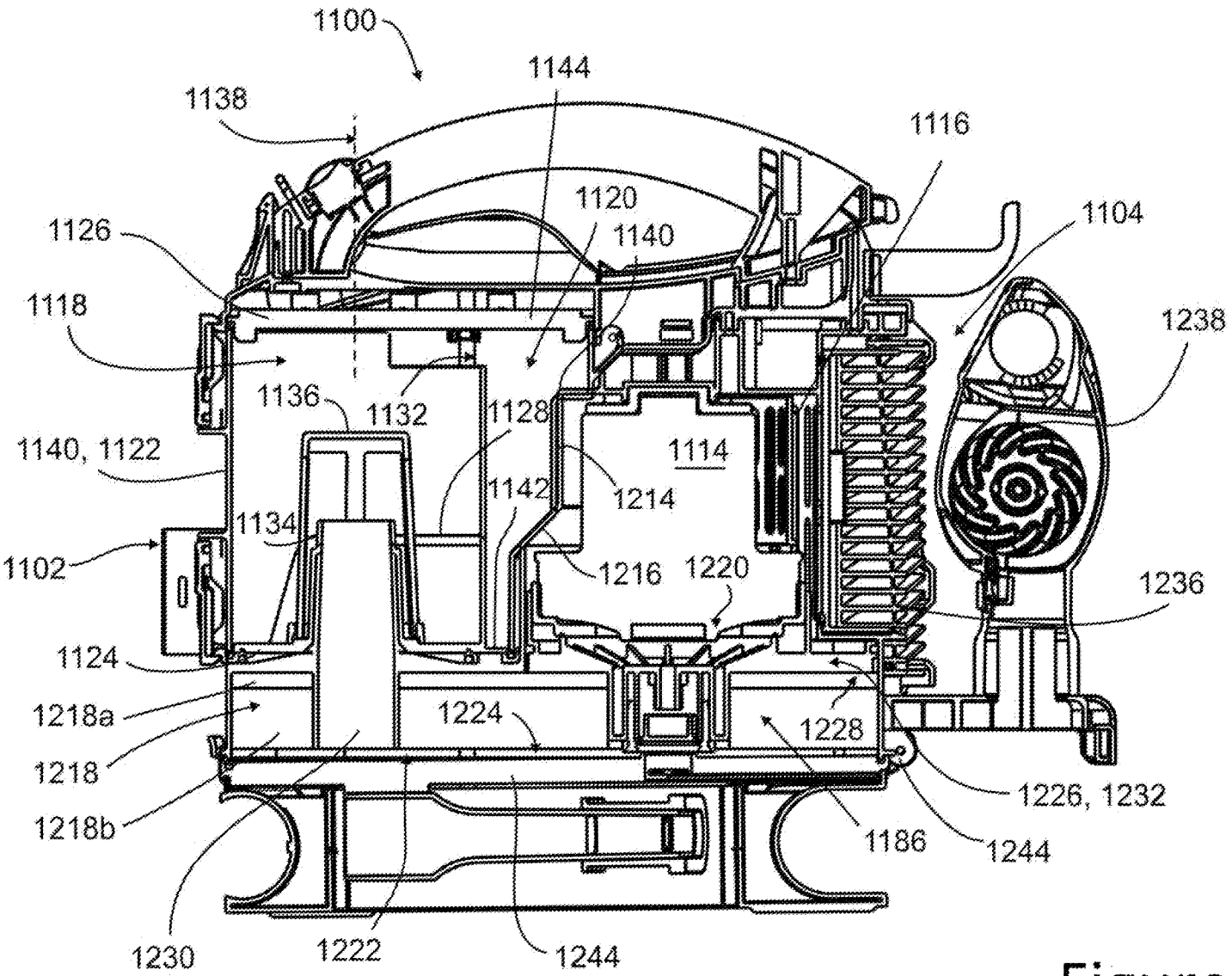
FIG. 44 is a section view taken along line 10-10 in FIG. 41.
Figure 45:
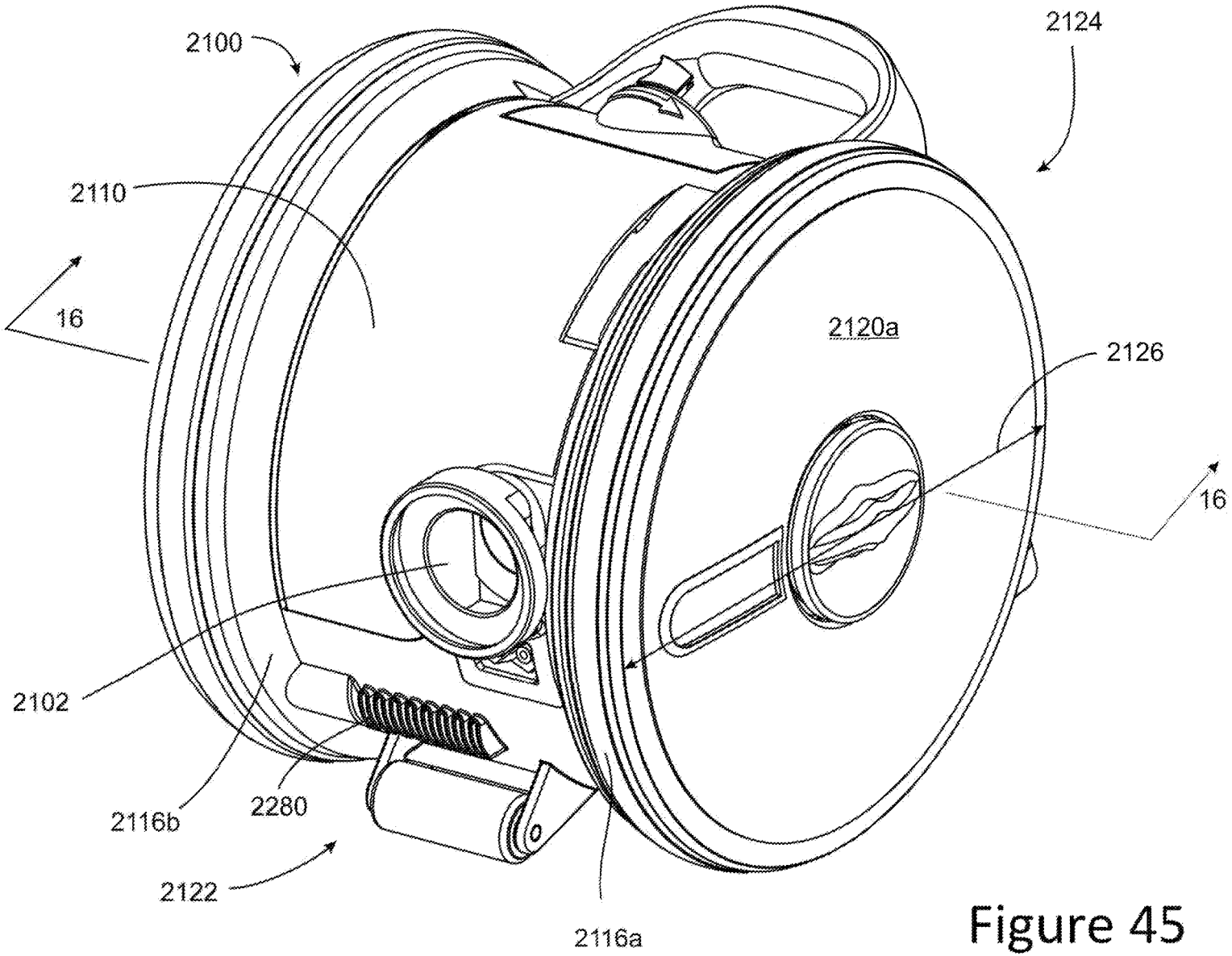
FIG. 45 is a perspective illustration of an alternate embodiment of a surface cleaning apparatus.

Referring to FIG. 44, the surface cleaning apparatus 1100 has a dirty air inlet 1102, a clean air outlet 1104 and an airflow passage extending therebetween. In the embodiment shown, the dirty air inlet 1102 is the air inlet 1106 of a suction hose connector 1108 that can be connected to the downstream end of, e.g., a flexible suction hose or other type of cleaning accessory tool, including, for example, a wand and a nozzle. From the dirty air inlet 1102, the airflow passage extends through an air treatment member that can treat the air in a desired manner, including for example removing dirt particles and debris from the air. In the illustrated example, the air treatment member comprises a cyclone bin assembly 1110. The cyclone bin assembly 1110 is mounted on a body 1112. Alternatively, or in addition, the air treatment member can comprise a bag, a filter or other air treating means. A suction motor 1114 that is mounted within the body 1112 and is in fluid communication with the cyclone bin assembly 1110.

The clean air outlet 1104, which is in fluid communication with an outlet of the suction motor 1114, is provided in the body 1112. In the illustrated example, the dirty air inlet 1102 is located toward the front of the surface cleaning apparatus 1100, and the clear air outlet 1104 is located toward the rear.

In the illustrated example, cyclone bin assembly 1110 includes a cyclone chamber 1118 and a dirt collection chamber 1120. The cyclone chamber 1118 is bounded by a sidewall 1122, a first end wall 1124 and a second end wall 1126 that are configured to provide an inverted cyclone configuration. A tangential air inlet 1128 is provided in the sidewall of the cyclone chamber 1118 and is in fluid communication with the air outlet of the hose connector 1108. Air flowing into the cyclone chamber 1118 via the tangential air inlet 1128 can circulate around the interior of the cyclone chamber 1118 and dirt particles and other debris can become disentrained from the circulating air.

A slot 1132 formed between the sidewall 1122 and the second end wall 1126 serves as a cyclone dirt outlet 1132. Debris separated from the air flow in the cyclone chamber 1118 can travel from the cyclone chamber 1118, through the dirt outlet 1132 to the dirt collection chamber 1120.

Air can exit the cyclone chamber 1118 via an air outlet. In the illustrated example, the cyclone air outlet includes a vortex finder 1134. Optionally, a removable screen 1136 can be positioned over the vortex finder 1134. The cyclone chamber 1118 extends along a longitudinal cyclone axis 1138. In the example illustrated, the longitudinal cyclone axis 1138 is aligned with the orientation of the vortex finder 1134.

The dirt collection chamber 1120 comprises a sidewall 1140, a first end wall 1142 and an opposing second end wall 1144. In the illustrated example, at least a portion of the dirt collection chamber sidewall 1140 is integral with a portion of the cyclone chamber sidewall 1122, and at least a portion of the first cyclone end wall 1124 is integral with a portion of the first dirt collection chamber end wall 1142.

Figure 42:
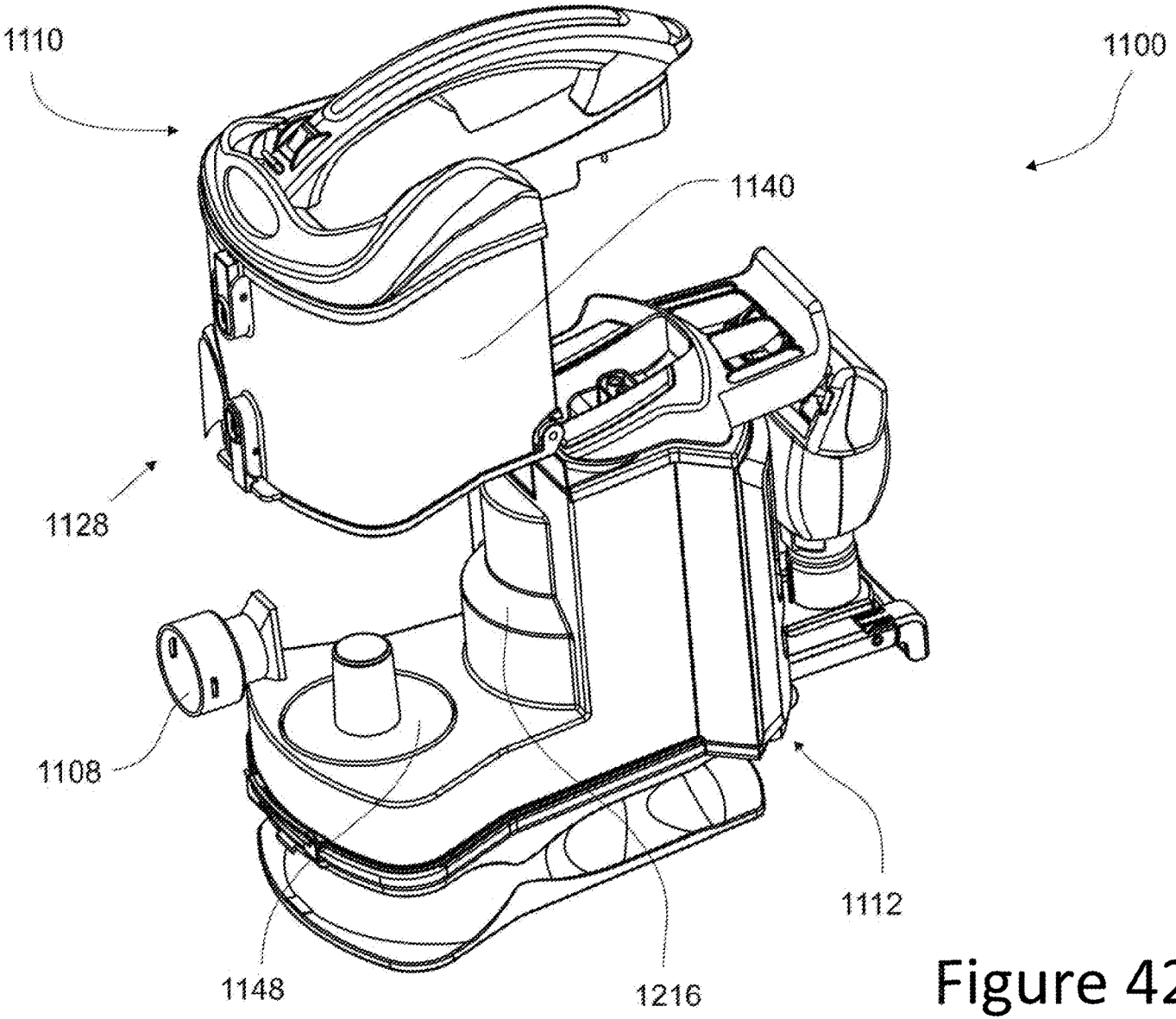
FIG. 42 is a perspective illustration of the surface cleaning apparatus of FIG. 41, with its cyclone bin assembly removed.

Referring to FIG. 42, the cyclone bin assembly 1110 is optionally detachably connected to the body 1112. In the example illustrated, the cyclone bin assembly 1110 is detachably mounted on a platform 1148. A releasable latch 1150 can be used to secure a front edge of the cyclone bin assembly 1110 to the body 1112.

Figure 41:
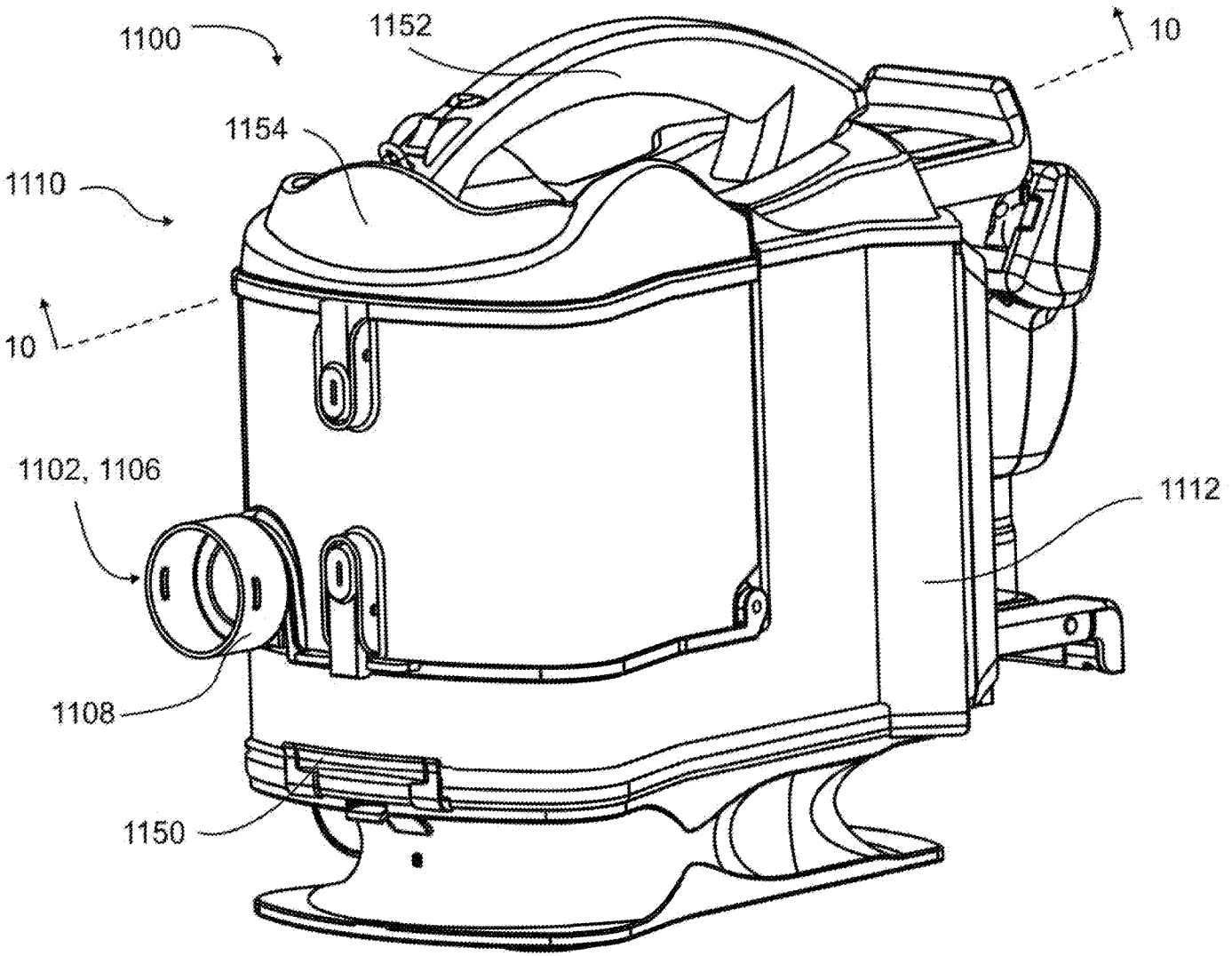
FIG. 41 is a perspective illustration of an alternate embodiment of a surface cleaning apparatus.

Referring to FIG. 41, a handle 1152 is provided on the top of the cyclone bin assembly 1110. The handle 1152 is configured to be grasped by a user. When the cyclone bin assembly 1110 is mounted on the body 1112, the handle 1152 can be used to manipulate the surface cleaning apparatus 1100. When the cyclone bin assembly 1110 is removed from the body 1112, the handle 1152 can be used to carry the cyclone bin assembly 110, for example to position the cyclone bin assembly 1110 above a waste receptacle for emptying. In the illustrated example, the handle 1152 is integral with a lid 1154 of the cyclone bin assembly 110.

Figure 43:
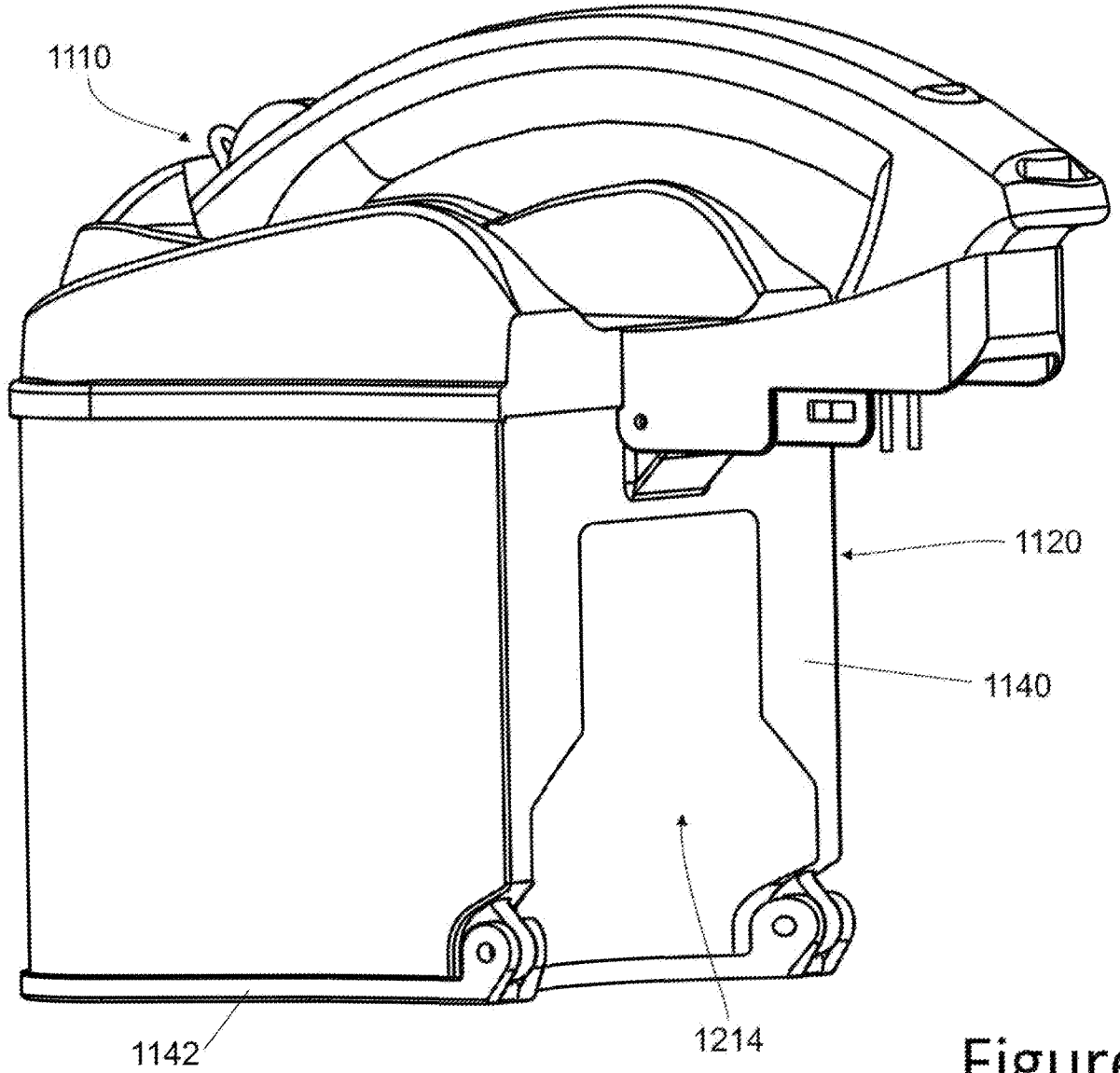
FIG. 43 is a perspective illustration of the cyclone bin assembly of FIG. 42.

Referring to FIGS. 43 and 44, the dirt collection chamber sidewall 1140 comprises a recess 1214 that is shaped to receive a corresponding portion of the body 1112. In the illustrated example, the recess 1214 is shaped to receive a portion of the motor housing 1216 surrounding the suction motor 1114. In this example, at least a portion of the dirt collection chamber 1120 is positioned between the cyclone chamber 1118 and the suction motor 1114. Preferably, at least a portion of the dirt collection chamber 1120 surrounds at least a portion of the suction motor 1114 and, if a suction motor housing is provided, the suction motor housing 1216. In the illustrated example, the dirt collection chamber 1120 surrounds only a portion of the motor housing 1216. The shape of the recess 1214 is preferably selected to correspond to the shape of the suction motor housing 1216 so as to maximize the size of the dirt collection chamber for the foot print of the vacuum cleaner. Configuring the dirt collection chamber 1120 to at least partially surround the suction motor housing 216 may help reduce the overall length of the surface cleaning apparatus 1100, and/or may help increase the capacity of the dirt collection chamber 1120.

Referring to FIG. 44, the dirt collection chamber 1120 also surrounds at least a portion of the cyclone chamber 1118. Optionally, the dirt collection chamber 1120 can be configured to completely surround the cyclone chamber 1118.

Air exiting the cyclone chamber 1118 flows to a suction motor 1114 inlet via a filter chamber 1186. The filter chamber 1186 is provided downstream from the cyclone air outlet. In the illustrated example, the filter chamber 1186 extends over substantially the entire lower portion of the body 1112 and overlies substantially all of the cyclone chamber 1118, dirt collection chamber 1120 and suction motor 1114.

A pre-motor filter 1218 is provided in the filter chamber 1186 to filter the air before it enters the suction motor inlet 1220. The pre-motor filter 1218 is sized to cover the entire area of the filter chamber 1186, and overlies substantially all of the cyclone chamber 1118, dirt collection chamber 1120 and suction motor 1114. Preferably, the cross sectional area (in the direction of air flow) of the pre-motor filter 1218 is greater than the cross sectional area of the cyclone chamber 1118 and the suction motor 1114. In the illustrated example, the pre-motor filter 1218 comprises first and second pre-motor filters 1218*a*, 1218*b*. The filter chamber 1186 comprises an air inlet chamber 1222 on the upstream side 1224 of the pre-motor filter 1218, and an air outlet chamber 1226 on the downstream side 1228 of the pre-motor filter 1218. Air can travel from the air inlet chamber 1222 to the air outlet chamber 1226 by flowing through the air-permeable pre-motor filter 1218. It will be appreciated that the larger the cross sectional area of the upstream face of the filter, the greater the capacity of the filter to filter particulates without the filter becoming clogged. Accordingly, it is preferred to make pre-motor filter 1218 as large as possible. Accordingly, it is preferred that filter chamber 1186 is as large as possible (i.e. it overlies all of an end face of the cyclone chamber, dirt collection chamber and suction motor) and that the pre-motor filter 1218 extends over the full transverse extent of filter chamber 1186. It will be appreciated that the filter chamber 1186 may overlie only a portion of the end face of the cyclone chamber, dirt collection chamber and suction motor but may still provide a larger upstream surface area then is the filter only overlied the cyclone chamber.

The lower side of the air filtration chamber comprises a filtration chamber end wall 1244. Optionally, the first end wall 1244 of the filter chamber 1186 can be openable to allow a user to access the pre-motor filter 1218. In the illustrated example, the filter chamber end wall 1244 is pivotally connected to the body 1112 by a hinge 1246 and can pivot to an open position. The releasable latch 1150 can be used to secure in a closed position. The latch 1150 can connect the filter chamber end wall 1244 to the cyclone bin assembly 1110. As exemplified and discussed hereafter, the upstream side of pre-motor filter 1218 is visible when filter chamber end wall 1244 is in the open position and accordingly, a user may readily detect if the pre-motor filter 1218 requires cleaning or changing.

The air inlet chamber 1222 is fluidly connected to the cyclone chamber air outlet by an inlet conduit 1230 that extends through the pre-motor filter 1218. In the illustrated example the inlet conduit 1230 comprises an extension of a vortex finder insert. The air outlet chamber 1226 is in fluid communication with the inlet 1220 of the suction motor 1114. The pre-motor filter 1218 may be supported by a plurality of support ribs 1232 extending through the air outlet chamber 1226. Gaps or cutouts can be provided in the ribs 1232 to allow air to circulate within the air outlet chamber 1226 and flow toward the suction motor inlet 1220. From the suction motor inlet 1220, the air is drawn through the suction motor 1114 and ejected via a suction motor outlet 1116. Optionally, a post-motor filter 1236 (for example a HEPA filter) can be provided downstream from the suction motor outlet 1116, between the suction motor outlet 1116 and the clean air outlet 1104. A detachable grill 1238 can be used to retain the post-motor filter 1236 in position, and allow a user to access the post-motor filter 1236 for inspection or replacement.

Another Alternate Hand Carriable Surface Cleaning Apparatus

Referring to FIGS. 45 to 50, another embodiment of a surface cleaning apparatus 2100 is shown. In the embodiment illustrated, the surface cleaning apparatus 2100 is a canister vacuum cleaner. The surface cleaning apparatus 2100 has a dirty air inlet 2102, a clean air outlet 2104 and an airflow passage extending therebetween. In the embodiment shown, the dirty air inlet 2102 is the air inlet of a suction hose connector 2106 that can be connected to the downstream end of a flexible suction hose or other type of cleaning accessory tool, including, for example, a surface cleaning head, a wand and a nozzle. From the dirty air inlet 2102, the airflow passage extends through an air treatment member 2108 that can treat the air in a desired manner, including for example removing dirt particles and debris from the air. In the illustrated example, the air treatment member 2108 comprises a cyclone bin assembly 2110. Alternatively, or in addition, the air treatment member 2108 can comprise a bag, a filter or other air treating means. A suction motor 2111 (FIG. 50) is mounted within a body 2112 of the surface cleaning apparatus 2100 and is in fluid communication with the cyclone bin assembly 2110. In the illustrated example, the body 2112 of the surface cleaning apparatus 2100 is a rollable, canister-type body that comprises a platform 2114 and two opposing sidewalls 2116*a*, 2116*b* that cooperate to define a central cavity 2118. The surface cleaning apparatus 2100 also comprises two main side wheels 2120*a*, 2120*b*, rotatably coupled to the sidewalls 2116*a* and 2116*b*, respectively.

The clean air outlet 2104, which is in fluid communication with an outlet of the suction motor 2111, is provided in the body 2112. In the illustrated example, the dirty air inlet 2102 is located toward the front 2122 of the surface cleaning apparatus 2100, and the clear air outlet is located toward the rear 2124.

Figure 50:
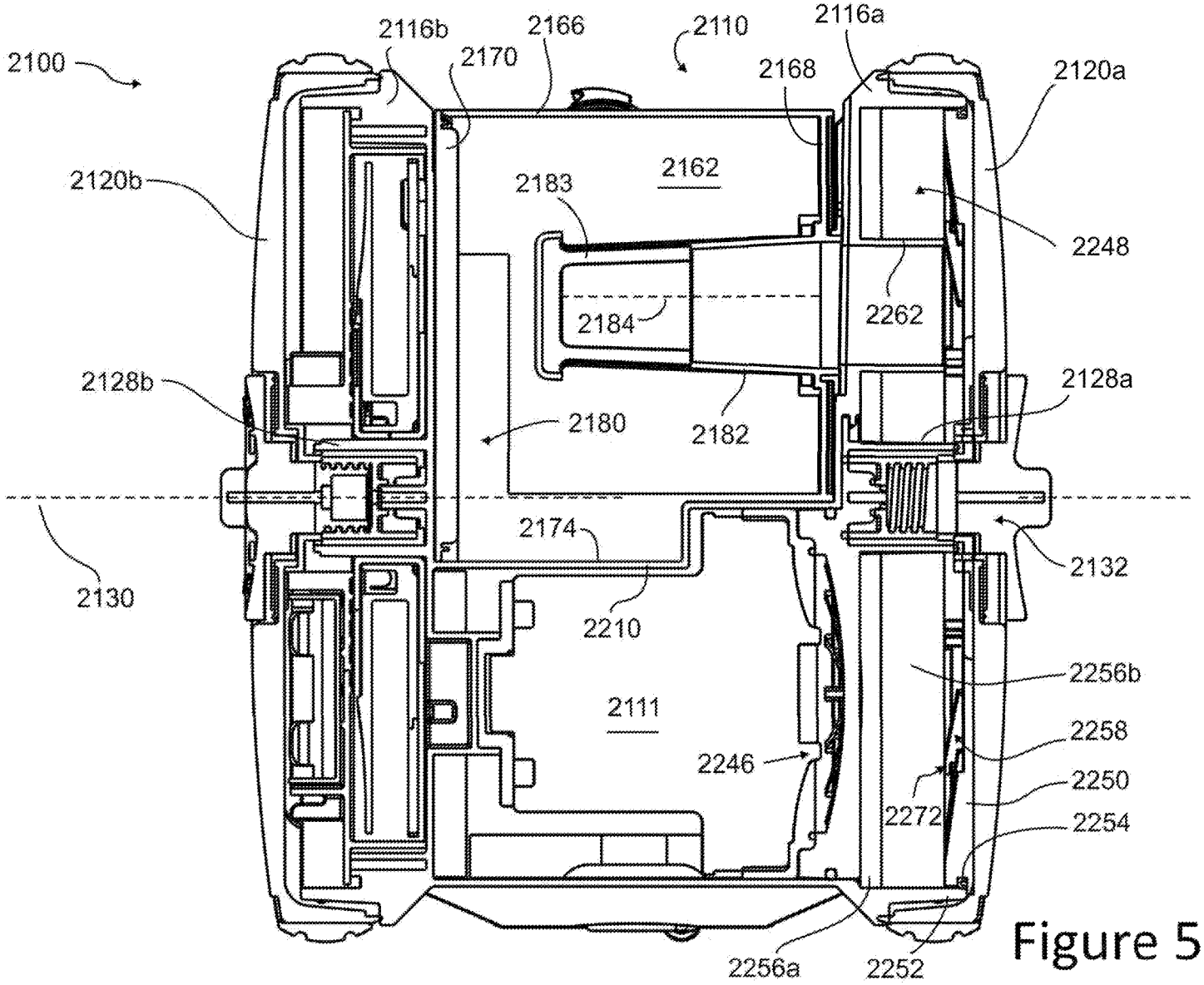
FIG. 50 is a section view taken along line 16-16 in FIG. 45.

In the illustrated example, the body sidewalls 2116*a, b* are generally circular and cover substantially the entire side faces of the surface cleaning apparatus 2100. One main side wheel 2120*a*, 2120*b* is coupled to the outer face of each body sidewall 2116*a* and 2116*b*, respectively. Optionally, the side wheels 2120*a*, 2120*b* may have a larger diameter 2126 than the body sidewalls 2116*a, b* and can completely cover the outer faces of the sidewalls 2116*a, b*. Referring to FIG. 50, each side wheel 2120*a, b* is rotatably supported by a corresponding axel 2128*a*, 2128*b*, which extends from the body sidewalls 2116*a* and 2116*b*, respectively. The main side wheels 2120*a* and 2120*b* are rotatable about a primary axis of rotation 2130. In the illustrated example, the primary axis of rotation 2130 passes through the cyclone bin assembly 2110.

Figure 49:
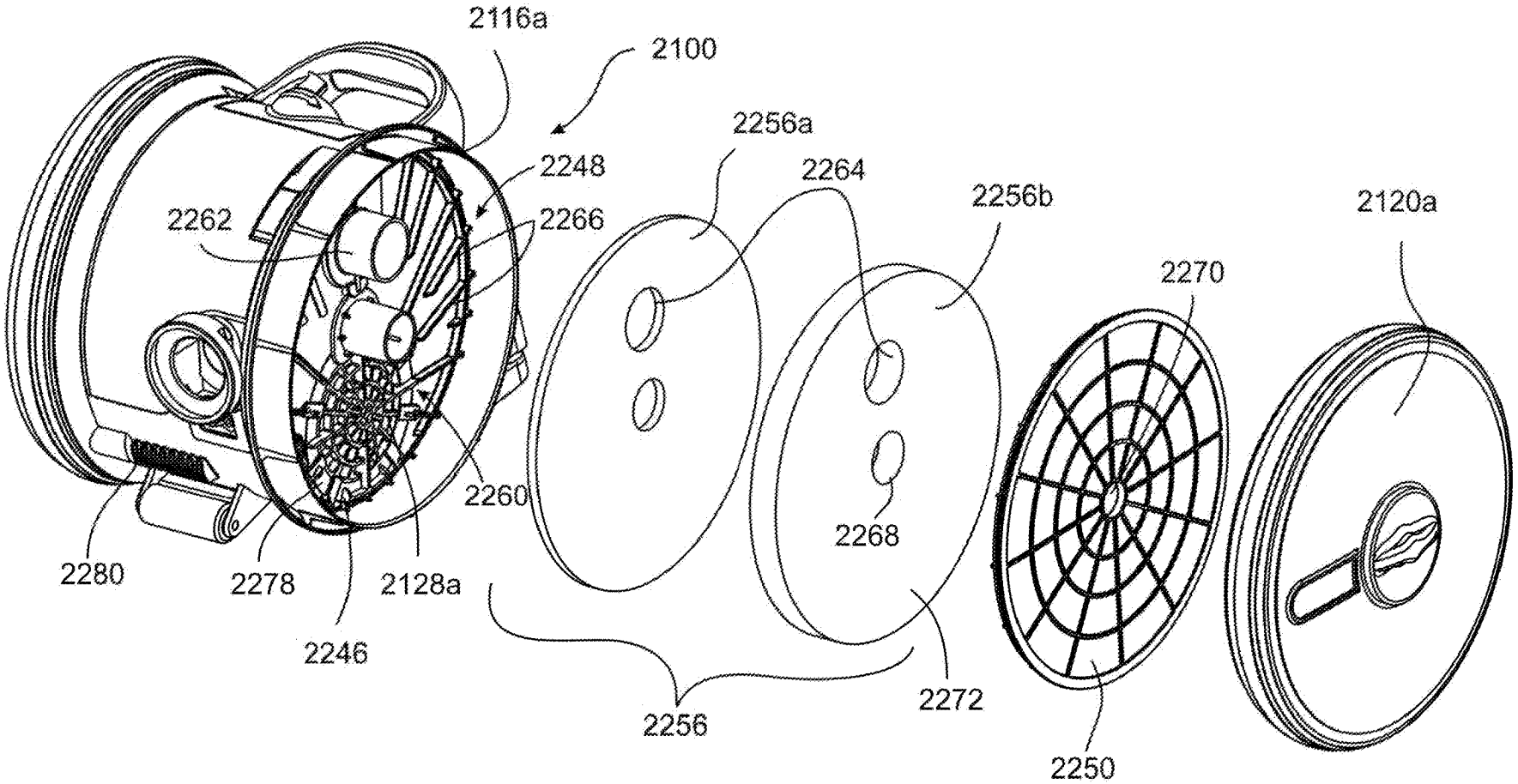
FIG. 49 is a partially exploded view of the surface cleaning apparatus of FIG. 45.

Optionally, at least one of the side wheels 120*a, b* can be detachable from the body 2112. Referring to FIG. 49, in the illustrated example side wheel 2120*a* is detachably coupled to its corresponding axels 2128*a* by a threaded hub assembly 2132*a*, and can be removed from the body 2112. Removing the side wheel 2120*a* from the body 112, or otherwise positioning them in an open configuration, may allow a user to access a variety of components located in compartments between the side wheels 120*a* and 120*b* and the corresponding sidewalls 116*a* and 116*b*, as explained in greater detail below.

FIGS. 46, 47, 48 and 50 illustrated an example of a cyclone bin assembly 2110 includes a cyclone chamber 2162 and a dirt collection chamber 2164 in accordance with one embodiment. The cyclone bin assembly 2110 is detachably mounted in the cavity 2118, laterally between the sidewalls 2116*a*, 2116*b* and side wheels 2120*a*, 2120*b*. Positioning the cyclone bin assembly 2110 in the cavity 2118, between the body sidewalls 2116*a*, 2116*b* may help protect the cyclone bin assembly 2110 from side impacts, for example if the surface cleaning apparatus 2100 contacts a piece of furniture or other obstacle. Preferably, the body sidewalls 2116*a*, 2116*b* have a larger cross-sectional area than the cyclone bin assembly 2110. More preferably, the transverse faces of the cyclone bin assembly 2110 are entirely covered by the body sidewalls 2116*a*, 2116*b*.

In the illustrated example, the cyclone chamber 2162 is bounded by a sidewall 2166, a first end wall 2168 and a second end wall 2170. A tangential air inlet 2172 is provided in the sidewall of the cyclone chamber 2162 and is in fluid communication with the dirty air inlet 2102. Air flowing into the cyclone chamber 2162 via the air inlet can circulate around the interior of the cyclone chamber 2162 and dirt particles and other debris can become disentrained from the circulating air.

A slot 2180 formed between the sidewall 2166 and the second end wall 2170 serves as a cyclone dirt outlet 2180. Debris separated from the air flow in the cyclone chamber 2162 can travel from the cyclone chamber 2162, through the dirt outlet 2180 to the dirt collection chamber 2164.

Air can exit the cyclone chamber 2162 via an air outlet. In the illustrated example, the cyclone air outlet includes a vortex finder 2182. Optionally, a removable screen 2183 can be positioned over the vortex finder 2182. The cyclone chamber 2162 extends along a longitudinal cyclone axis 2184. In the example illustrated, the longitudinal cyclone axis is aligned with the orientation of the vortex finder 2182 and is generally transverse to the direction of movement of the surface cleaning apparatus 2100. The cyclone chamber 2162 has a generally circular cross sectional shape (taken in a plane perpendicular to the cyclone axis) and has a cyclone diameter 2186.

The dirt collection chamber 2164 comprises a sidewall 2174, a first end wall 2176 and an opposing second end wall 2178. In the illustrated example, at least a portion of the dirt collection chamber sidewall 2174 is integral with a portion of the cyclone chamber sidewall 2166, and at least a portion of the first cyclone end wall 2168 is integral with a portion of the first dirt collection chamber end wall 2176.

Figure 46:
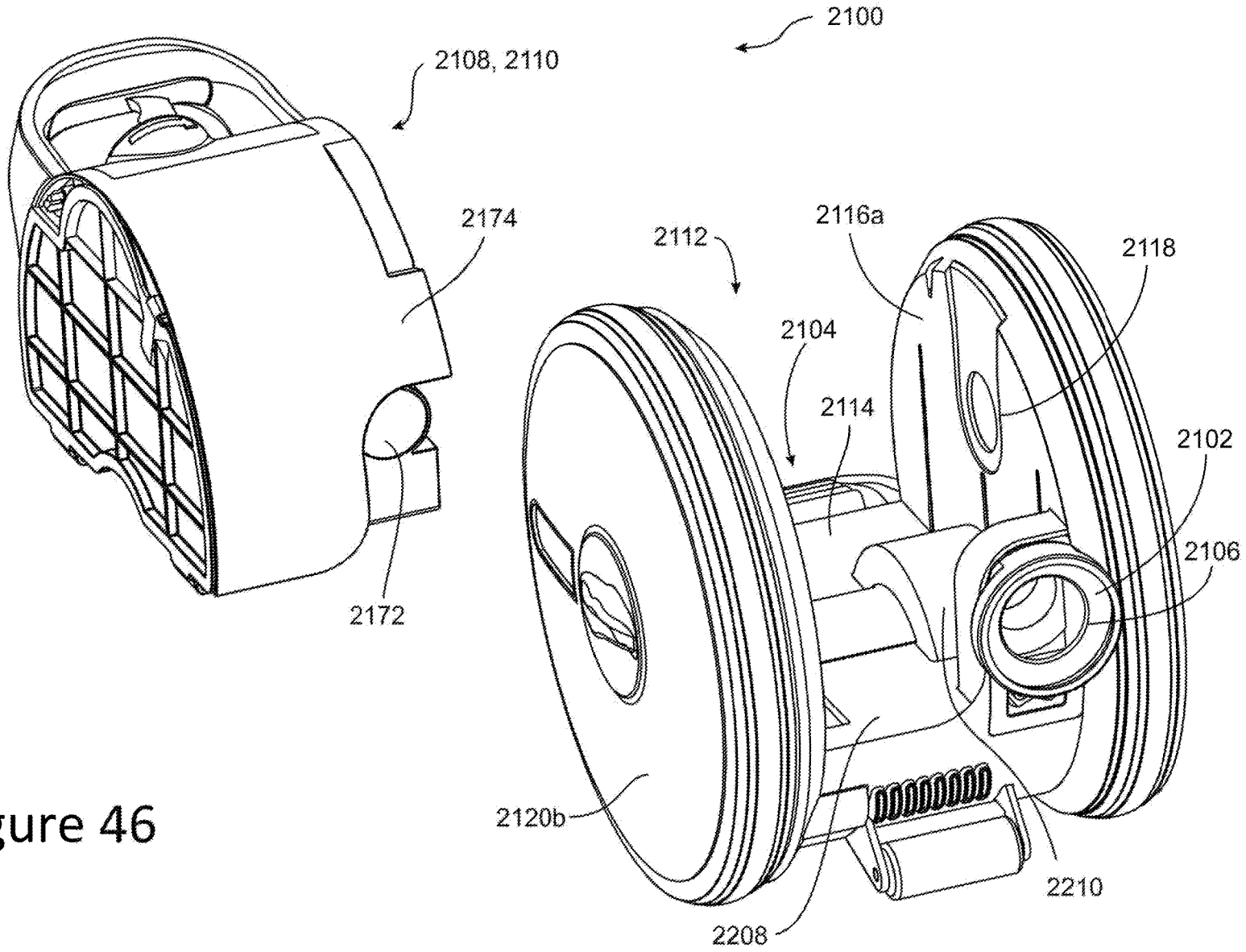
FIG. 46 is a perspective illustration of the surface cleaning apparatus of FIG. 45, with its cyclone bin assembly removed.
Figure 48:
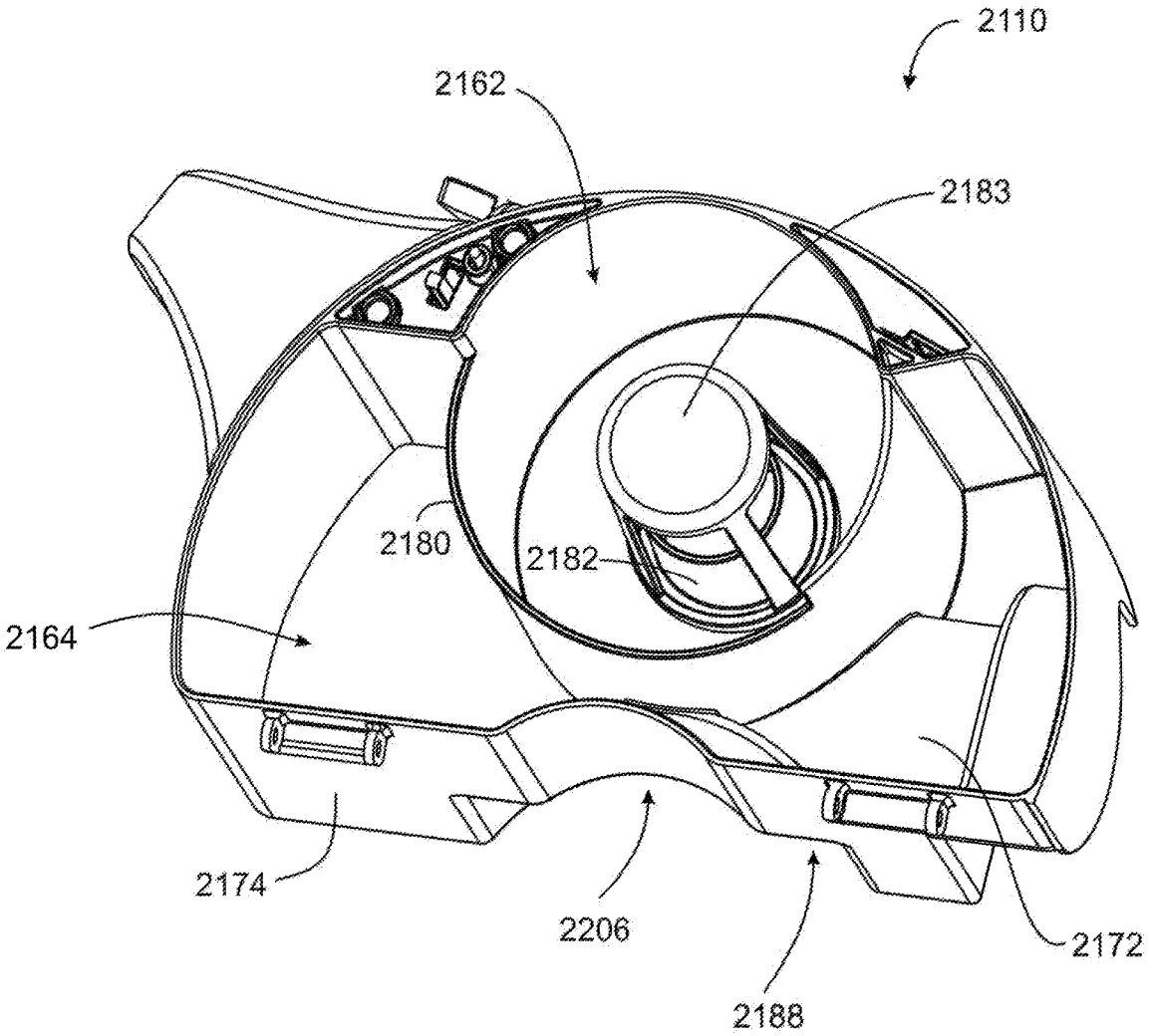
FIG. 48 is a perspective illustration of the cyclone bin assembly of FIG. 47, with the one end wall removed.

Referring to FIGS. 46 and 48, a lower surface 2188 of the cyclone bin assembly 2110 is configured to rest on the platform 2114, and the first and second end walls 2168, 2170 of the cyclone bin assembly 2110 are shaped to engage the inner surfaces of the body sidewalls 2116*a*, 2116*b*, respectively. The upper portion of the cyclone bin (as viewed when installed in the cavity 2118) can have a radius of curvature that generally corresponds to the radius of curvature of the body sidewalls 2116*a*, 2116*b* and the side wheels 2120*a*, 2120*b*. Matching the curvature of the cyclone bin assembly 2110 with the curvature of the side wheels 120*a*, 120*b* may help facilitate mounting of the cyclone bin assembly 2110 within the body 2112, so that the walls of the cyclone bin assembly 2110 do not extend radially beyond the body sidewalls 2116*a*, 1216*b* or main side wheels 2120*a*, 2120*b*.

Figure 47:
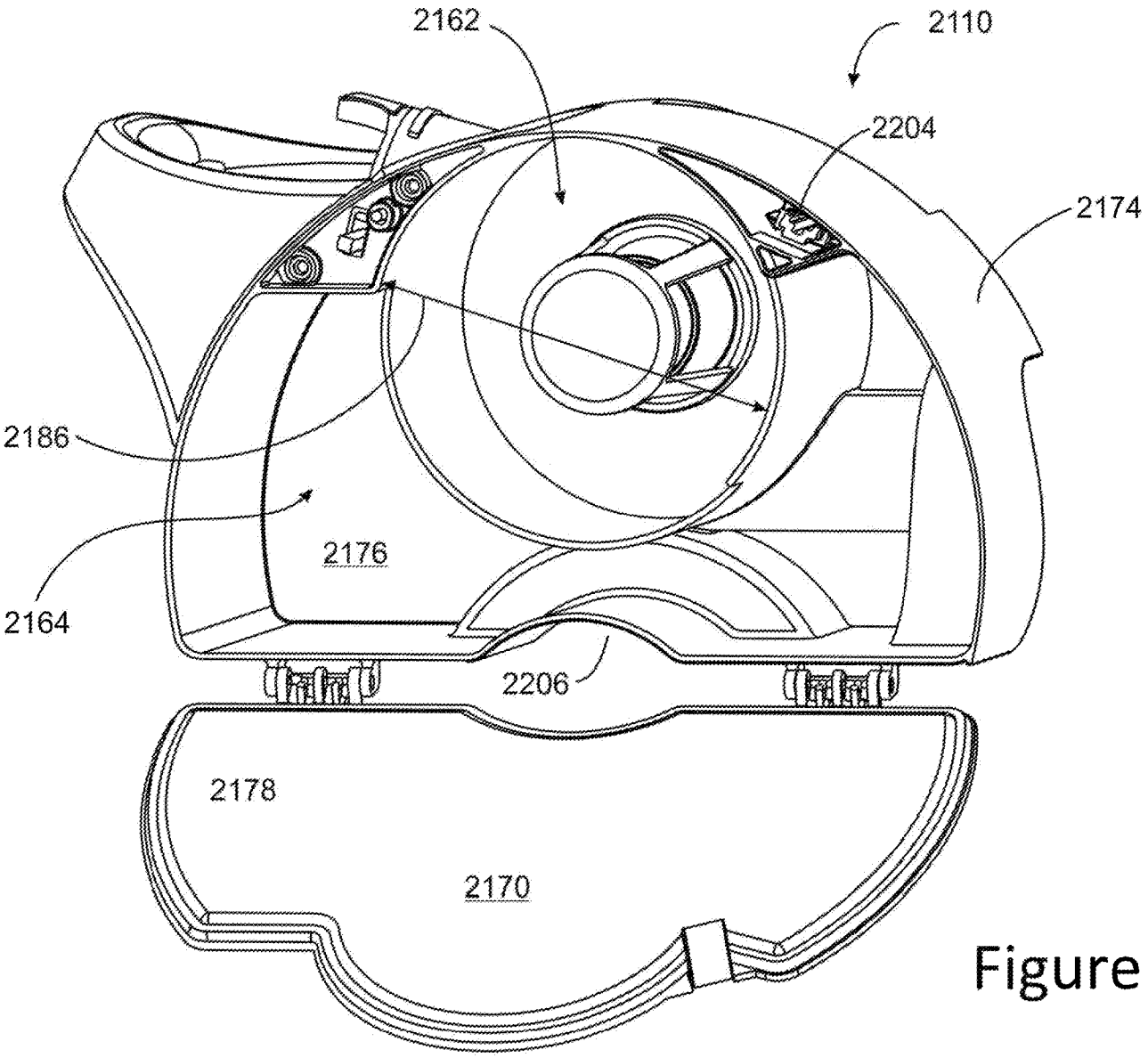
FIG. 47 is a perspective illustration of the cyclone bin assembly of FIG. 45, with one end wall in an open configuration.

Referring to FIG. 47, the second dirt collection chamber end wall 2178 is preferably pivotally connected to the dirt collection chamber sidewall 2174. The second dirt collection chamber end wall 2178 can be opened to empty dirt and debris from the interior of the dirt collection chamber 2164. Optionally, the second cyclone end wall 2170 is integral with and is openable with the second dirt collection chamber end wall 2178. Opening the second cyclone end wall 2170 can allow dirt and debris to be emptied from the cyclone chamber 2162. The second dirt collection chamber sidewall 2178 can be retained in the closed position by a releasable latch 2204. Optionally, the screen 2183 and/or the vortex finder 2182 can be removable from the cyclone chamber 2162 and can be removed when the second dirt collection chamber end wall 2178 is open.

Referring to FIGS. 47 and 48, the dirt collection chamber sidewall 2174 comprises a recess 2206 that is shaped to receive a corresponding portion of the body 2112. Referring to FIG. 46, in the illustrated example, the platform 2114 comprises a generally planar bearing surface 2208 for supporting the cyclone bin assembly 2110. The platform 2114 also comprises at least a portion of the suction motor housing 2210 surrounding the suction motor 2111. In this example, the recess 2206 in the dirt collection chamber sidewall 2174 is shaped to receive the portion of the motor housing 2210 projecting above the planar bearing surface 2208.

Preferably, at least a portion of the dirt collection chamber 2164 surrounds at least a portion of the suction motor 2111 and the suction motor housing 2210. In this example, at least a portion of the dirt collection chamber 2164 is positioned between the cyclone chamber 2162 and the suction motor housing 2210 (and the suction motor 2111 therein). Configuring the dirt collection chamber 2164 to at least partially surround the suction motor housing 2210 may help reduce the overall size of the surface cleaning apparatus 2100, and/or may help increase the capacity of the dirt collection chamber 2164. The dirt collection chamber 2164 also surrounds at least a portion of the cyclone chamber 2162.

Referring to FIGS. 49 and 50, air exiting the cyclone chamber 2162 flows to a suction motor inlet 2246 via a filter chamber 2248. The filter chamber 2248 is provided downstream from the cyclone air outlet. In the illustrated example, the filter chamber 2248 comprises a recessed chamber in the body sidewall 2116*a* that is enclosed by an openable seal plate 2250. A sealing gasket 2254 is provided at the interface between an annular rim 2252 of the sidewall 2116*a* and the seal plate 2250 to help provide an air-tight filter chamber 2248. In the illustrated example, the filter chamber 2248 extends over substantially the entire sidewall 2116*a* and overlies substantially all of the transverse cross sectional area of cyclone chamber 2162, dirt collection chamber 2164 and suction motor 2111.

A pre-motor filter 2256 is provided in the filter chamber 2248 to filter the air before it enters the suction motor inlet. The pre-motor filter 2256 is sized to cover substantially the entire area of the filter chamber 2248, and overlies substantially all of the transverse cross sectional area of the cyclone chamber 2162, dirt collection chamber 2164 and suction motor 2111. In the illustrated example, the pre-motor filter 2256 comprises first and second pre-motor filters 2256*a*, 2256*b*. The filter chamber 2248 comprises an air inlet chamber 2258 on the upstream side of the pre-motor filter 256, and an air outlet chamber 2260 on the downstream side of the pre-motor filter 2256. Air can travel from the air inlet chamber 2258 to the air outlet chamber 2260 by flowing through the pre-motor filter 2256.

The air inlet chamber 2258 is fluidly connected to the vortex finder 2182 by an inlet conduit 2262 that extends through a first aperture 2264 in the pre-motor filter 2256. The air outlet chamber 2260 is in fluid communication with the inlet 2246 of the suction motor 2111. The pre-motor filter 2256 can be supported by a plurality of support ribs 2266 extending from the sidewall 2116*a* into the air outlet chamber 2260. Cutouts can be provided in the ribs to allow air to circulate within the air outlet chamber 2266 and flow toward the suction motor inlet 2246.

In the illustrated example, the axle 2128*a* for supporting the side wheel extends through the air filter chamber 2248, a second aperture 2268 in the pre-motor filter 2256 and through an axel aperture 2270 in the seal plate 2250. The axle aperture 2270 in the seal plate 2250 is configured to provide an air-tight seal against the axel 2128*a*. Optionally, a sealing gasket can be provided at the interface between the seal plate 2250 and the axel 2128*a*. In this configuration the pre-motor filter 2256 surrounds the axel 2128*a*.

In the illustrated example, the seal plate 2250 is removable, when the side wheel 2120*a* is detached, to allow a user to access the pre-motor filter 2256. Alternatively, instead of being removable, the seal plate 2250 can be movably attached to the body 2112, for example pivotally connected to the sidewall 2116*a*, such that the seal plate 2250 can be opened without being completely detached from the body 2112.

Preferably, the seal plate 2250 is transparent, or at least partially transparent. Providing a transparent seal plate 2250 may help facilitate visual inspection of the upstream side 2272 of the pre-motor filter 2256 while the seal plate 2250 is in place. When the seal plate 2250 is removed, the pre-motor filter 2256 may be removed, for example for cleaning or replacement.

A bleed valve is provided to supply clean air to the suction motor inlet. In the illustrated example a bleed valve air outlet 2278 is in fluid communication with the air outlet chamber 2260 and can introduce clean air into the air outlet chamber 2260 downstream from the pre-motor filter 2256. Air introduced by the bleed valve can flow through the cutouts in the supporting ribs 2266, as described above. The bleed valve may be a pressure sensitive valve that is opened when there is a blockage in the air flow path upstream from the suction motor 2111. In the illustrated example, the bleed valve is parallel with the suction motor 2111. A bleed valve inlet 2280 (see also FIG. 45) is provided toward the front of the body 2112.

It will be appreciated that, in one embodiment, the enhanced dirt collection chamber construction may be used by itself without the enhanced filter chamber design. Alternately, both the enhanced dirt collection chamber construction and the enhanced filter chamber design may be used concurrently as exemplified herein. It will also be appreciated that the cyclone chamber may be of any design and configuration. When either of the enhanced dirt collection chamber construction and/or the enhanced filter chamber design are used, the vacuum cleaner may be of any design and the dirt collection chamber may or may not be removably mounted from the vacuum cleaner.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

I claim:

1. A hand vacuum cleaner comprising:

(a) an air flow path extending from a dirty air inlet to a clean air outlet;

(b) a cyclone assembly positioned in the air flow path, the cyclone assembly comprising a cyclone chamber and a dirt collection chamber having an openable end wherein, when the hand vacuum cleaner is positioned with the dirty air inlet positioned at an upper end of the hand vacuum cleaner, a cyclone axis of rotation extends vertically and the openable end of the dirt collection chamber comprises a lower end of the dirt collection chamber which, when in an open position, is attached as part of the hand vacuum cleaner;

(c) a main body housing a suction motor positioned in the air flow path; and, (d) a handle provided on the main body;

wherein the cyclone chamber has a diameter in a direction that is transverse to the cyclone axis of rotation and a portion of the dirt collection chamber that is positioned below the cyclone chamber has a diameter in the direction that is greater than the diameter of the cyclone chamber.

2. The hand vacuum cleaner of claim 1 wherein the cyclone chamber has a cyclone chamber air inlet and a cyclone chamber air outlet and, when the hand vacuum cleaner is positioned with the cyclone axis of rotation extending vertically, the cyclone air inlet and the cyclone chamber air outlet are provided at an upper end of the cyclone chamber and a dirt outlet is provided at a lower end of the cyclone chamber.

3. The hand vacuum cleaner of claim 2 wherein the lower end of the dirt collection chamber comprises an openable wall and the openable end of the dirt collection chamber is rotationally mounted as part of the cyclone assembly.

4. The hand vacuum cleaner of claim 1 wherein, when the hand vacuum cleaner is positioned with the cyclone axis of rotation extending vertically, the openable end of the dirt collection chamber is positioned below the cyclone chamber.

5. The hand vacuum cleaner of claim 1 wherein, when the hand vacuum cleaner is positioned with the cyclone axis of rotation extending vertically, the cyclone chamber has an upper end, an opposed lower openable end and a sidewall extending between the upper and lower ends of the cyclone chamber, and the dirt outlet comprises a spacing between a lower end of the sidewall and the opposed lower openable end of the cyclone chamber.

6. The hand vacuum cleaner of claim 1 wherein the dirt collection chamber includes a volume that faces the dirt outlet and an axis that extends in the direction extends through the volume, the dirt outlet and the cyclone chamber.

7. The hand vacuum cleaner of claim 1 wherein, when the hand vacuum cleaner is positioned with the cyclone axis of rotation extending vertically, a front side of the dirt collection chamber extends upwardly and a front wall of the cyclone assembly is angled rearwardly at a location above a location of the dirt outlet.

8. The hand vacuum cleaner of claim 7 wherein, when the hand vacuum cleaner is positioned with the cyclone axis of rotation extending vertically, an open area is provided above a forward portion of the dirt collection chamber and rearward of a vertical plane located at a front end of the dirt collection chamber.

9. The hand vacuum cleaner of claim 1 wherein a front end of the hand vacuum cleaner comprises the dirty air inlet and an electrical connector and, when the hand vacuum cleaner is positioned with the cyclone axis of rotation extending vertically a vertical plane located at a front end of the dirt collection chamber extends through the electrical connector.

10. The hand vacuum cleaner of claim 1 wherein a front end of the hand vacuum cleaner comprises an inlet conduit extending downstream from the dirty air inlet and, when the hand vacuum cleaner is positioned with the cyclone axis of rotation extending vertically a vertical plane located at a front end of the dirt collection chamber extends through the inlet conduit.

11. A hand vacuum cleaner comprising:

(a) an air flow path extending from a dirty air inlet to a clean air outlet wherein the dirty air inlet comprises an inlet conduit that extends rearwardly and has an axis that extends in a forward/rearward direction;

(b) an air treatment member positioned in the air flow path, the air treatment member comprising an air treatment chamber and a dirt collection chamber having an openable end wherein, when the hand vacuum cleaner is positioned with the dirty air inlet positioned at an upper end of the hand vacuum cleaner, the openable end of the dirt collection chamber comprises a lower end of the dirt collection chamber which, when in an open position, is attached as part of the hand vacuum cleaner;

(c) a main body housing a suction motor positioned in the air flow path; and, (d) a handle provided on the main body;

wherein the air treatment chamber has a diameter in the forward/rearward direction and a portion of the dirt collection chamber that is positioned below the air treatment chamber has a diameter in the forward/rearward direction that is greater than the diameter of the air treatment chamber.

12. The hand vacuum cleaner of claim 11 wherein the air treatment chamber has an air treatment chamber air inlet and an air treatment chamber air outlet and, when the hand vacuum cleaner is positioned with the dirty air inlet positioned at the upper end of the hand vacuum cleaner, the air treatment chamber air inlet and the air treatment chamber air outlet are provided at an upper end of the air treatment chamber and a dirt outlet is provided at a lower end of the air treatment chamber.

13. The hand vacuum cleaner of claim 12 wherein the lower end of the dirt treatment chamber comprises an openable wall and the openable end of the dirt collection chamber is rotationally mounted as part of the air treatment member.

14. The hand vacuum cleaner of claim 11 wherein, when the hand vacuum cleaner is positioned with the dirty air inlet positioned at the upper end of the hand vacuum cleaner, the openable end of the dirt collection chamber is positioned below the air treatment chamber.

15. The hand vacuum cleaner of claim 11 wherein, when the hand vacuum cleaner is positioned with the dirty air inlet positioned at the upper end of the hand vacuum cleaner, the air treatment chamber has an upper end, an opposed lower openable end and a sidewall extending between the upper and lower ends of the air treatment chamber, and the dirt outlet comprises a spacing between a lower end of the sidewall and the opposed lower openable end of the air treatment chamber.

16. The hand vacuum cleaner of claim 11 wherein the dirt collection chamber includes a volume that faces the dirt outlet and an axis that extends in the forward/rearward direction extends through the volume, the dirt outlet and the air treatment chamber.

17. The hand vacuum cleaner of claim 11 wherein, when the hand vacuum cleaner is positioned with the dirty air inlet positioned at the upper end of the hand vacuum cleaner, a front side of the dirt collection chamber extends upwardly and a front wall of the air treatment member is angled rearwardly at a location above a location of the dirt outlet.

18. The hand vacuum cleaner of claim 17 wherein, when the hand vacuum cleaner is positioned with the dirty air inlet positioned at the upper end of the hand vacuum cleaner, an open area is provided below the dirty air inlet and above a forward portion of the dirt collection chamber.

19. The hand vacuum cleaner of claim 11 wherein a front end of the hand vacuum cleaner comprises the dirty air inlet and an electrical connector and a front end of the dirt collection chamber is recessed rearwardly of a front end of the electrical connector.

20. The hand vacuum cleaner of claim 11 wherein a front end of the hand vacuum cleaner comprises the dirty air inlet and a front end of the dirt collection chamber is recessed rearwardly of a front end of the dirty air inlet.

* * * * *